US011291882B2

(12) United States Patent
Carruthers

(10) Patent No.: US 11,291,882 B2
(45) Date of Patent: Apr. 5, 2022

(54) CLIMBING EXERCISE MACHINE

(71) Applicant: CLMBR1, LLC, Denver, CO (US)

(72) Inventor: Nathaniel Carruthers, Austin, TX (US)

(73) Assignee: CLMBR1, LLC., Denver, CO (US)

( * ) Notice: Subject to any disclaimer, the term of this patent is extended or adjusted under 35 U.S.C. 154(b) by 0 days.

(21) Appl. No.: 17/458,810

(22) Filed: Aug. 27, 2021

(65) Prior Publication Data

US 2021/0387047 A1 Dec. 16, 2021

Related U.S. Application Data

(60) Division of application No. 17/225,706, filed on Apr. 8, 2021, which is a continuation-in-part of application (Continued)

(51) Int. Cl.

*A63B 22/04* (2006.01)
*A63B 21/00* (2006.01)

(Continued)

(52) U.S. Cl.

CPC ..... *A63B 22/04* (2013.01); *A63B 21/00069* (2013.01); *A63B 21/4034* (2015.10); *A63B 21/4035* (2015.10); *A63B 21/4045* (2015.10); *A63B 22/001* (2013.01); *A63B 22/0005* (2015.10); *A63B 22/0046* (2013.01); *A63B 21/154* (2013.01); *A63B 23/03575* (2013.01); *A63B 69/0048* (2013.01); *A63B 2022/0043* (2013.01)

(58) Field of Classification Search

CPC ..... A63B 69/0048; A63B 22/20–208; A63B 69/18; A63B 69/182; A63B 23/02–0244

See application file for complete search history.

(56) References Cited

U.S. PATENT DOCUMENTS 3,381,958 A * 5/1968 Gulland ..... A63B 22/001 482/96
4,529,194 A * 7/1985 Haaheim ..... A63B 21/012 482/70

(Continued)

OTHER PUBLICATIONS

Official Action for U.S. Appl. No. 17/458,794, dated Dec. 2, 2021 6 pages, Restriction Requirement.

(Continued)

*Primary Examiner* — Nyca T Nguyen
(74) *Attorney, Agent, or Firm* — Sheridan Ross P.C.

(57) ABSTRACT

An exercise machine creates a simulated continuous resisted climbing motion. The machine includes a floor- or ground-contacting base frame and two or more substantially vertically oriented uprights, wherein at least one upright is rigidly connected to the base frame. The machine further includes two handles and two foot pedals, each handle and each foot pedal being movably engaged with an upright for linear reciprocating motion along the upright. The handles and foot pedals are interconnected so that they move concurrently. An adjustable resistance mechanism may be operatively connected to the interconnection of the handles and foot pedals to provide adjustable resistance for the simulated continuous climbing motion.

20 Claims, 58 Drawing Sheets

Related U.S. Application Data

No. 17/118,355, filed on Dec. 10, 2020, now Pat. No. 11,077,336, which is a continuation-in-part of application No. PCT/US2020/036434, filed on Jun. 5, 2020.

(60) Provisional application No. 62/858,966, filed on Jun. 7, 2019.

(51) Int. Cl.

| | |
|---|---|
| ***A63B 22/00*** | (2006.01) |
| *A63B 23/035* | (2006.01) |
| *A63B 69/00* | (2006.01) |

(56) References Cited

U.S. PATENT DOCUMENTS

| | | | | | |
|---|---|---|---|---|---|
| 4,958,830 | A * | 9/1990 | Huggins | A61H 1/0259 | 482/51 |
| 4,982,952 | A * | 1/1991 | Wang | A63B 22/001 | 482/53 |
| 5,000,442 | A * | 3/1991 | Dalebout | A63B 21/018 | 482/120 |
| 5,040,785 | A * | 8/1991 | Charnitski | A63B 23/0417 | 482/51 |
| 5,199,932 | A * | 4/1993 | Liao | A63B 22/001 | 482/113 |
| 5,203,751 | A * | 4/1993 | Chang | A63B 22/0002 | 482/51 |
| 5,256,117 | A * | 10/1993 | Potts | A63B 21/157 | 482/52 |
| 5,299,995 | A * | 4/1994 | Ko | A63B 23/0417 | 482/52 |
| 5,490,818 | A * | 2/1996 | Haber | A63B 22/001 | 482/112 |
| 5,492,515 | A * | 2/1996 | Charnitski | A63B 22/001 | 482/37 |
| 5,803,880 | A * | 9/1998 | Allen | A63B 21/0087 | 482/113 |
| 5,928,115 | A * | 7/1999 | Arroyo, Jr. | A63B 22/0005 | 482/62 |
| 6,042,516 | A * | 3/2000 | Norton | A63B 22/0002 | 482/54 |
| 6,152,859 | A * | 11/2000 | Stearns | A63B 22/0007 | 482/52 |
| 6,155,959 | A * | 12/2000 | Arroyo, Jr. | A63B 21/012 | 482/37 |
| 6,702,722 | B1 * | 3/2004 | Arroyo, Jr. | A63B 21/012 | 482/37 |
| 10,179,260 | B1 * | 1/2019 | Stearns | A63B 21/4045 | |
| 10,188,890 | B2 * | 1/2019 | Olson | A63B 21/4035 | |
| 10,328,302 | B2 * | 6/2019 | Yeh | A63B 22/0056 | |
| D853,504 | S * | 7/2019 | Mercenari Uribe | A63B 22/001 | D21/670 |
| 2010/0144496 | A1 * | 6/2010 | Schmidt | A63B 21/4035 | 482/70 |
| 2010/0248919 | A1 * | 9/2010 | Zhou | A63B 22/203 | 482/139 |
| 2012/0115694 | A1 * | 5/2012 | Chen | A63B 23/0227 | 482/142 |
| 2015/0343259 | A1 * | 12/2015 | Mercenari Uribe | A63B 22/205 | 482/52 |
| 2017/0157445 | A1 * | 6/2017 | Young | A63B 21/22 | |
| 2019/0009129 | A1 * | 1/2019 | Liao Lai | A63B 22/0002 | |
| 2019/0070453 | A1 * | 3/2019 | Kiani | A63B 22/0025 | |
| 2019/0105529 | A1 * | 4/2019 | Canali | A63B 21/4035 | |
| 2019/0160331 | A1 * | 5/2019 | Mercenari Uribe | A63B 21/008 | |
| 2020/0171346 | A1 * | 6/2020 | Chen | A63B 22/205 | |

OTHER PUBLICATIONS

Official Action for U.S. Patent Application No. 17/458,799, dated Dec. 9, 2021 34 pages.
Official Action for U.S. Appl. No. 17/458,806, dated Nov. 23, 2021 6 pages, Restriction Requirement.
Ex Parte Quayle Action for U.S. Appl. No. 17/458,818, dated Dec. 6, 2021 10 pages.
Official Action for U.S. Patent Application No. 17/458,831, dated Nov. 26, 2021 15 pages.
Official Action for U.S. Appl. No. 17/458,839, dated Dec. 15, 2021 27 pages.
Official Action for U.S. Appl. No. 17/458,850, dated Dec. 8, 2021 9 pages.
Notice of Allowance for U.S, U.S. Appl. No. 17/466,589, dated Jan. 11, 2022 10 pages.
Official Action for U.S. Appl. No. 17/466,610, dated Nov. 24, 2021 21 pages.
Notice of Allowance for U.S. Appl. No. 17/466,631, dated Nov. 22, 2021 13 pages.
Notice of Allowance for U.S. Appl. No. 17/466,659, dated Dec. 24, 2021 11 pages.
Notice of Allowance for U.S. Appl. No. 17/490,083, dated Nov. 30, 2021 11 pages.
Corrected Notice of Allowance for U.S. Appl. No. 17/490,083, dated Jan. 5, 2022 7 pages.
Official Action for U.S. Patent Application No. 17/490,098, dated Nov. 26, 2021 28 pages.
Official Action for U.S. Appl. No. 17/490,121, dated Nov. 19, 2021 7 pages, Restriction Requirement.
Official Action for U.S. Appl. No. 17/490,121, dated Feb. 10, 2022 13 pages.

* cited by examiner

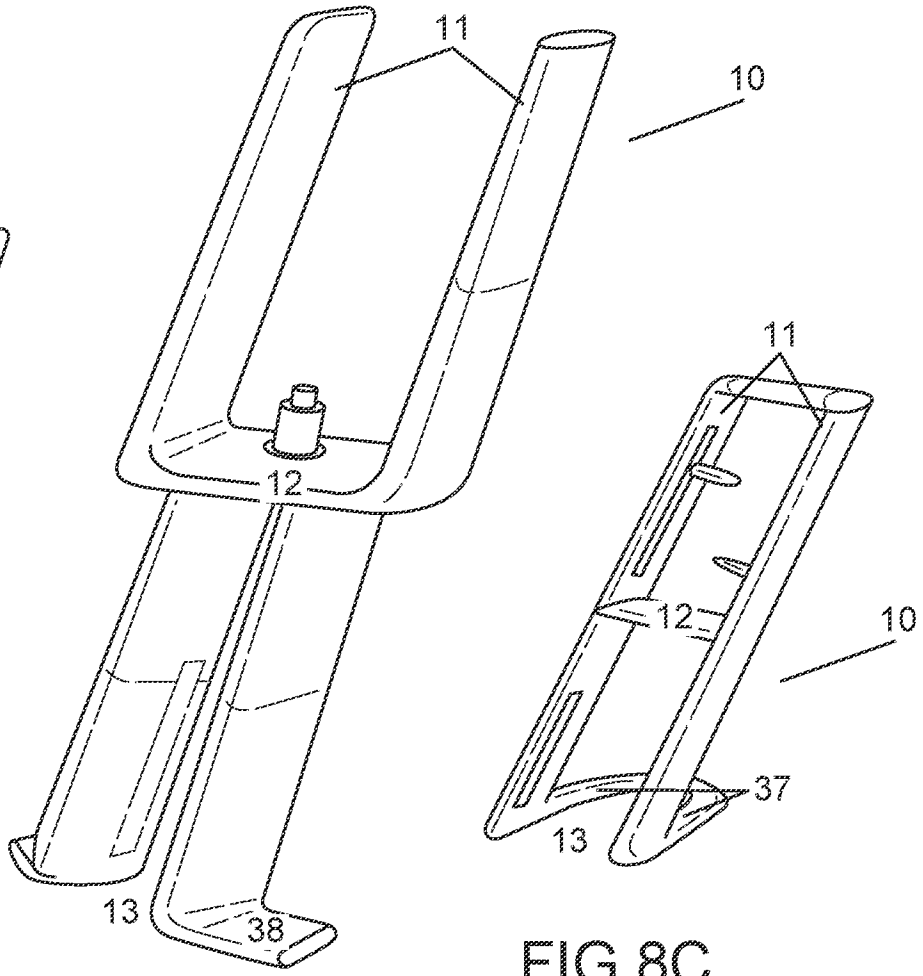
FIG.8C
FIG.8B
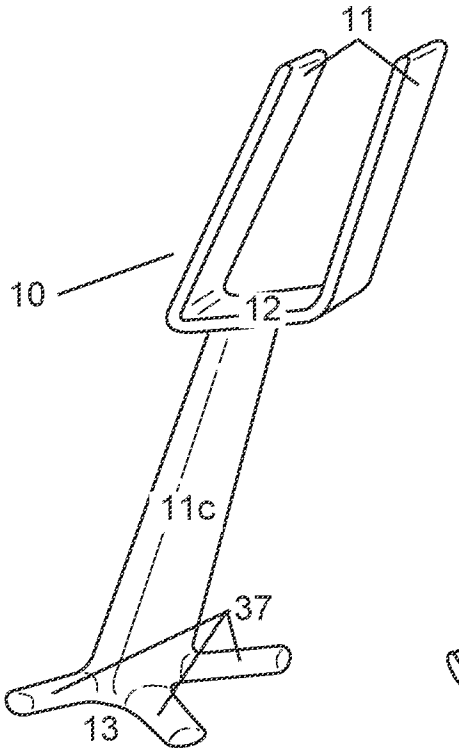
FIG.8A

CLIMBING EXERCISE MACHINE

CROSS-REFERENCE TO RELATED APPLICATIONS

This application is a divisional of U.S. patent application Ser. No. 17/225,706, filed 8 Apr. 2021, which is a continuation-in-part of U.S. patent application Ser. No. 17/118,355, filed 10 Dec. 2020, now U.S. Pat. No. 11,077,336, which is a continuation-in-part of PCT Application PCT/US2020/036434, filed 5 Jun. 2020, which claims the benefit of U.S. Provisional Patent Application 62/858,966, filed 7 Jun. 2019, the entireties of all of which are incorporated herein by reference.

FIELD OF THE INVENTION

This application pertains generally to exercise machines, and specifically to climbing exercise machines that simulate a continuous vertical climbing motion for the user.

BACKGROUND OF THE INVENTION

Many persons in different levels of physical condition and types of athletic ability desire to improve their overall physical fitness and cardiovascular capability. Prior exercise devices provide a wide range of motions and activities for increasing physical fitness. For example, known exercise devices may strengthen and condition individual muscles or various muscle groups of the user. Prior exercise devices may also exercise the entire body simultaneously to increase the overall physical fitness of the user.

Prior exercise devices frequently simulate different motions such as walking, running, and climbing. Climbing is particularly advantageous because it exercises the upper and lower body simultaneously, and it efficiently and effectively exercises all the major muscle groups of the body. Prior climbing devices emulate a climbing motion by having moveable handles and foot pedals which move in a generally predetermined pattern or range of motion.

U.S. Pat. No. 5,492,515 to Charnitski, the entirety of which is incorporated herein by reference, is generally representative of the state of the art of climbing exercise machines, which has not significantly advanced in many years and suffers from several drawbacks. Specifically, prior climbing exercise machines generally comprise a large and unstable base, which significantly increases the machine's weight, decreases its movability, and presents the risk of injury to the user or surrounding people and property should the instability of the base cause the machine to rock or tip. These problems are compounded by the provision in these machines of a single central track, interconnecting both handles and both foot pedals along a single axis, which further impedes the stability, movability, and safety of the machine and is generally aesthetically displeasing. Moreover, prior climbing exercise machines generally include at least one slide and/or belt that may fail or require frequent lubrication, and which typically shorten the useful life of the machine.

U.S. Pat. No. 5,490,818 to Haber, the entirety of which is incorporated herein by reference, represents a climbing exercise machine with two uprights such that each upright houses a handle and a foot pedal. This is an improvement that increases the stability and opens the central viewing area for the user. However, the shortcomings of this design include that the handle and foot pedal engaged with each upright are mounted on a singular carriage such that the left-side handle cannot move independently from the left-side foot pedal, and likewise for the right-side handle and foot pedal. This eliminates the ability of the user to use a natural-gait climbing motion, wherein a user's left foot and left hand move in opposite directions and the user's right foot and right hand likewise move in opposite directions. This design also uses a perimetrical linkage connection, wherein the left-side handle and foot pedal carriage and the right-side handle and foot pedal carriage are connected across the upper end and the lower end of the frame by reciprocating linear motion cables and pulleys. This type of interconnection of the handles and foot pedals requires the usage of a linear motion resistance mechanism, such as the piston-driven hydraulic resistance system claimed by Haber. This type of resistance mechanism has multiple shortcomings, including a "jerky" feel associated with the reversing motion of the piston and fluid. Hydraulic systems are also prone to leaks that can create a messy and hazardous situation in a user's home or fitness facility. The needle valves required to adjust hydraulic valves can also be very difficult to calibrate to create consistent resistance settings.

U.S. Pat. No. 5,803,880 to Allen, the entirety of which is incorporated herein by reference, presents a climbing exercise machine with two uprights such that each upright houses a handle and a foot pedal. This design also has a perimetrical linkage connection, wherein the left and right handle and foot pedal carriages are connected across the upper end of the uprights with a cable and pulleys and the lower end has a hydraulic fluid connection, which regulates the stroke length required to allow the user to move the handles and foot pedals in the opposite reciprocating direction and creates the resistance to the exercise motion. This hydraulic resistance system has many of the same shortcomings as the Haber design, but with the addition of many components that add substantial manufacturing cost and complexity to the design.

There is thus a need in the art for climbing exercise machines with improved stability, movability, safety, and aesthetics. It is further advantageous for such improved climbing exercise machines to reduce the need for maintenance of the machine or any of its components, and to extend the useful life of the machine.

SUMMARY OF THE INVENTION

In one aspect of the present invention, a climbing exercise machine comprises a frame, comprising two uprights disposed on opposing lateral sides of the climbing exercise machine, a base interconnected to at least one upright, and a crossbar interconnecting the uprights above the base; two handles; two foot pedals; four reciprocating, self-lubricating slides; two linear rails; at least two belts; and an axle, housed within the crossbar, wherein each handle and each foot pedal is mounted to a separate one of the reciprocating, self-lubricating slides, wherein each upright houses an assembly comprising one reciprocating, self-lubricating slide to which a handle is mounted, one reciprocating, self-lubricating slide to which a foot pedal is mounted, one linear rail, and at least one belt, wherein the reciprocating, self-lubricating slides of each assembly are mounted on the linear rail of the assembly and interconnected by the at least one belt of the assembly, wherein the belts of both assemblies are interconnected by the axle, and wherein, due to the interconnections of the reciprocating, self-lubricating slides by the belts and of the belts by the axle, travel of any reciprocating, self-lubricating slide along the rail to which it is mounted results in movement in a same direction or an opposing direction of each of the three other reciprocating, self-lubricating slides along the rails to which they are respectively mounted, thereby simulating a continuous vertical climbing motion for a user.

In embodiments, the climbing exercise machine may further comprise an electronic device or system enabling a user to perceive digital content while using the climbing exercise machine. The electronic device or system may, but need not, comprise a networked tablet computer mounted on a mounting apparatus associated with the frame.

In embodiments, the at least two belts may consist of four belts.

In embodiments, the climbing exercise machine may further comprise a braking feature configured to increases resistance encountered by the user during exercise. The braking feature may, but need not, comprise at least one selected from the group consisting of a hydraulic pump, a magnetic or electromagnetic device configured to retard rotation of the axle, and a friction brake. The climbing exercise machine may, but need not, further comprise a user input device operable to allow the user to selectively adjust a magnitude of a braking effect imparted by the braking feature.

In embodiments, the climbing exercise machine may further comprise a sensor or device configured to measure at least one parameter associated with a use of the machine that corresponds to a parameter of interest to the user. The parameter of interest to the user may, but need not, be selected from the group consisting of a length of the use, an effective distance climbed during the use, and a quantity of energy expended during the use. The parameter associated with a use of the machine may, but need not, be selected from the group consisting of a time of the use, a total distance traveled by one or more of the slides during the use, a number of rotations of the axle during the use, and/or a quantity of work done on the axle during the use.

In another aspect of the present invention, a climbing exercise machine comprises a base support frame configured to contact a floor or ground surface; a first elongate upright, rigidly connected to the base support frame at an obtuse angle relative to the floor or ground surface; a second elongate upright, horizontally spaced apart from and parallel to the first upright and rigidly connected to the base support frame at an obtuse angle relative to the floor or ground surface; a first movable handle and a first movable foot pedal, vertically spaced apart from each other and each being slidably engaged with the first upright to enable reciprocating linear movement along the first upright; a second movable handle and a second movable foot pedal, vertically spaced apart from each other and each being slidably engaged with the second upright to enable reciprocating linear movement along the second upright; an adjustable resistance mechanism, mounted on a stationary portion of the machine; and a linkage assembly, interconnecting and synchronizing the first movable handle, the first movable foot pedal, the second movable handle, the second movable foot pedal, and the adjustable resistance mechanism, wherein the interconnection and synchronization provided by the linkage assembly enables reciprocating concurrent movement of the first handle, the first foot pedal, the second handle, the second foot pedal, and the adjustable resistance mechanism to simulate a resisted continuous climbing motion for a user.

In embodiments, the linkage assembly may comprise multiple flexible components, each guided by pulleys.

In embodiments, the linkage assembly may comprise multiple gear racks, multiple drive gears, and at least one flexible component guided by pulleys.

In embodiments, movement of one handle or foot pedal may cause concurrent motion of all other handles and foot pedals. The concurrent motion of the handles and foot pedals may, but need not, simulate a contralateral climbing motion. The concurrent motion of the handles and foot pedals may, but need not, simulate an ipsilateral climbing motion.

In embodiments, the locations of the first handle and the first foot pedal relative to each other may be adjustable prior to operation of the machine and the locations of the second handle and the second foot pedal relative to each other may be adjustable prior to operation of the machine.

In embodiments, at least one foot pedal may be reconfigurable between a secured configuration and an unsecured configuration, wherein in the secured configuration an angle of a foot pedal relative to a corresponding foot pedal support axle is fixed and in the unsecured configuration the foot pedal may articulate about the corresponding foot pedal support axle.

In embodiments, the climbing exercise machine may further comprise an electronic device or system enabling a user to perceive digital content while using the climbing exercise machine. The electronic device or system may, but need not, comprise a tablet computer mounted on a mounting apparatus of the climbing exercise machine. The electronic device or system may, but need not, further comprise at least one sensor, disposed within or on a surface of the climbing exercise machine and configured to transmit data pertaining to the function of the climbing exercise machine to the tablet computer. The mounting apparatus may, but need not, be adjustable such that a user can adjust at least one of an angle of the tablet computer relative to the uprights and a height of the tablet computer above the floor or ground surface. The tablet computer may, but need not, be configured to allow a user to input data corresponding to the user's workout preferences and display to the user data corresponding to the user's exercise performance and experience.

In another aspect of the present invention, a climbing exercise machine comprises a base support frame configured to contact a floor or ground surface; a first elongate upright having a first end and second end, wherein the first end is rigidly connected to the base support frame at an obtuse angle relative to the floor or ground surface; an elongate or V-shaped crossbar having a first end and a second end, wherein a central portion of the crossbar is rigidly connected to the second end of the first upright to form a T or Y shape; a second elongate upright having a first end and a second end, wherein the first end is rigidly connected to the first end of the crossbar such that the first upright and the second upright are in substantially parallel planes on opposing vertical sides of the crossbar; a third elongate upright having a first end and a second end, wherein the first end is rigidly connected to the second end of the crossbar such that the first upright and the third upright are in substantially parallel planes on opposing vertical sides of the crossbar; first and second movable foot pedals, operatively engaged with opposing lateral sides of the first upright to enable reciprocating linear movement along the first upright; a first movable handle, operatively engaged with the second upright to enable reciprocating linear movement along the second upright; a second movable handle, operatively engaged with the third upright to enable reciprocating linear movement along the third upright; an adjustable resistance mechanism, mounted on a stationary portion of the machine; and a linkage assembly, interconnecting and synchronizing the first movable handle, the first movable foot pedal, the second movable handle, the second movable foot pedal, and the adjustable resistance mechanism, wherein the interconnection and synchronization provided by the linkage assembly enables reciprocating concurrent movement of the first handle, the first foot pedal, the second handle, the second foot pedal, and the adjustable resistance mechanism to simulate a resisted continuous climbing motion for a user.

In embodiments, the linkage assembly may comprise multiple flexible components, each guided by pulleys.

In embodiments, the linkage assembly may comprise multiple gear racks, multiple drive gears, and at least one flexible component guided by pulleys.

In embodiments, movement of one handle or foot pedal may cause concurrent motion of all other handles and foot pedals. The concurrent motion of the handles and foot pedals may, but need not, simulate a contralateral climbing motion. The concurrent motion of the handles and foot pedals may, but need not, simulate an ipsilateral climbing motion.

In embodiments, the locations of the first handle and the first foot pedal relative to each other may be adjustable prior to operation of the machine and the locations of the second handle and the second foot pedal relative to each other may be adjustable prior to operation of the machine.

In embodiments, at least one foot pedal may be reconfigurable between a secured configuration and an unsecured configuration, wherein in the secured configuration an angle of a foot pedal relative to a corresponding foot pedal support axle is fixed and in the unsecured configuration the foot pedal may articulate about the corresponding foot pedal support axle.

In embodiments, the climbing exercise machine may further comprise an electronic device or system enabling a user to perceive digital content while using the climbing exercise machine. The electronic device or system may, but need not, comprise a tablet computer mounted on a mounting apparatus of the climbing exercise machine. The electronic device or system may, but need not, further comprise at least one sensor, disposed within or on a surface of the climbing exercise machine and configured to transmit data pertaining to the function of the climbing exercise machine to the tablet computer. The mounting apparatus may, but need not, be adjustable such that a user can adjust at least one of an angle of the tablet computer relative to the uprights and a height of the tablet computer above the floor or ground surface. The tablet computer may, but need not, be configured to allow a user to input data corresponding to the user's workout preferences and display to the user data corresponding to the user's exercise performance and experience.

In another aspect of the present invention, a system for delivering digital content to a user comprises a climbing exercise machine as described herein; and a remote server, connected to the tablet computer of the climbing exercise machine via a network.

In embodiments, the digital content may comprise a climbing class or instructional video.

In embodiments, the digital content may comprise at least one type of entertainment content selected from the group consisting of television content, movie content, and music.

In embodiments, the network may be selected from the group consisting of an Ethernet network, a Token-Ring network, a wide-area network, a virtual network, the Internet, an intranet, an extranet, a Public Switched Telephone Network (PSTN), and an infrared network.

In embodiments, the network may be a wireless network.

In another aspect of the present invention, a method for delivering digital content to a remote user comprises providing a climbing exercise machine as described herein; and transmitting, via a network to which the tablet computer is connected, the digital content from a remote server to the tablet computer.

In embodiments, the digital content may comprise a live or archived climbing class or instructional video.

In embodiments, the digital content may comprise both video content and audio content and may be streamed to the tablet computer substantially in real time.

In embodiments, the digital content may comprise both video content and audio and may be archived content provided from a database.

In embodiments, the method may further comprise displaying at least a portion of the digital content on a display screen of the tablet computer.

In another aspect of the present invention, a climbing exercise machine comprises a base support frame, configured to contact a floor or ground surface; a first upright, wherein a first end of the first upright is rigidly connected to the base support frame at an angle of between about 45° and about 90° relative to the floor or ground surface; a second upright, laterally spaced apart from and parallel to the first upright, wherein a first end of the second upright is rigidly connected to the base support frame at an angle of between about 45° and about 90° relative to the floor or ground surface; a first handle mounted on a first linear motion carriage; a first foot pedal mounted on a second linear motion carriage; a second handle mounted on a third linear motion carriage; a second foot pedal mounted on a fourth linear motion carriage; a cross connector housing, wherein a first end of the cross connector housing is rigidly connected to the first upright at a middle, central, or intermediate portion of the first upright and a second end of the cross connector housing is rigidly connected to the second upright at a middle, central, or intermediate portion of the second upright; a cross connector drive axle, mounted on or within the cross connector housing; a first linkage assembly located on or within the first upright, interconnecting the first handle, the first foot pedal, and the first end of the cross connector drive axle; and a second linkage assembly located on or within the second upright, interconnecting the second handle, the second foot pedal, and the second end of the cross connector drive axle, wherein the first and second linear motion carriages are vertically spaced apart from each other and slidably engaged with the first upright to enable reciprocating linear movement of the first linear motion carriage, the first handle, the second linear motion carriage, and the first foot pedal along the first upright, wherein the third and fourth linear motion carriages are vertically spaced apart from each other and slidably engaged with the second upright to enable reciprocating linear movement of the third linear motion carriage, the second handle, the fourth linear motion carriage, and the second foot pedal along the second upright, and wherein the interconnection provided by the first linkage assembly, the second linkage assembly, and the cross connector drive axle synchronizes a reciprocating concurrent motion of the first handle, the first foot pedal, the second handle, and the second foot pedal to simulate a continuous climbing exercise motion for a user.

In embodiments, the first linkage assembly may comprise a first continuous-loop flexible component, a first drive pulley, a first guide pulley, and a first connector bar and the second linkage assembly may comprise a second continuous-loop flexible component, a second drive pulley, a second guide pulley, and a second connector bar. A first end of the cross connector drive axle may, but need not, be rigidly connected to the first drive pulley and a second end of the cross connector drive axle may, but need not, be rigidly connected to the second drive pulley. The first handle may, but need not, be operatively connected to the first drive pulley by the first continuous-loop flexible component and the first guide pulley and the second handle may, but need not, be operatively connected to the second drive pulley by the second continuous-loop flexible component and the second guide pulley. A first end of the first connector bar may, but need not, be rigidly connected to the second linear motion carriage, a second end of the first connector bar may, but need not, be rigidly connected to the first continuous-loop flexible component, a first end of the second connector bar may, but need not, be rigidly connected to the fourth linear motion carriage, and a second end of the second connector bar may, but need not, be rigidly connected to the second continuous-loop flexible component.

In embodiments, the climbing exercise machine may further comprise an adjustable resistance mechanism, operatively connected to the cross connector drive axle to provide adjustable resistance to the motion of the first handle, the first foot pedal, the second handle, and the second foot pedal. Movement of any handle or foot pedal may, but need not, cause concurrent motion of all other handles and foot pedals and the adjustable resistance mechanism. The adjustable resistance mechanism may, but need not, comprise at least one flywheel and at least one adjustable resistance component, and the at least one flywheel and the at least one adjustable resistance component may, but need not, be operatively engaged such that the at least one adjustable resistance component creates an adjustable resistance to the rotation of the at least one flywheel.

In embodiments, as a result of the interconnection provided by the first linkage assembly, the second linkage assembly, and the cross connector drive axle, the first handle and the first foot pedal may move in opposite directions, the second handle and the second foot pedal may move in opposite directions, the first handle and the second handle may move in opposite directions, and the first foot pedal and the second foot pedal may move in opposite directions.

In embodiments, the climbing exercise machine may further comprise a first foot pedal support axle rigidly mounted on the second linear motion carriage and a second foot pedal support axle rigidly mounted on the fourth linear motion carriage, wherein the first foot pedal is pivotally mounted on the first foot pedal support axle and the second foot pedal is pivotally mounted on the second foot pedal support axle.

In embodiments, the first handle may be adjustably mounted on the first linear motion carriage and the second handle may be adjustably mounted on the third linear motion carriage.

In embodiments, at least one of the following may be linearly adjustable: (i) a location of a connection point between the first handle and the first linear motion carriage; (ii) a location of a connection point between the first foot pedal and the first foot pedal support axle; (iii) a location of a connection point between the second handle and the third linear motion carriage; and (iv) a location of a connection point between the second foot pedal and the second foot pedal support axle.

In embodiments, at least one of an angular position of the first handle relative to the first upright and an angular position of the second handle relative to the second upright may be adjustable.

In embodiments, the climbing exercise machine may further comprise an electronic user interface display console, configured to cooperate with the function of the climbing exercise machine and mounted on a stationary component of the climbing exercise machine.

In embodiments, the climbing exercise machine may further comprise at least one stationary handle mounted on a stationary component of the climbing exercise machine.

These and other advantages will be apparent from the disclosure of the aspects, embodiments, and configurations contained herein.

For purposes of further disclosure and to comply with applicable written description and enablement requirements, the following references generally relate to exercise machines and are hereby incorporated by reference in their entireties:

U.S. Patent Application Publication 2018/0339189, entitled "Exercise machine," published 29 Nov. 2018 to Luger et al.

U.S. Patent Application Publication 2019/0134456, entitled "Rock climbing machine," published 9 May 2019 to Yeh.

U.S. Patent Application Publication 2020/0094106, entitled "Climbing machine," published 26 Mar. 2020 to Liu.

U.S. Pat. No. 10,751,562, entitled "Climbing machine," issued 25 Aug. 2020 to Chen.

U.S. Patent Application Publication 2021/0098126, entitled "Interactive athletic equipment system," published 1 Apr. 2021 to Tchao et al.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

It is to be noted that the term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

The term "means" as used herein shall be given its broadest possible interpretation in accordance with 35 U.S.C., Section 112(f) and/or Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the disclosure, brief description of the drawings, detailed description, abstract, and claims themselves.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein. By way of example, the phrase from about 2 to about 4 includes the whole number and/or integer ranges from about 2 to about 3, from about 3 to about 4 and each possible range based on real (e.g., irrational and/or rational) numbers, such as from about 2.1 to about 4.9, from about 2.1 to about 3.4, and so on.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

FIGS. 8A, 8B, and 8C are illustrations of different embodiments of uprights of a climbing exercise machine, according to embodiments of the present invention.

Figure 1:
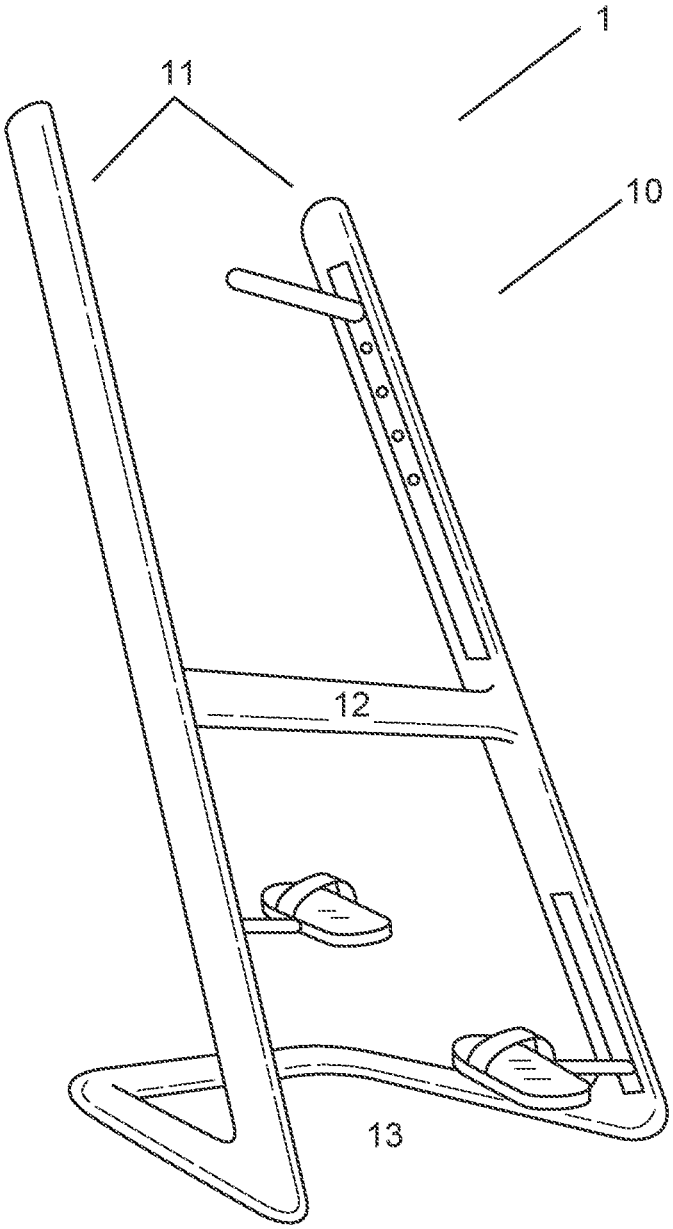
FIG. 1 illustrates various embodiments of a frame (uprights, crossbar, and base) of a climbing exercise machine, according to embodiments of the present invention.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. The reference labels and their corresponding components are as follows:

| Reference label | Element |
|---|---|
| U | User |
| 1 | Climbing machine |
| 9 | Lower upright brace tube |
| 10 | Frame |
| 11 | Upright |
| 11c | Unitary upright |
| 12 | Crossbar |
| 13 | Base |
| 14 | Rail |
| 15 | Belt connector |
| 16 | Axle |
| 17 | Belt |
| 18 | Handle |
| 18a | Left handle |
| 18b | Right handle |
| 19 | Handle adjustment plate |
| 20 | Slide component |
| 21 | Foot pedal |
| 21a | Left foot pedal |
| 21b | Right foot pedal |
| 23 | Flat inward-facing surface |
| 24 | Button |
| 25 | Adjustable strap |
| 26 | Foot pad |
| 27 | Rod |
| 28 | Nut |
| 29 | Slot |
| 30 | Aperture(s) |
| 31 | Connection mechanism |
| 32 | Screw(s) |
| 33 | Central bore |
| 34 | Center structural core |
| 35 | Bracket |

-continued

| Reference label | Element |
|---|---|
| 36 | Pulley |
| 37 | Base member(s) |
| 38 | Base feet |
| 39 | Adjustable arm |
| 40 | Tablet computer |
| 41 | Adjustable handle |
| 42 | Mounting bracket |
| 43 | Crank |
| 44 | Footing(s) |
| 45 | Sprocket |
| 46 | Belt tensioner |
| 47 | Resistance motor |
| 50 | Foot pedal latch |
| 51 | Foot pedal latch pin |
| 52 | Foot pedal latch receiver |
| 53 | Movable electronic sensor |
| 54 | Stationary electronic sensor |
| 55 | Handle adjustment latching pin receiver |
| 56 | Tablet pivot rod |
| 57 | Adjustable arm securing knob |
| 58 | Adjustable arm movement lever |
| 59 | Resistance adjustment dial |
| 60a | Left foot pedal gear rack assembly |
| 60b | Right foot pedal gear rack assembly |
| 61a | Left handle gear rack assembly |
| 61b | Right handle gear rack assembly |
| 62 | Gear rack guide wheel |
| 63a | Left gear rack drive gear |
| 63b | Right gear rack drive gear |
| 64 | Resistance motor axle |
| 65 | Resistance motor axle pulley |
| 70a | First drive axle |
| 70b | Second drive axle |
| 70c | Third drive axle |
| 71 | Drive axle mounting bearing |
| 72a | First drive axle drive gear |
| 72b | Second drive axle drive gear |
| 72c | Third drive axle drive gear |
| 73 | Drive chain |
| 74 | Second drive axle drive chain sprocket |
| 75 | Third drive axle drive chain sprocket |
| 76 | Resistance motor drive chain sprocket |
| 77 | Handle adjustment latching pin |
| 78 | Foot pedal support axle |
| 100 | Computing environment |
| 104 | Computing device |
| 108 | Computing device |
| 110 | Network |
| 112 | Computing device |
| 114 | Server |
| 116 | Server |
| 118 | Database |
| 200 | Computer system |
| 204 | Bus |
| 208 | Central processing unit |
| 212 | Input device |
| 216 | Output device |
| 220 | Storage device |
| 224 | Storage media reader |
| 228 | Communications system |
| 232 | Processing acceleration unit |
| 236 | Working memory |
| 240 | Operating system |
| 244 | Other code |
| 300 | Climbing machine |
| 305A | First stationary handle |
| 305B | Second stationary handle |
| 308 | Handle assembly |
| 309 | Interior wall |
| 310A | First upright |
| 310B | Second upright |
| 311 | Foot pedal assembly |
| 312 | Cross connector housing |
| 313 | Base frame |
| 315A | First belt connector bracket |
| 315B | Second belt connector bracket |

-continued

| Reference label | Element |
|---|---|
| 316A | First connector bar connector bracket |
| 316B | Second connector bar connector bracket |
| 316C | Third connector bar connector bracket |
| 316D | Fourth connector bar connector bracket |
| 317A | First linkage belt |
| 317B | Second linkage belt |
| 318A | First handle |
| 318B | Second handle |
| 319 | Handle slide plate |
| 320A | First linear motion carriage |
| 320B | Second linear motion carriage |
| 320C | Third linear motion carriage |
| 320D | Fourth linear motion carriage |
| 321a | First foot pedal |
| 321b | Second foot pedal |
| 322 | Linear motion carriage wheels |
| 325 | Adjustable foot pedal strap |
| 326 | Handle slide plate latching lever |
| 327 | Handle slide plate latching lever axle |
| 328 | Handle slide plate latching pin |
| 329 | Handle slide plate latching pin receiver holes |
| 330 | Handle slide plate receiver slot |
| 331 | Handle pivot adjustment latching button |
| 332 | Handle pivot axle |
| 333 | Handle pivot latching pin |
| 334 | Handle pivot latching pin receiver hole |
| 335A | First guide pulley mounting bracket |
| 335B | Second guide pulley mounting bracket |
| 336A | First guide pulley |
| 336B | Second guide pulley |
| 337A | First cross connector axle drive pulley |
| 337B | Second cross connector axle drive pulley |
| 340 | Electronic user interface display |
| 341 | Electronic user interface display support tube |
| 342 | Electronic user interface display mounting bracket |
| 343 | Flywheel resistance assembly support frame |
| 345 | Resistance magnets housing |
| 346 | Resistance magnet |
| 347 | Flywheel |
| 348 | Resistance magnets housing pivot axle |
| 349 | Flywheel resistance assembly |
| 350A | First linkage assembly |
| 350B | Second linkage assembly |
| 359 | Resistance adjustment dial |
| 360a | First connector bar |
| 360b | Second connector bar |
| 364 | Flywheel axle |
| 365 | Flywheel axle pulley |
| 368 | Brace tube |
| 369 | Mounting block |
| 370 | Cross connector axle |
| 371 | Cross connecting axle bearing |
| 372A | First flywheel drive pulley |
| 372B | Second flywheel drive pulley |
| 372C | Third flywheel drive pulley |
| 373A | First flywheel drive belt |
| 373B | Second flywheel drive belt |
| 374 | Flywheel drive pulley axle |
| 378A | First foot pedal support axle |
| 378B | Second foot pedal support axle |
| 379A | First foot pedal support axle connector bracket |
| 379B | Second foot pedal support axle connector bracket |

DETAILED DESCRIPTION OF THE INVENTION

In the following description, for the purposes of explanation, numerous specific details are set forth to provide a thorough understanding of various embodiments disclosed herein. It will be apparent, however, to one skilled in the art that various embodiments of the present disclosure may be practiced without some of these specific details. The ensuing description provides exemplary embodiments only and is not intended to limit the scope or applicability of the disclosure. Furthermore, to avoid unnecessarily obscuring the present disclosure, the preceding description omits several known structures and devices. This omission is not to be construed as a limitation of the scopes of the claims. Rather, the ensuing description of the exemplary embodiments will provide those skilled in the art with an enabling description for implementing an exemplary embodiment. It should however be appreciated that the present disclosure may be practiced in a variety of ways beyond the specific detail set forth herein.

While the exemplary aspects, embodiments, and/or configurations illustrated herein show the various components of the system collocated, certain components of the system can be located remotely, at distant portions of a distributed network, such as a LAN and/or the Internet, or within a dedicated system. Thus, it should be appreciated, that the components of the system can be combined in to one or more devices or collocated on a particular node of a distributed network, such as an analog and/or digital telecommunications network, a packet-switch network, or a circuit-switched network. It will be appreciated from the following description, and for reasons of computational efficiency, that the components of the system can be arranged at any location within a distributed network of components without affecting the operation of the system.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire and fiber optics, and may take the form of acoustic or light waves, such as those generated during radio-wave and infra-red data communications.

As used herein, the phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

The term "computer-readable medium" as used herein refers to any tangible storage and/or transmission medium that participate in providing instructions to a processor for execution. Such a medium may take many forms, including but not limited to, non-volatile media, volatile media, and transmission media. Non-volatile media includes, for example, NVRAM, or magnetic or optical disks. Volatile media includes dynamic memory, such as main memory. Common forms of computer-readable media include, for example, a floppy disk, a flexible disk, hard disk, magnetic tape, or any other magnetic medium, magneto-optical medium, a CD-ROM, any other optical medium, punch cards, paper tape, any other physical medium with patterns of holes, a RAM, a PROM, and EPROM, a FLASH-EPROM, a solid state medium like a memory card, any other memory chip or cartridge, a carrier wave as described hereinafter, or any other medium from which a computer can read. A digital file attachment to e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored.

A "computer readable signal" medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable medium may be transmitted using any appropriate medium, including but not limited to wireless, wireline, optical fiber cable, RF, etc., or any suitable combination of the foregoing.

The terms "determine," "calculate," and "compute," and variations thereof, as used herein, are used interchangeably and include any type of methodology, process, mathematical operation, or technique.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials or acts and the equivalents thereof shall include all those described in the summary of the disclosure, brief description of the drawings, detailed description, abstract, and claims themselves.

As used herein unless otherwise provided, the term "belt" or "flexible component" refers to any piece of material having the general shape of a loop that may be looped over a pulley and used to mechanically link two or more rotating shafts. Examples of belts as that term is used herein include loops of flexible material (such as, by way of non-limiting example, leather, fabric, rubber, or a synthetic polymer), chains, and ropes.

As used herein unless otherwise provided, the term "component" refers to any rigid, flexible, movable, or stationary item that is included in a part, assembly, or structure of an exercise machine.

As used herein unless otherwise provided, the term "mounted on," when used to refer to a component or structure of an exercise machine, means that the component is fastened to, coupled, welded to, or otherwise affixed or connected to another component or structure on the exercise machine.

As used herein unless otherwise specified, the terms "swivel," "rotate," and "pivot" are interchangeable and each refer to an arcing or circular motion along a fixed path about a fixed center point.

As used herein unless otherwise specified, the terms "forward end," "forward section," and "forward portion" each refer to an end or section of a climbing exercise machine or any component thereof proximal to an end of the machine toward which a user faces during operation of the machine. Conversely, the terms "rearward end," "rearward section," and "rearward portion" each refer to an end or section of the climbing exercise machine or any component thereof opposite to an end of the machine toward which a user faces during operation of the machine.

As used herein unless otherwise provided, the terms "inward" and "inwardly" refer to a direction oriented generally in a horizontal plane and generally toward a central longitudinal axis of a frame of an exercise machine. By way of non-limiting example, handles and foot pedals of an exercise machine may extend "inwardly" from uprights of a frame because they extend from a left upright of the frame toward the right, or from a right upright of the frame toward the left (i.e., in both cases, toward the central longitudinal axis of the frame). By logical extension, as used herein unless otherwise provided, the terms "outward" and "outwardly" refer to a direction oriented generally in a horizontal plane and generally away from the central longitudinal axis of the frame of the exercise machine, e.g. toward the left from a left upright of the frame or toward the right from a right upright of the frame.

Aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Any combination of one or more computer readable medium(s) may be utilized. The computer readable medium may be a computer readable signal medium or a computer readable storage medium.

In yet another embodiment, the systems and methods of this disclosure can be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the disclosed embodiments, configurations, and aspects includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

Examples of the processors as described herein may include, but are not limited to, at least one of Qualcomm® Snapdragon® 800 and 801, Qualcomm® Snapdragon® 610 and 615 with 4G LTE Integration and 64-bit computing, Apple® A7 processor with 64-bit architecture, Apple® M7 motion coprocessors, Samsung® Exynos® series, the Intel® Core™ family of processors, the Intel® Xeon® family of processors, the Intel® Atom™ family of processors, the Intel Itanium® family of processors, Intel® Core® i5-4670K and i7-4770K 22 nm Haswell, Intel® Core® i5-3570K 22 nm Ivy Bridge, the AMD® FX™ family of processors, AMD® FX-4300, FX-6300, and FX-8350 32 nm Vishera, AMD® Kaveri processors, Texas Instruments® Jacinto C6000™ automotive infotainment processors, Texas Instruments® OMAP™ automotive-grade mobile processors, ARM® Cortex™-M processors, ARM® Cortex-A and ARM926EJ-S™ processors, other industry-equivalent processors, and may perform computational functions using any known or future-developed standard, instruction set, libraries, and/or architecture.

In yet another embodiment, the disclosed methods may be readily implemented in conjunction with software using object or object-oriented software development environments that provide portable source code that can be used on a variety of computer or workstation platforms. In additional embodiments, the disclosed methods may be implemented in conjunction with functional programming. Alternatively, the disclosed system may be implemented partially or fully in hardware using standard logic circuits or VLSI design. Whether software or hardware is used to implement the systems in accordance with this disclosure is dependent on the speed and/or efficiency requirements of the system, the particular function, and the particular software or hardware systems or microprocessor or microcomputer systems being utilized.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein, and other similar standards and protocols not mentioned herein are periodically superseded by faster or more effective equivalents having essentially the same functions. Such replacement standards and protocols having the same functions are considered equivalents included in the present disclosure.

The present invention provides an improved climbing exercise machine that simulates a continuous vertical climbing motion for the user. The machine generally includes two handles and two foot pedals, each of which is mounted to a reciprocating, self-lubricating slide. The four reciprocating, self-lubricating slides are housed within two uprights disposed on opposing lateral sides of the machine, each of which houses a linear rail; within each upright, a slide mounting a handle and a slide mounting a foot pedal are interconnected by at least one belt. The belt of the left upright and the belt of the right upright are interconnected by an axle housed within a crossbar. The uprights are secured to a stable base. In embodiments, the machine may further include electronic devices and systems that enable a user to perceive digital content (e.g. streaming multimedia, such as climbing classes or instructional videos, as well as other digital entertainment content) while using the machine; by way of non-limiting example, such devices and systems may include a wirelessly networked tablet computer mounted on the crossbar of the machine.

Referring now to FIG. 1, various embodiments of a frame 10 of the exercise machine 1 are illustrated, comprising two uprights 11, a crossbar 12, and a base 13. As illustrated in FIG. 1, the uprights 11, and therefore the rails 14 to which the reciprocating, self-lubricating slides 20 are mounted, are generally parallel to each other. The uprights 11 are generally disposed at a horizontal distance approximately commensurate with a shoulder width of the user, but this width may vary, and in some embodiments may be adjustable by the user.

As illustrated in FIG. 1, the crossbar 12 housing the axle 16 that interconnects the belts 17 itself interconnects and spaces apart the uprights 11. In some embodiments, the crossbar 12 may be disposed at a top end of the uprights 11 to provide a generally A-shaped appearance, while in other embodiments, such as that illustrated in FIG. 1, the crossbar 12 may be disposed at or near an approximate midpoint of the uprights 11 to provide a generally H-shaped appearance. The belts 17 may be interconnected by more than one axle 16; in these embodiments, an axle 16 interconnecting the belts 17 may be provided in association with the top crossbar 12, or the central crossbar 12, or both.

As illustrated in FIG. 1, the uprights 11 are longitudinal beams that, when the user is using the machine, extend outwardly away from the user. Each beam forms an angle with a base 13 of the exercise machine 1 of between about 0 and about 90 degrees, such that the user perceives an upward direction (and optionally also a forward direction) of motion, and works against at least a portion of his or her own weight, while exercising; in some embodiments, this angle may be adjustable by the user. The uprights 11 interconnect with a base 13, which may generally be shaped such that the "footprint" of the exercise machine 1 on a floor, ground, or other horizontal surface on which the machine 1 is placed has the general shape of three sides of a rectangle. The uprights 11 and base 13 thus provide greater stability for the machine 1 than prior climbing exercise machines, while occupying a comparable or even smaller area of floor or ground space.

Figure 9A:
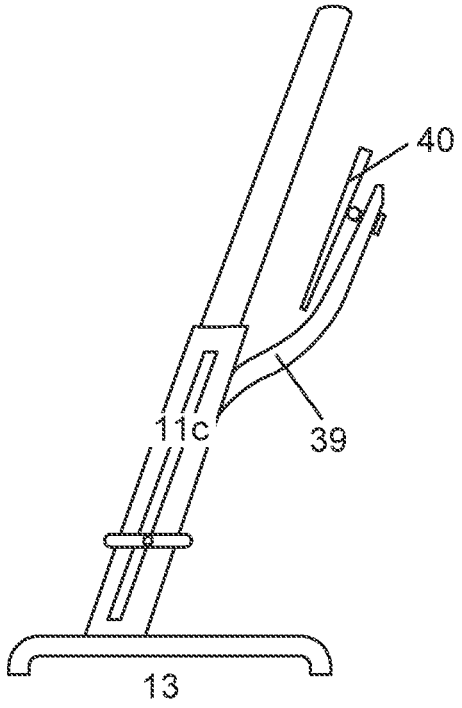
FIGS. 9A, 9B, 9C, 9D, and 9E illustrate further various embodiments of a frame of a climbing exercise machine, according to embodiments of the present invention.
Figure 9B:
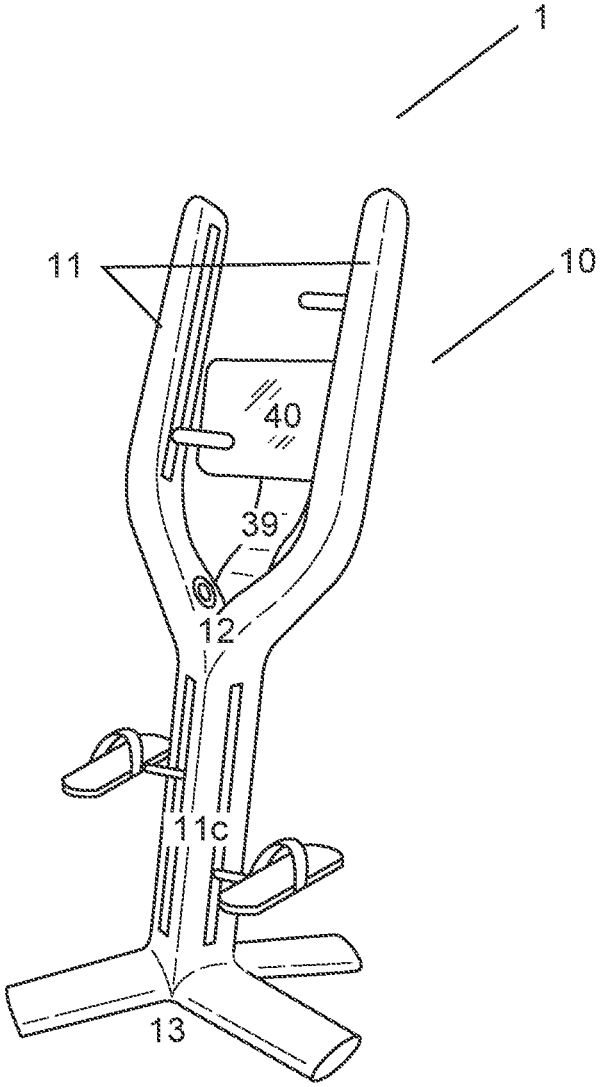
Figure 9C:
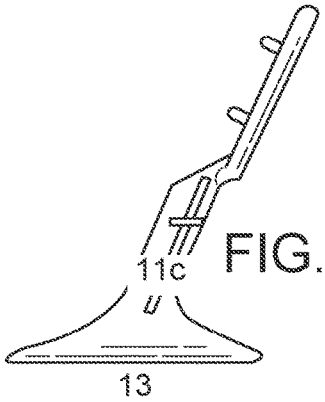
Figure 10A:
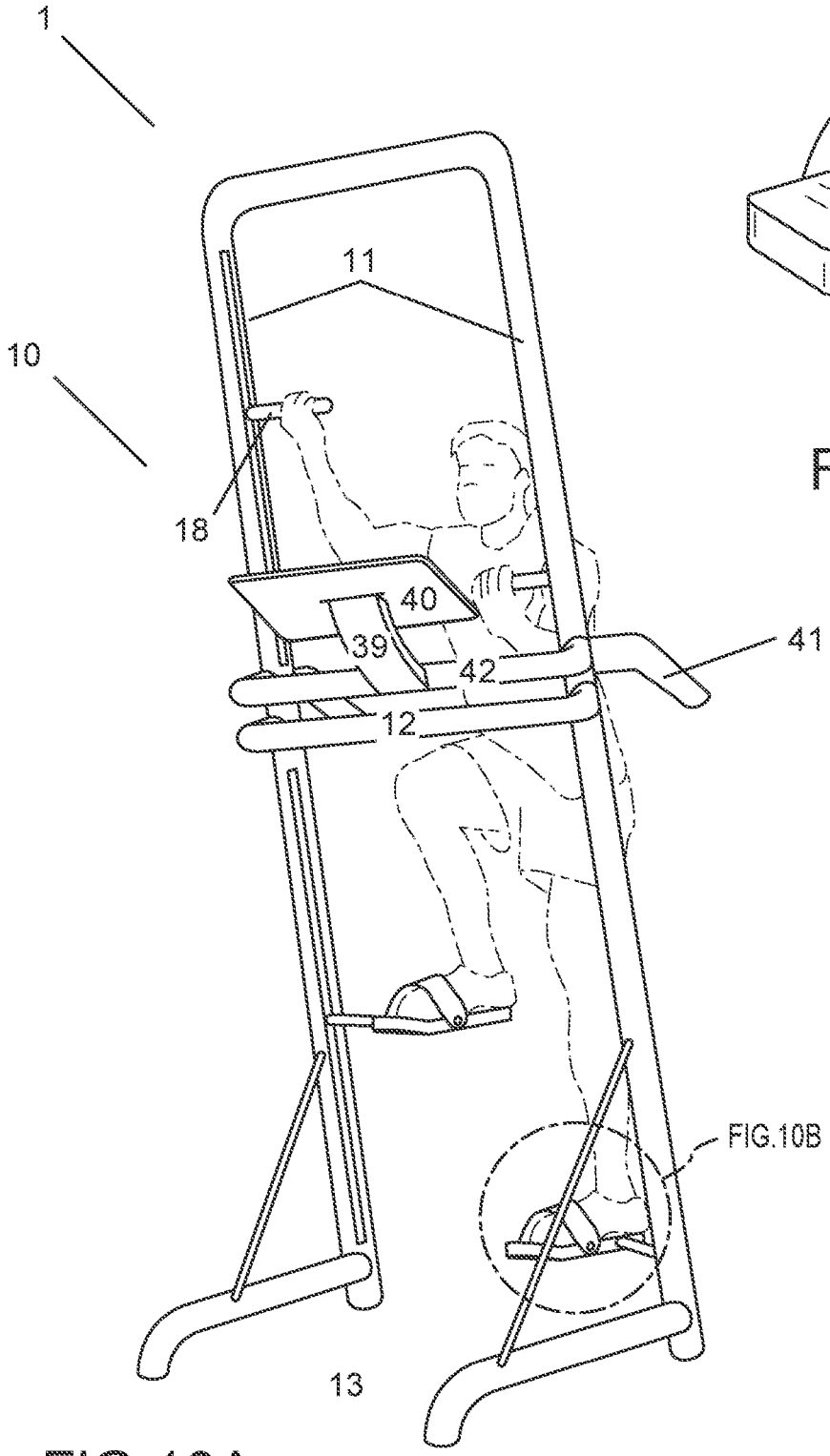
FIGS. 10A and 10B illustrate adjustment and safety mechanisms that may be provided as part of a climbing exercise machine, according to embodiments of the present invention.
Figure 11:
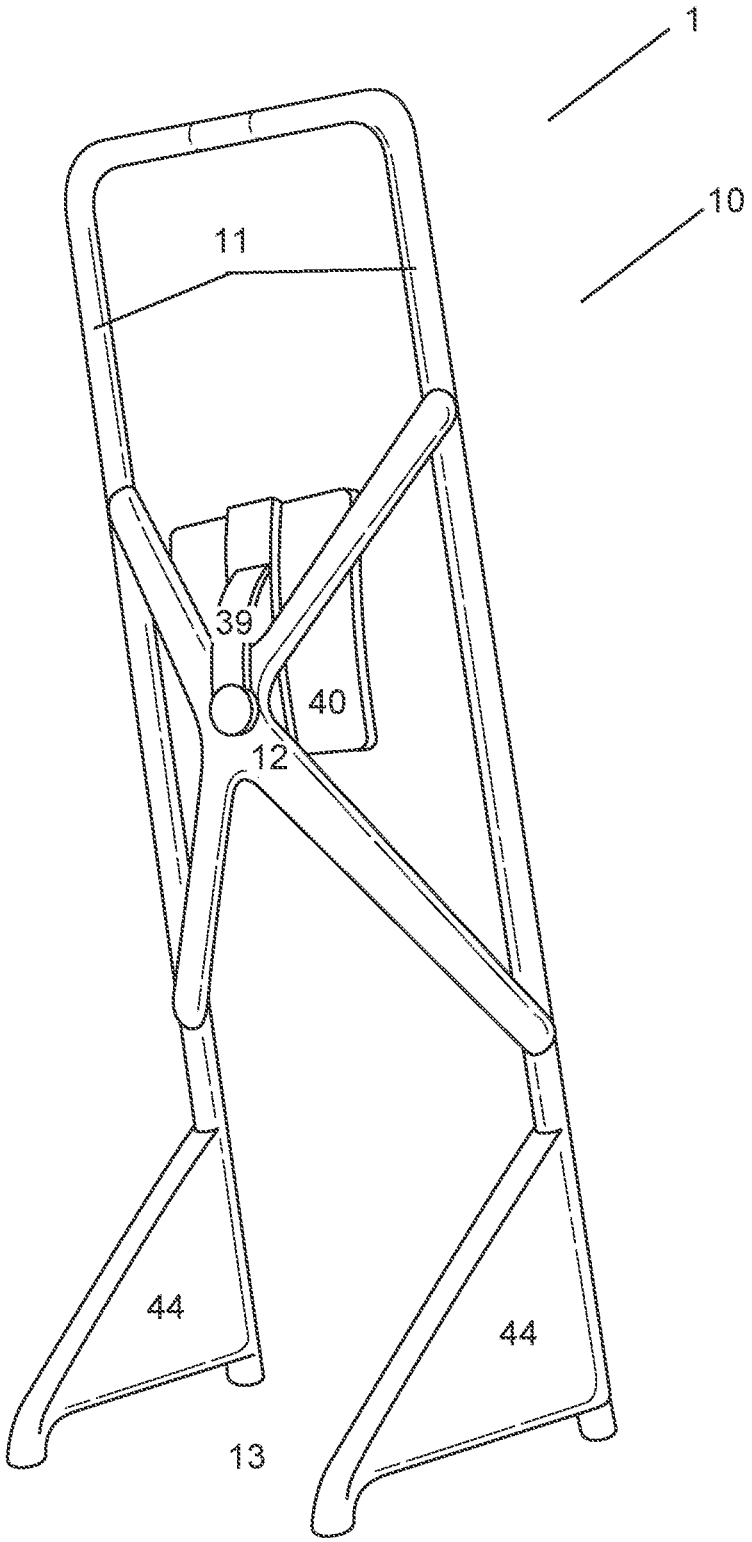
FIG. 11 is a rear perspective view of a climbing exercise machine, according to embodiments of the present invention.

As illustrated particularly in FIGS. 9B, 10A, and 11 that follow, climbing exercise machines of the present invention may optionally include devices and systems that enable a user to view digital content while using the machine. These devices and systems may include a tablet computer affixed to a vertically disposed mount extending upwardly from a centrally located (i.e. at or near an approximate midpoint of the uprights 11) crossbar 12, but it is to be expressly understood that such devices and systems may include other components (e.g. wireless networking components, additional or alternative types of audiovisual equipment, etc.) and be affixed to the frame 10 in any suitable configuration (e.g. mounted directly on a surface of a central crossbar, affixed to a mount extending downwardly from a top crossbar, etc.). Such devices and systems are preferably wirelessly connected to a network for providing multimedia content (e.g. the Internet), by which the user may receive and view live or recorded instructional videos or other multimedia content, e.g. television shows, movies, music, etc.

Figure 2:
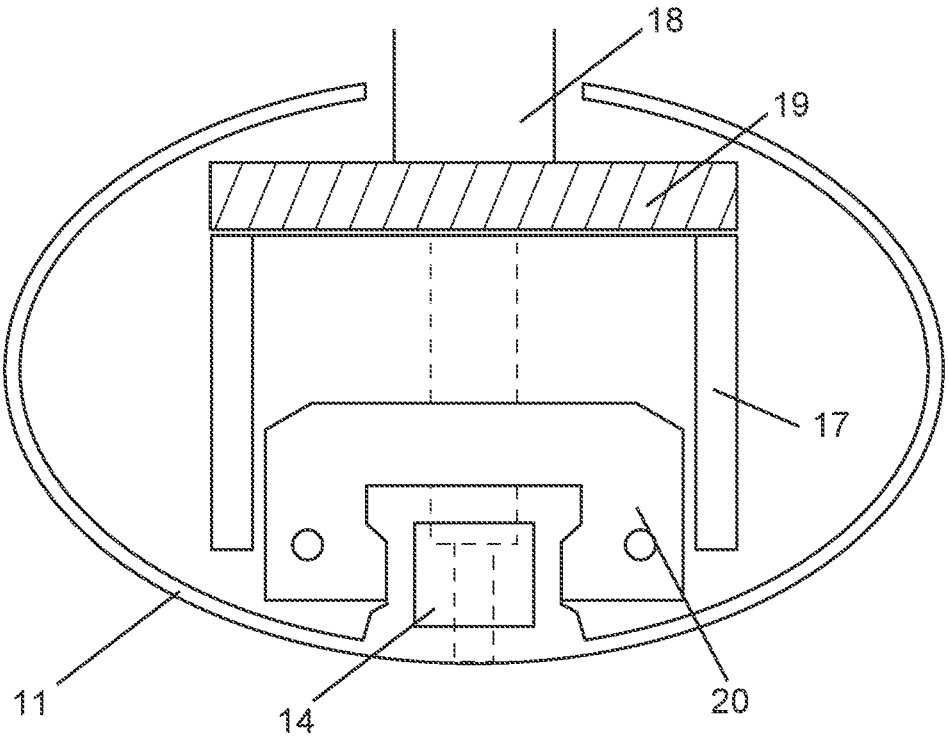
FIG. 2 is a cross-sectional view of an interior of an upright of a climbing exercise machine, according to embodiments of the present invention.

Referring now to FIG. 2, an interior of an upright 11 of the climbing exercise machine 1 is illustrated in cross-section. As illustrated, a handle 18 of the machine 1, graspable by the user's hand, extends both inwardly (away from the rail 14) and outwardly (into an interior of the upright 11). The handle 18 is affixed to a handle adjustment plate 19, which is interconnected via a belt 17 and cog to a generally C-shaped slide 20. The slide 20 is reciprocating and self-lubricating, and at the open end of the C-shape snugly receives the rail 14. The snug fit of the rail 14 within the open space defined by the slide 20 permits the slide 20 to travel smoothly along the rail 14 (i.e. along the length of the upright 11) to allow the user to exercise, while ensuring that the slide 20 does not become detached or loosened from the rail 14. While in FIG. 2 the illustrated plate 19 and slide 20 mechanisms are shown in conjunction with a handle 18 (i.e. for receiving the user's hand), it is to be expressly understood that the same or similar mechanisms are provided, mutatis mutandis, in conjunction with each foot pedal 21 (i.e. for receiving the user's foot).

Figure 3B:
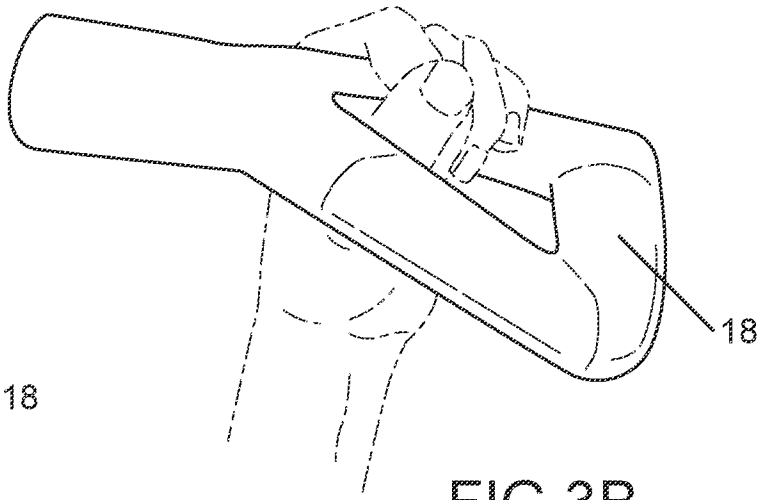
FIGS. 3A, 3B, and 3C illustrate a handle of a climbing exercise machine comprising a void space, according to embodiments of the present invention.
Figure 3C:
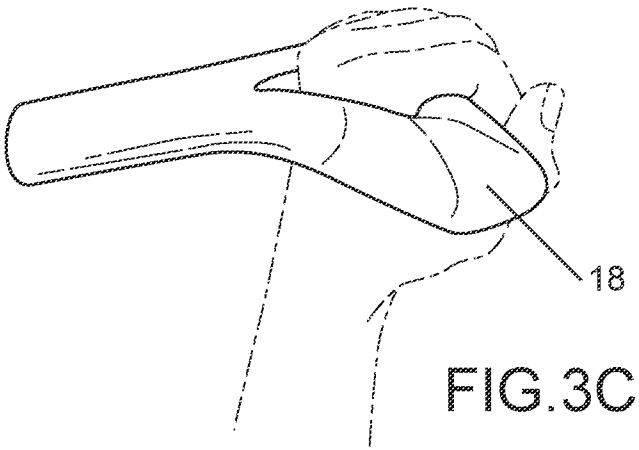
Figure 3A:
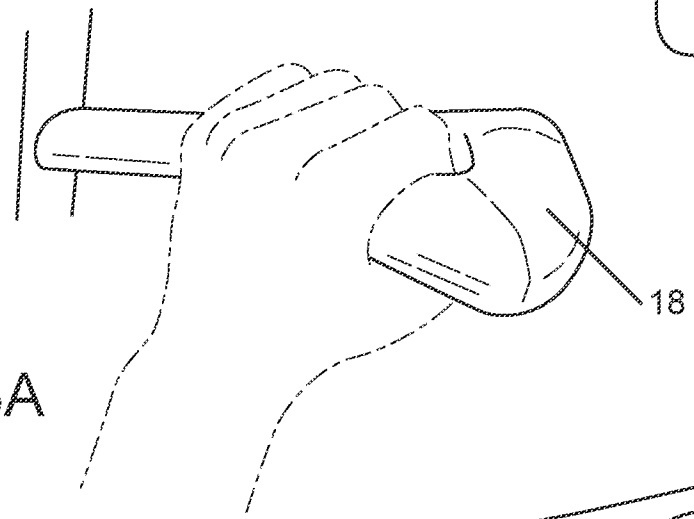
Figure 3E:
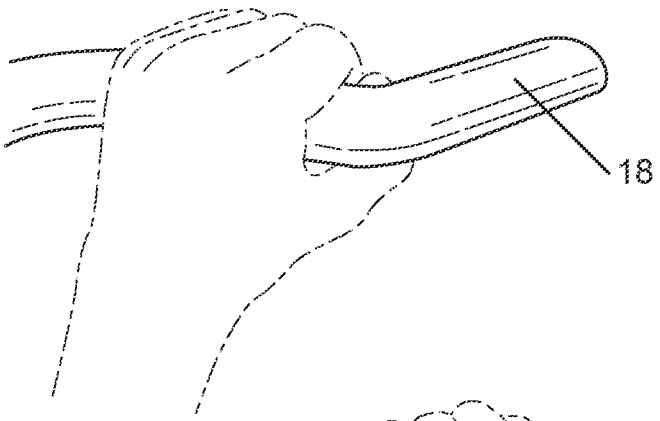
FIGS. 3D, 3E, and 3F illustrate a generally U-shaped handle of a climbing exercise machine, according to embodiments of the present invention.
Figure 3F:
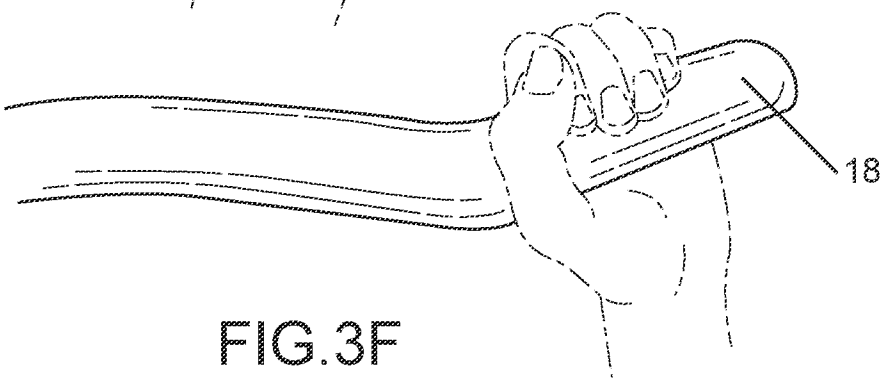
Figure 3D:
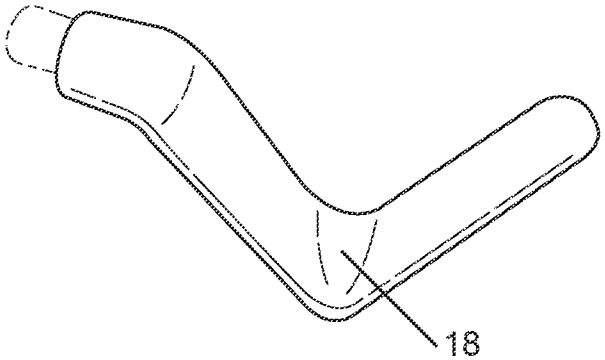
Figures 3G, 3H, 3I, 3J:
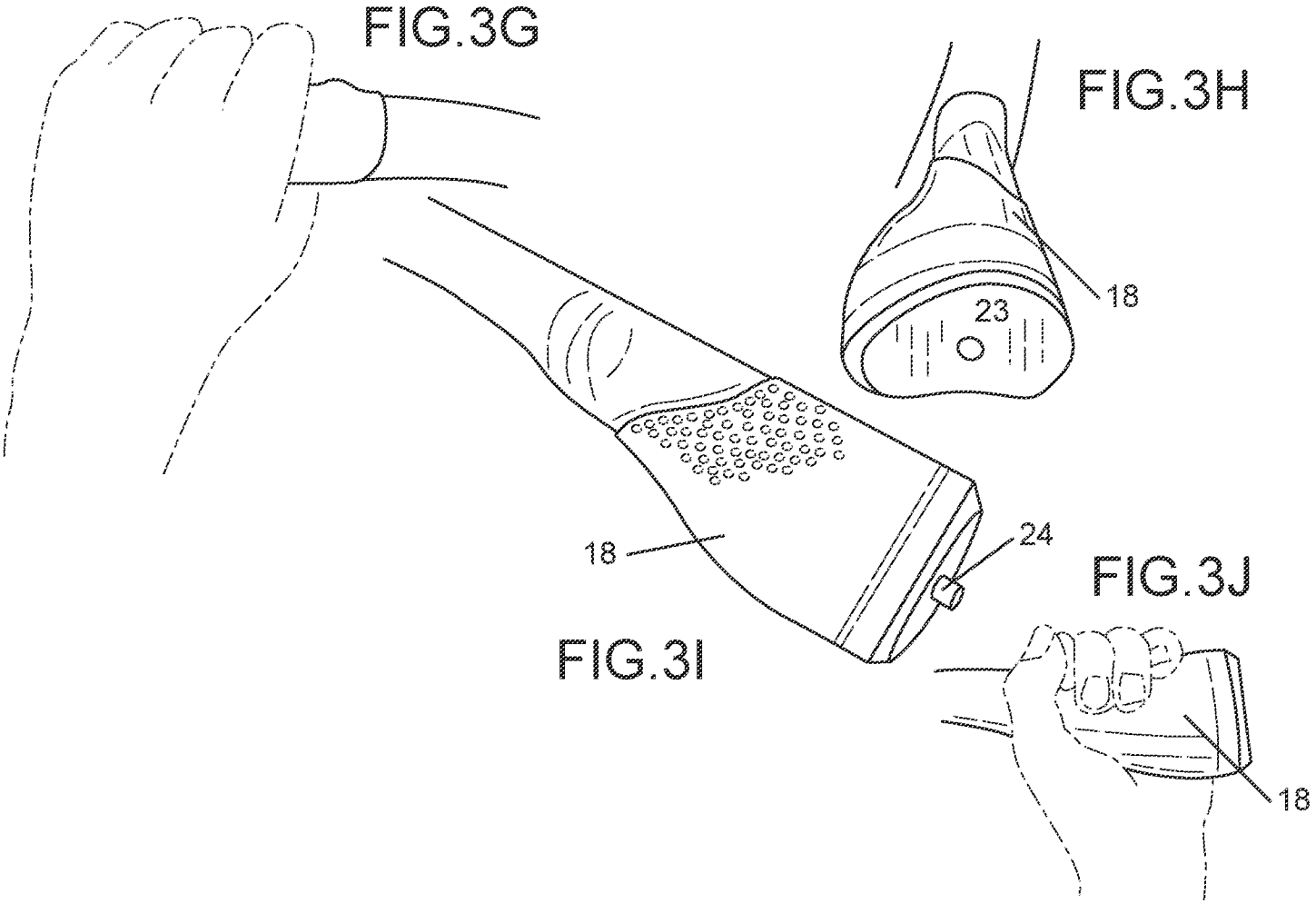
FIGS. 3G, 3H, 3I, and 3J illustrate an ergonomic handle of a climbing exercise machine, according to embodiments of the present invention.

Referring now to FIGS. 3A through 3J, various configurations of a handle 18 of the climbing exercise machine 1 are illustrated. In FIGS. 3A through 3C, a grip portion of the handle 18 has a generally triangular shape in a horizontal plane, defining a central void space; as illustrated, such a structure allows the user to grasp any of the three sides of the triangular shape, and thereby place at least part of his or her hand within the central void space, while exercising. In FIGS. 3D through 3F, a grip portion of the handle 18 is generally V-shaped; as illustrated, such a structure allows the user to apply either an "overhand" or "underhand" grip to the handle 18, either of which may be desirable for various exercise applications. In FIGS. 3G through 3J, ergonomic features, such as a textured or patterned grip material, are provided on a surface of a grip portion of the handle 18; as illustrated, and as in FIGS. 3D through 3F, the user may apply either an "overhand" or "underhand" grip to the handle. The handle 18 embodiment of FIGS. 3G through 3J includes various other optional features, including a flat inward-facing surface 23 (allowing a user to, e.g., apply pressure to the handle 18 with a palm of the hand), and a release pin or button 24 that allows a user to adjust the handle 18 and/or detach the handle 18 from the slide 20.

Figure 4A:
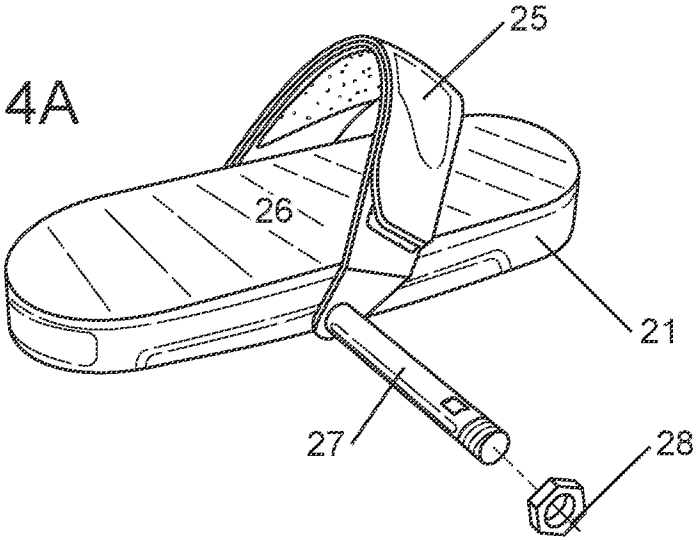
FIGS. 4A, 4B, and 4C illustrate foot pedals of a climbing exercise machine, according to embodiments of the present invention.
Figure 4B:
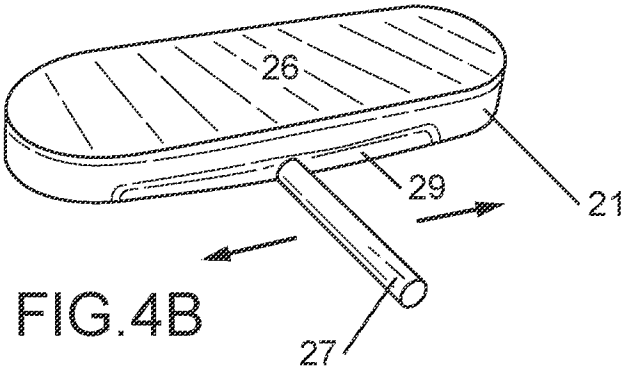
Figure 4C:
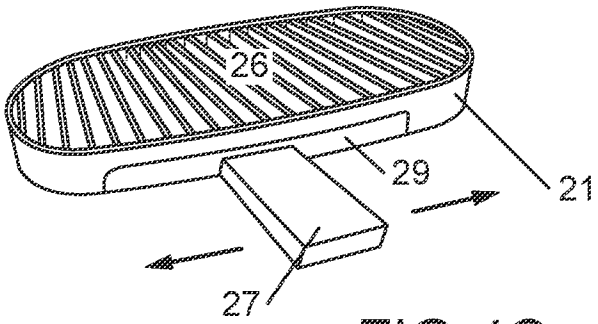

Referring now to FIGS. 4A through 4C, various configurations of a foot pedal 21 of the climbing exercise machine 1 are illustrated. These foot pedal 21 configurations are provided with various features, any or all of which may be provided in any combination in embodiments of the invention. As illustrated in FIG. 4A, the foot pedal 21 may be provided with an adjustable strap 25, such as, by way of non-limiting example, a strap comprising a hook-and-loop fastener, that may aid the user in securing the user's feet to a foot pad 26 of the foot pedal 21 during exercise; this reduces the likelihood of a slip, trip, or fall during exercise, thus reducing the risk of injury to the user. The configuration shown in FIG. 4A also includes a rod 27 that interconnects the foot pad 26 and strap 25 to the slide 20; in this embodiment, the rod 27 is manipulable by a wrench or other tool to tighten or loosen the connection, and is threaded to secure the rod 27 to a corresponding nut 28 to mitigate the risk of accidental disconnection of the foot pedal 21 during exercise. As shown in FIG. 4C, the foot pad 26 of the foot pedal 21 may be provided with a textured surface to improve the grip and/or aesthetic features of the foot pad 26; the textured surface may take any suitable configuration, including, as illustrated and by way of non-limiting example, a striated configuration or a tessellated or "honeycomb" pattern. As illustrated in FIGS. 4B and 4C, the rod that interconnects the foot pad 26 and strap 25 to the slide 20 may be received by a slot 29 on the side of the foot pad 26 and may be adjustable or reconfigurable within the slot 29 to allow the foot pad 26 to be moved forward or backward relative to the rod 27. The foot pad 26 may also have a restricted or unrestricted range of rotation about the rod 27, allowing the user to apply dorsiflexion or plantar flexion during exercise while keeping his or her foot in flush contact with the foot pad 26.

Figure 5:
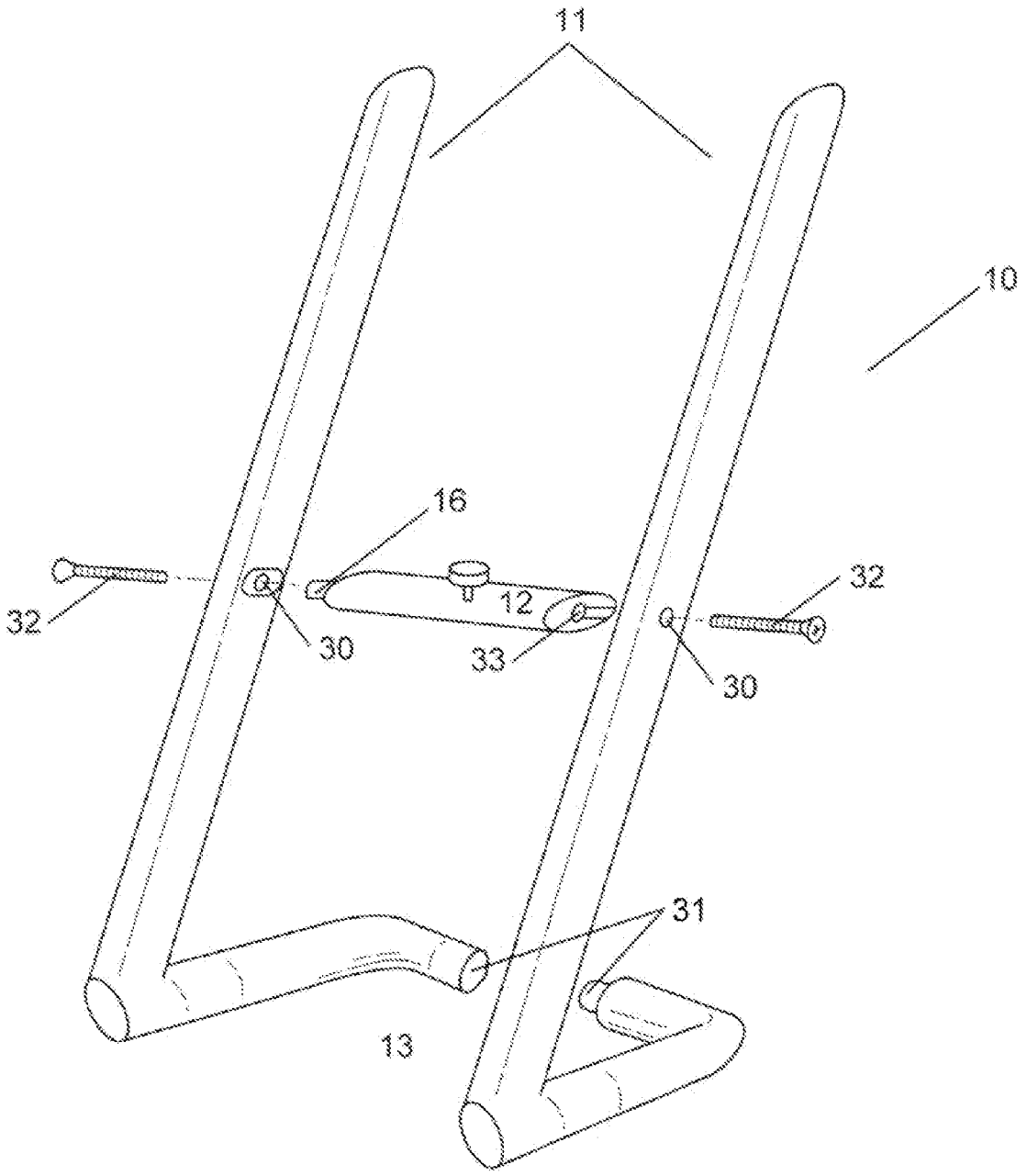
FIG. 5 is an exploded view of connection mechanisms associated with a crossbar and a base of a climbing exercise machine, according to embodiments of the present invention.

Referring now to FIG. 5, connection mechanisms of the axle 16, crossbar 12, and base of 13 the climbing exercise machine 1 are illustrated. As illustrated in FIG. 5, the uprights 11 of the frame may be provided with apertures 30, through which the axle 16 may penetrate to interconnect the belts 17 housed within the left and right uprights 11. Where the axle 16 enters, intersects, or meets each upright 11, there is generally provided a means for converting linear motion of the belt 17 to rotational motion of the axle 16 (and/or vice versa); one such means is a sprocket disposed within or in conjunction with the aperture 30. As a result of this type of interconnection between the belts 17 and the axle 16, the movements of the belts 17 (and therefore the slides 20, and therefore the handles 18 and foot pedals 21) on either side of the machine 1 may be coordinated with each other so as to ensure that the user employs a predetermined climbing motion, known as a climbing pattern; this feature is described in greater detail with reference to FIG. 7 below. Additionally, the crossbar 12 may be secured to the uprights 11 by means of screws 32 or other affixing devices inserted through a central bore 33 of the crossbar 12 and/or axle 16, as illustrated. Also illustrated in exploded view is one example of a connection mechanism 33 (in this case, a simple insertion connection) for two sides of the base 13 to be securely interconnected to each other and provide stability to the exercise machine 1.

Figure 6:
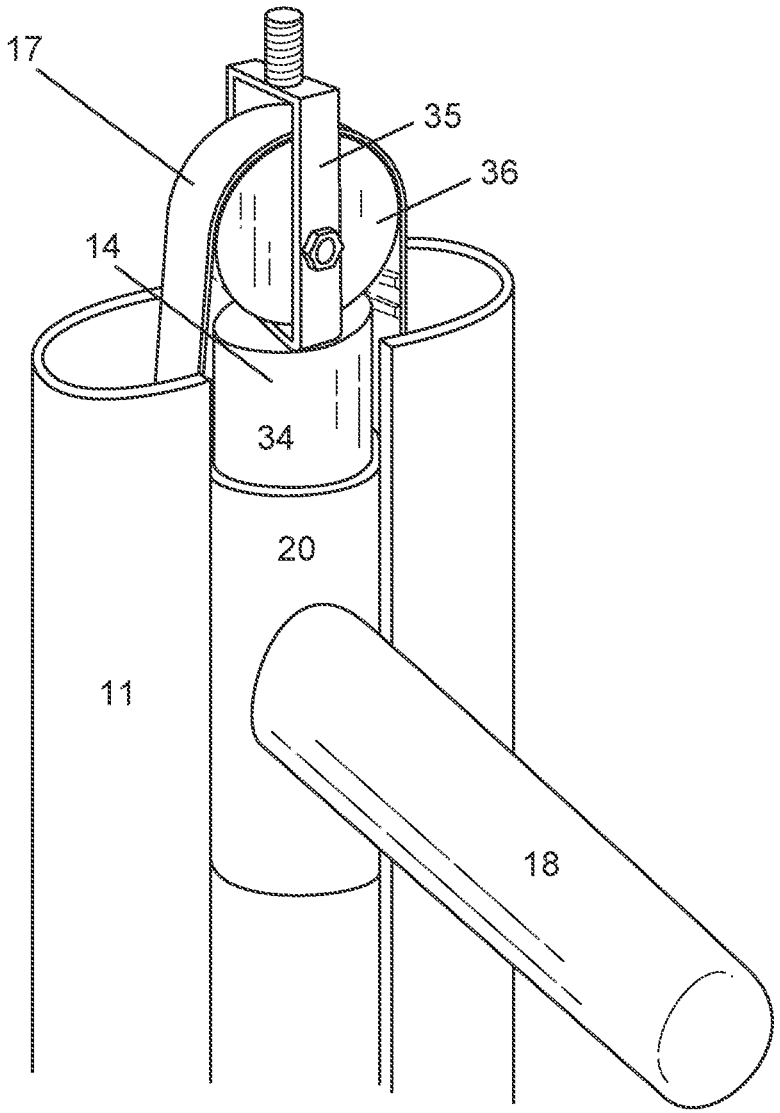
FIG. 6 is a perspective cutaway view of an upright of a climbing exercise machine, according to embodiments of the present invention.

Referring now to FIG. 6, another embodiment of an interior of an upright 11 of the climbing exercise machine 1 is illustrated in cutaway view. In this embodiment, the rail 14 comprises both a center structural 34 core and a bracket 35. The bracket 35 may have any suitably rigid construction and/or material; as illustrated in this embodiment, the bracket 35 is of unitary construction and is milled from iron or steel. The bracket 35 affixes a pulley 36, which receives and maintains the belt 17 associated with the rail 14; as illustrated, the belt 17 is looped over either longitudinal side of the center structural core 34 of the rail 14. In this embodiment, the reciprocating, self-lubricating slide 20 may substantially surround the entirety of a circumference of the center structural core 34, but as before, the slide 20 and rail 14 are configured to snugly fit together such that the slide 20 may travel smoothly and securely along the length of the rail 14. The bracket may 35, but need not, have at least one axis, diameter, or width greater than a corresponding axis, diameter, or width of the central structural core 34 of the rail, thereby acting as a "stop" to prevent the slide 20 from traveling beyond an upper end of the central structural core 34. The handle 18, as before, is connected to one side of the belt 17. It is to be expressly understood that, although the details of the structure of this embodiment may (or may not) differ from the embodiment illustrated in FIG. 2, the ultimate function, from the user's point of view, remains the same: as the user moves the handle 18 upwardly or downwardly, the travel of the slide 20 along the rail 14 causes corresponding movement of the belt 17 and therefore of the foot pedal 21 disposed on the same belt 17 (not shown), and, due to the interconnection of the two or more belts 17 via the axle 16 of the exercise machine 1, corresponding movement of the belt 17, handle 18, and foot pedal 21 of the opposing upright 11 of the exercise machine 1 (not shown). While in FIG. 6 the illustrated belt 17 and slide 20 mechanisms are shown in conjunction with a handle 18 (i.e. for receiving the user's hand), it is to be expressly understood that the same or similar mechanisms are provided, mutatis mutandis, in conjunction with each foot pedal 21 (i.e. for receiving the user's foot). Of course, the movement of the other handle 18 or either of the two foot pedals 21 of the machine 1 may also cause movement of the handle 18 illustrated in FIG. 6.

Figure 7:
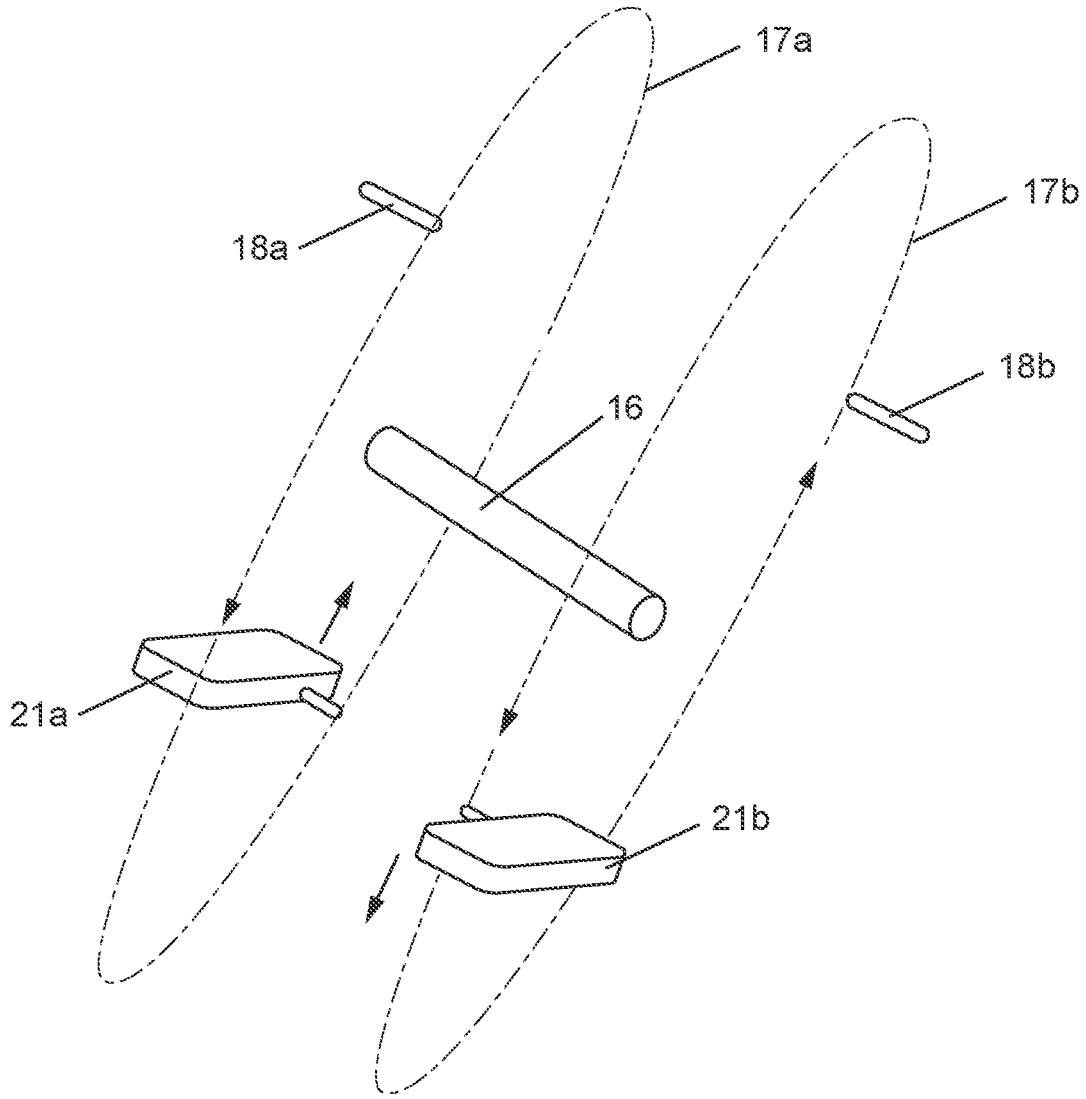
FIG. 7 is an illustration of coordinated movements of handles and foot pedals of a climbing exercise machine, according to embodiments of the present invention.

Referring now to FIG. 7, the climbing pattern created by the configuration of the handles 18 and foot pedals 21 in conjunction with the belts 17 of the climbing exercise machine 1 is illustrated. As illustrated in FIG. 7, the handles 18 and foot pedals 21 are interconnected to the belts 17 of each upright 11 (in this case, on opposing sides of the belt 17 to ensure contralateral motion), and/or the belts 17 of each upright 11 are interconnected via the axle 16, in such a way that when the user moves the left handle 18*a* downwardly, the left foot pedal 21*a* moves upwardly, the right handle 18*b* moves upwardly, and the right foot pedal 21*b* moves downwardly. Additionally, or alternatively, when the user moves the left foot pedal 21*a* upwardly, the left handle 18*a* moves downwardly, the right handle 18*b* moves upwardly, and the right foot pedal 21*b* moves downwardly. Additionally, or alternatively, when the user moves the right handle 18*b* upwardly, the left handle 18*a* moves downwardly, the left foot pedal 21*a* moves upwardly, and the right foot pedal 21*b* moves downwardly. Additionally, or alternatively, when the user moves the right foot pedal 21*b* downwardly, the left handle 18*a* moves downwardly, the left foot pedal 21*a* moves upwardly, and the right handle 18*b* moves upwardly. This climbing pattern, in which a hand and the opposite foot move upwardly while the other hand and foot move downwardly, is known as a "contralateral" or "cross-crawl" climbing pattern and may be a preferred embodiment of the desired climbing motion. In some embodiments, an alternative climbing pattern in which the right hand and foot move in one vertical direction while the left hand and foot move in the opposite direction—known as an "ipsilateral" or "standard" climbing pattern—may be preferred and provided for. Of course, all of the above movements may also be true vice versa, i.e. with each of the directions reversed.

As illustrated in FIG. 7, the exercise machine 1 is configured so as to encourage the user to use a smooth, continuous, repeatable climbing motion that represents good climbing form, e.g. a contralateral climbing motion with one hand and the opposite foot (e.g. left hand and right foot) moving in one vertical direction (e.g. downwardly) while the other hand and foot (e.g. right hand and left foot) move in the opposite vertical direction (e.g. upwardly). This encouragement of good climbing form improves the usefulness and safety of the machine to the user, as good climbing form not only improves the effectiveness of the exercise in building strength but reduces the risk of muscle strain and other injuries. It is to be expressly understood that the climbing pattern illustrated in FIG. 7 is exemplary only, and that the handles 18, foot pedals 21, slides 20, belts 17, axles 16, and other components of the climbing exercise machine 1 of the invention may be configured to encourage the user to use any desired climbing pattern while exercising.

Referring now to FIGS. 8A through 8C, various embodiments of the uprights 11 in the frame 10 of the climbing exercise machine 1 are illustrated. The embodiment illustrated in FIG. 8C is a generally A-shaped frame 10, having two full-length uprights 11 extending the entire height of the frame 10 from the base 13 to the top crossbar 12, but other configurations and embodiments are expressly contemplated and illustrated. By way of non-limiting example, one alternative embodiment of the uprights is illustrated in FIG. 8A. In this embodiment, the two uprights 11 are, as before, separate above the crossbar 12, but have been combined, below the crossbar 12, into a single central unitary upright 11*c* to provide a generally Y-shaped appearance to the frame 10 of the exercise machine. In such an embodiment, the two full-length rails 14 of the embodiments heretofore illustrated may instead be replaced by any of several different rail configurations, including, e.g., three half-length rails 14 (one in each upright 11 above the crossbar 12, and a single rail 14 supporting both foot pedals 21 below the crossbar 12), four half-length rails 14 (one in each upright 11 above the crossbar 12, and separate rails 14 supporting each foot pedal 21 below the crossbar 12), or two full-length rails 14 that are "crimped," "kinked," or "zigzagged" so as to be housed within the single central unitary upright 11*c* below the crossbar 12, through at least a portion of the crossbar 12, and then upwardly into the separate uprights 11 above the crossbar as before. The configuration of the belts 17 may, in this embodiment, be altered in similar fashion; the foot pedals 21 may be associated with two separate belts 17, or a single shared belt 17, that may or may not be the same belts 17 as those associated with the handles 18. Regardless of the exact rail 14 and belt 17 configurations, however, it is to be expressly understood that the principal advantages and benefits are derived from interconnecting the belts 17 associated with the handles 18 and the foot pedals 21 in such a way as to provide coordinated motion between the handles 18 and the foot pedals 21, which may be accomplished in any suitable configuration as will be understood by those of skill in the art in view of this disclosure.

By way of further non-limiting example, another alternative embodiment of the uprights is illustrated in FIG. 8B. In this embodiment, the two uprights 11 are, as before, separate above the crossbar 12, and remain separate below the crossbar 12 as before but at a lesser horizontal distance. The rail 14 and belt 17 configuration may be modified to fit this frame 10 shape, as it may be in the embodiment illustrated in FIG. 8A. Again, regardless of the exact rail 14 and belt 17 configurations, it is to be expressly understood that the principal advantages and benefits are derived from interconnecting the belts 17 associated with the handles 18 and the foot pedals 21 in such a way as to provide coordinated motion between the handles 18 and the foot pedals 21, which may be accomplished in any suitable configuration as will be understood by those of skill in the art in view of this disclosure.

FIGS. 8A through 8C also illustrate various embodiments of the base 13 of the exercise machine. In the embodiment illustrated in FIG. 8C, the base 13 might be modified to have two members 37 meeting at an acute angle rather than the three rectangular members illustrated in, e.g., FIG. 1. In the embodiment illustrated in FIG. 8A, the base 13 might have a "tripod" or "tetrapod" (or similar) form, with three or four (or more) members 37 extending outwardly away from the single central unitary upright 11*c*. In the embodiment illustrated in FIG. 8B, the base 13 might have a "footed" form, with "feet" 38 extending outwardly away from the uprights 111. Any one or more of these and other contemplated base 13 configurations may be combined with any one or more configurations of the frame 10, and such combinations and modifications are within the scope of the present invention.

Figure 9D:
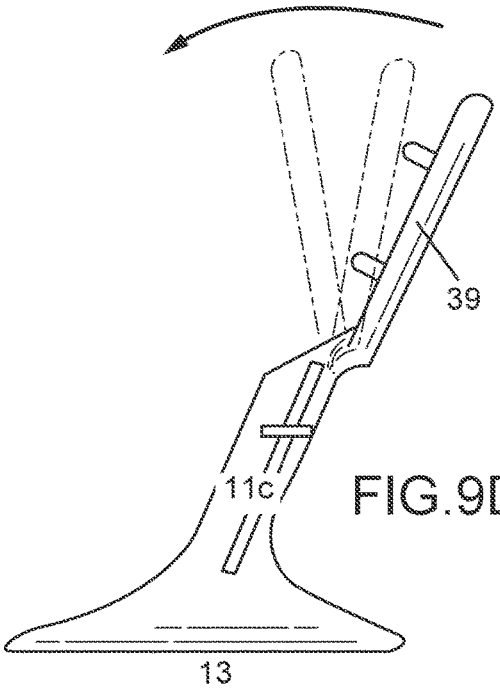
Figure 9E:
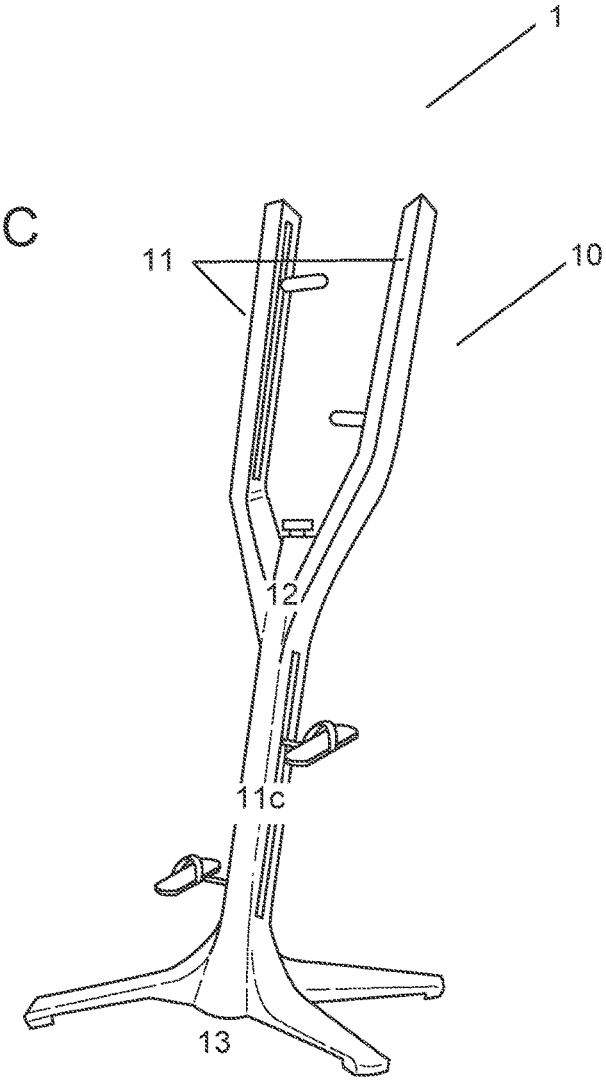

Referring now to FIGS. 9A through 9E, additional embodiments of frames 10 of a climbing exercise machine 1, specifically with a single central unitary upright 11*c* to provide a generally Y-shaped frame 10, are illustrated. As illustrated in FIGS. 9B and 9E, the uprights 11 and crossbar 12 may collectively take the form of "split arms" having any suitable shape, and specifically may be curved and/or tapered to provide a desired width between the split arms, thereby providing a frame 10 that more closely resembles a "wishbone" shape or "tuning fork" than a Y shape. In these embodiments, the crossbar 12 may not be an elongate horizontal component but may instead comprise the basal portions of the split arms where the split arms intersect the single central unitary upright 11*c*. Of particular note in these embodiments, in addition to the varying frame 10 shape and any one or more of several possible base 13 configurations, is the provision of an adjustable arm 39, interconnected with and extending upwardly from the crossbar 12 and/or intersection point of the split arms. The adjustable arm 39 functions as a mounting device for a tablet 40 or other electronic device or system that may provide the user with digital instruction, entertainment, or other data while exercising, and an angle of the adjustable arm 39 with respect to a horizontal axis may be selectively adjusted, preferably within a range of no less than about 0 degrees and no more than about 90 degrees, by a user, as illustrated in FIG. 9D.

Figure 10B:
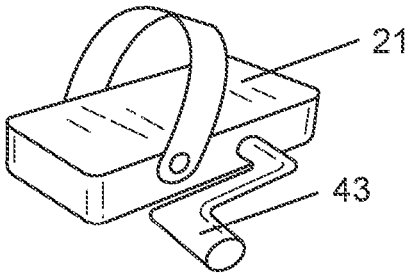

Referring now to FIGS. 10A and 10B, various optional adjustment and safety mechanisms that may be provided as part of climbing exercise machines 1 of the present invention are illustrated. As a first non-limiting example, an adjustable handle 41, which may be the same as or different from a handle 18 used by the user during exercise, may be provided on an upper or central portion of the frame 10 to aid the user in stepping up onto the foot pedals 21 of the exercise machine. As a second non-limiting example, a mounting bracket 42, provided in association with a mounting arm 39 for a tablet 40 or other electronic device or system, may allow the tablet 40 or other device or system to be tilted or rotated relative to the mounting arm 39; the mounting arm 39 may also be, in addition to adjustable with respect to angle, telescoping or otherwise articulable to allow for adjustment of a height of the tablet 40 or other device or system. As a third non-limiting example, and as illustrated in FIG. 10B, a foot pedal 21 of the exercise machine 1 may comprise a crank 43 or other mechanism allowing a position of the foot pedal 21 to be adjusted, e.g. forward or backward (relative to the rod 27 mounting the foot pedal 21 to the slide 20) or inwardly or outwardly (relative to the frame 10).

Referring now to FIG. 11, additional features of embodiments of climbing exercise machines 1 of the present invention are illustrated. In this embodiment, the crossbar 12 takes a different form than in the other embodiments previously illustrated; specifically, the crossbar 12 in this embodiment takes the form of an X-shaped piece, such that an axle 16 interconnecting the belts 17 of the left and right uprights 11 may be disposed and/or housed within either or both of the arms of the X-shape. This embodiment may provide advantages and benefits related to the smooth travel and mechanical longevity of the belts 17 and/or axle(s) 16. In this embodiment, a mounting arm 39 for a tablet 40 is curved, extending upwardly and toward a user from its connection point on the intersection of the two arms of the X-shaped piece. A further configuration of a base 13, in which a triangular portion having footings 44 is interconnected to each upright 11, is provided in this embodiment. Speakers may also be integrated into the base 13 or a lower portion of the frame 10, which may be operably connected via a wired or wireless connection to the tablet 40 to play audio content delivered via the tablet 40.

In embodiments, climbing exercise machines of the present invention may comprise a braking feature that increases the resistance the user encounters during exercise and thereby increases the intensity and/or effectiveness of the user's workout. Generally, the braking feature comprises a device or means that slows the rotation of the axle and/or increases the amount of work required to rotate the axle. By way of non-limiting example, such braking features may include a hydraulic pump, a magnetic and/or electromagnetic device that acts to slow or retard the rotation of the axle (e.g. an eddy current brake), and/or a friction brake. The degree of braking, i.e. the magnitude of the braking effect imparted by the braking feature and thus of the increase in work needed to rotate the axle, may be selectively adjusted by a user, for example by use of a knob or other user input device.

Figure 12:
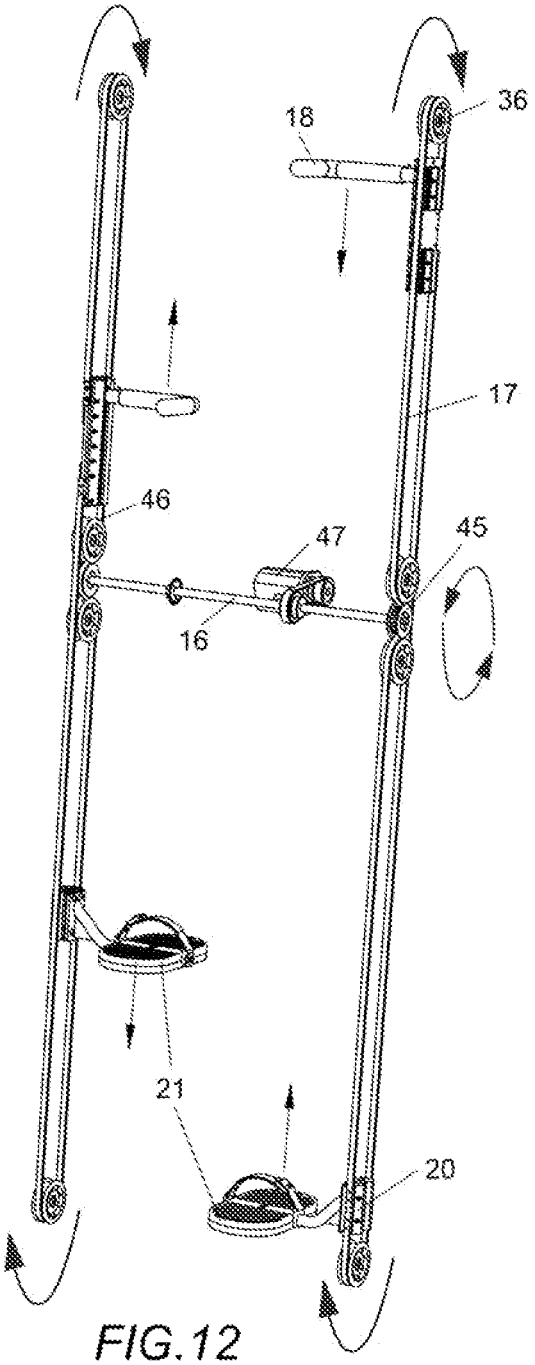
FIG. 12 illustrates various internal components of a climbing exercise machine, according to embodiments of the present invention.

Referring now to FIG. 12, another embodiment of a climbing exercise machine 1 according to the present invention is illustrated; the frame 10 is omitted from the illustration to more clearly depict internal components of the climbing exercise machine 1. In this embodiment, the belts 17 are toothed belts, which may be advantageous for, by way of non-limiting example, interfacing with a sprocket 45 that is configured to convert linear motion of the belts 17 into rotational motion of the axle 16 (or vice versa). The climbing exercise machine 1 also includes various other features of the invention, such as belt tensioners 46 that may serve any one or more of several purposes, including but not limited to the ability to be adjusted or controlled by the user via a user input device (not shown) to increase or decrease tension on the belts 17 and thus increase or decrease the resistance the user encounters during exercise. Additionally or alternatively, the user can modify the resistance encountered during exercise by controlling, via the same or a different user input device, a resistance pump or motor 47 that is operatively interconnected to the axle 16, e.g., via a belt and pulleys.

In embodiments, climbing exercise machines of the present invention may comprise one or more sensors or devices for measuring and/or recording at least one parameter associated with a use of the machine that corresponds to a parameter of interest to the user. Specifically, many users desire to measure, record, or calculate parameters such as a length of the workout, an effective distance climbed during the workout, a quantity of energy expended the workout, and so on. In some cases, these parameters can be measured directly (e.g. by timing the workout), while others may be calculated from parameters associated with the machine, e.g., the total distance traveled by the reciprocating, self-lubricating slides, the number of rotations of the axle, and/or the work done on the axle (total and/or per rotation). Accordingly, the sensor(s) or device(s) may measure and/or record the parameter associated with the machine and, optionally, convert this parameter to a parameter of interest to the user according to an algorithm. In some embodiments, data comprising the parameter associated with the machine and/or the parameter of interest to the user may be presented to the user in a graphical user interface of the tablet computer of the exercise machine.

In embodiments, the base of the climbing exercise machine may comprise wheels or casters that permit the machine to be easily repositioned on a floor or ground surface. The wheels or casters may take any suitable form and may be placed on any suitable portion of the base. The wheels or casters may, but need not, be selectively removable and/or may be provided with a braking and/or locking mechanism to secure the machine in a desired position.

Figure 13:
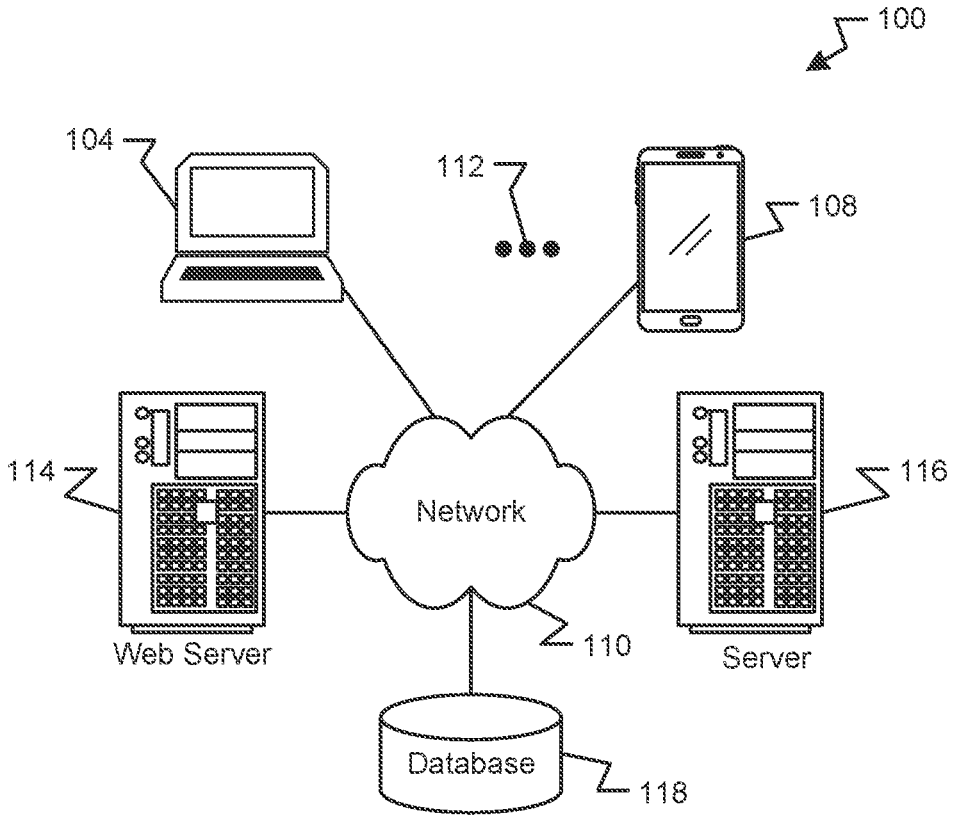
FIG. 13 is a block diagram illustrating elements of an exemplary computing environment in which embodiments of the present disclosure may be implemented.

FIG. 13 is a block diagram illustrating elements of an exemplary computing environment in which embodiments of the present disclosure may be implemented. More specifically, this example illustrates a computing environment 100 that may function as the servers, user computers, or other systems provided and described herein. The environment 100 includes one or more user computers, or computing devices, such as a computing device 104, a communication device 108, and/or more 112. The computing devices 104, 108, 112 may include general purpose personal computers (including, merely by way of example, personal computers, and/or laptop computers running various versions of Microsoft Corp.'s Windows® and/or Apple Corp.'s Macintosh® operating systems) and/or workstation computers running any of a variety of commercially available UNIX® or UNIX-like operating systems. These computing devices 104, 108, 112 may also have any of a variety of applications, including for example, database client and/or server applications, and web browser applications. Alternatively, the computing devices 104, 108, 112 may be any other electronic device, such as a thin-client computer, Internet-enabled mobile telephone, and/or personal digital assistant, capable of communicating via a network 110 and/or displaying and navigating web pages or other types of electronic documents. Although the exemplary computer environment 100 is shown with two computing devices, any number of user computers or computing devices may be supported.

Environment 100 further includes a network 110. The network 110 may can be any type of network familiar to those skilled in the art that can support data communications using any of a variety of commercially available protocols, including without limitation Session Initiation Protocol (SIP), Transmission Control Protocol/Internet Protocol (TCP/IP), Systems Network Architecture (SNA), Internetwork Packet Exchange (IPX), AppleTalk, and the like. Merely by way of example, the network 110 may be a Local Area Network (LAN), such as an Ethernet network, a Token-Ring network and/or the like; a wide-area network; a virtual network, including without limitation a Virtual Private Network (VPN); the Internet; an intranet; an extranet; a Public Switched Telephone Network (PSTN); an infra-red network; a wireless network (e.g., a network operating under any of the IEEE 802.9 suite of protocols, the Bluetooth® protocol known in the art, and/or any other wireless protocol); and/or any combination of these and/or other networks.

The system may also include one or more servers 114, 116. In this example, server 114 is shown as a web server and server 116 is shown as an application server. The web server 114, which may be used to process requests for web pages or other electronic documents from computing devices 104, 108, 112. The web server 114 can be running an operating system including any of those discussed above, as well as any commercially available server operating systems. The web server 114 can also run a variety of server applications, including SIP servers, HyperText Transfer Protocol (secure) (HTTP(s)) servers, FTP servers, CGI servers, database servers, Java servers, and the like. In some instances, the web server 114 may publish operations available operations as one or more web services.

The environment 100 may also include one or more file and or/application servers 116, which can, in addition to an operating system, include one or more applications accessible by a client running on one or more of the computing devices 104, 108, 112. The server(s) 116 and/or 114 may be one or more general purpose computers capable of executing programs or scripts in response to the computing devices 104, 108, 112. As one example, the server 116, 114 may execute one or more web applications. The web application may be implemented as one or more scripts or programs written in any programming language, such as Java™, C, C#®, or C++, and/or any scripting language, such as Perl, Python, or Tool Command Language (TCL), as well as combinations of any programming/scripting languages. The application server(s) 116 may also include database servers, including without limitation those commercially available from Oracle®, Microsoft®, Sybase®, IBM® and the like, which can process requests from database clients running on a computing device 104, 108, 112.

The web pages created by the server 114 and/or 116 may be forwarded to a computing device 104, 108, 112 via a web (file) server 114, 116. Similarly, the web server 114 may be able to receive web page requests, web services invocations, and/or input data from a computing device 104, 108, 112 (e.g., a user computer, etc.) and can forward the web page requests and/or input data to the web (application) server 116. In further embodiments, the server 116 may function as a file server. Although for ease of description, FIG. 13 illustrates a separate web server 114 and file/application server 116, those skilled in the art will recognize that the functions described with respect to servers 114, 116 may be performed by a single server and/or a plurality of specialized servers, depending on implementation-specific needs and parameters. The computer systems 104, 108, 112, web (file) server 114 and/or web (application) server 116 may function as the system, devices, or components described herein.

The environment 100 may also include a database 118. The database 118 may reside in a variety of locations. By way of example, database 118 may reside on a storage medium local to (and/or resident in) one or more of the computers 104, 108, 112, 114, 116. Alternatively, it may be remote from any or all of the computers 104, 108, 112, 114, 116, and in communication (e.g., via the network 110) with one or more of these. The database 118 may reside in a Storage-Area Network (SAN) familiar to those skilled in the art. Similarly, any necessary files for performing the functions attributed to the computers 104, 108, 112, 114, 116 may be stored locally on the respective computer and/or remotely, as appropriate. The database 118 may be a relational database, such as Oracle 20i®, that is adapted to store, update, and retrieve data in response to Structured Query Language (SQL) formatted commands.

Figure 14:
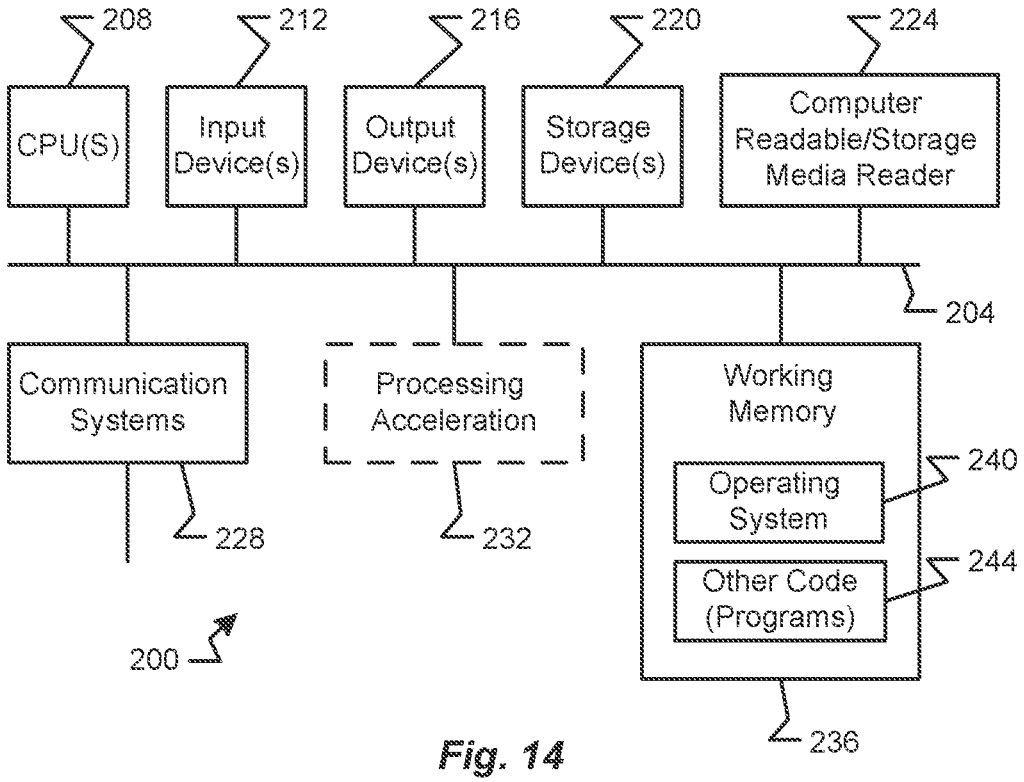
FIG. 14 is a block diagram illustrating elements of an exemplary computing device in which embodiments of the present disclosure may be implemented.
Figure 15:
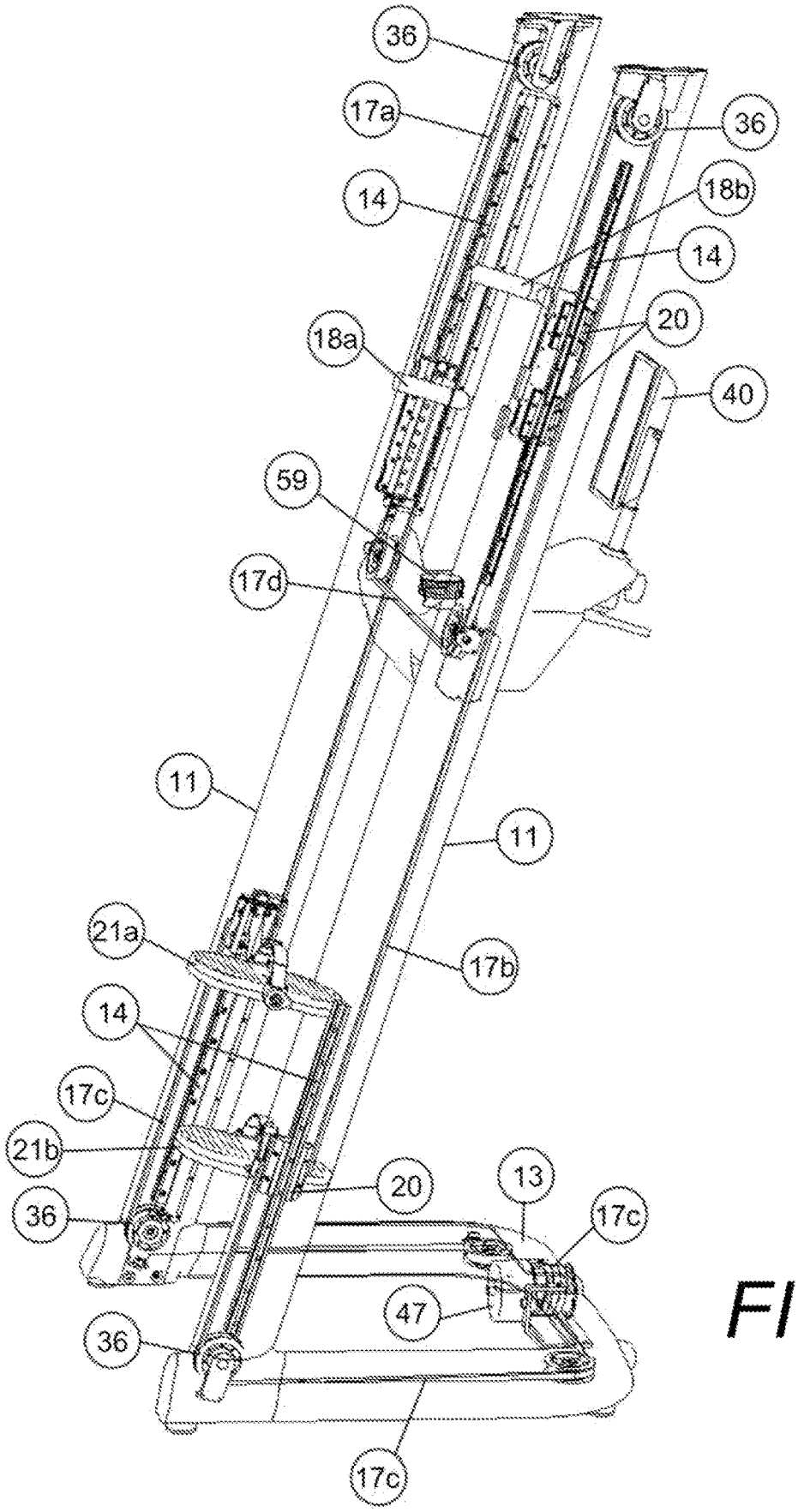
FIG. 15 is a front perspective view of a climbing exercise machine, according to embodiments of the present invention.
Figure 16:
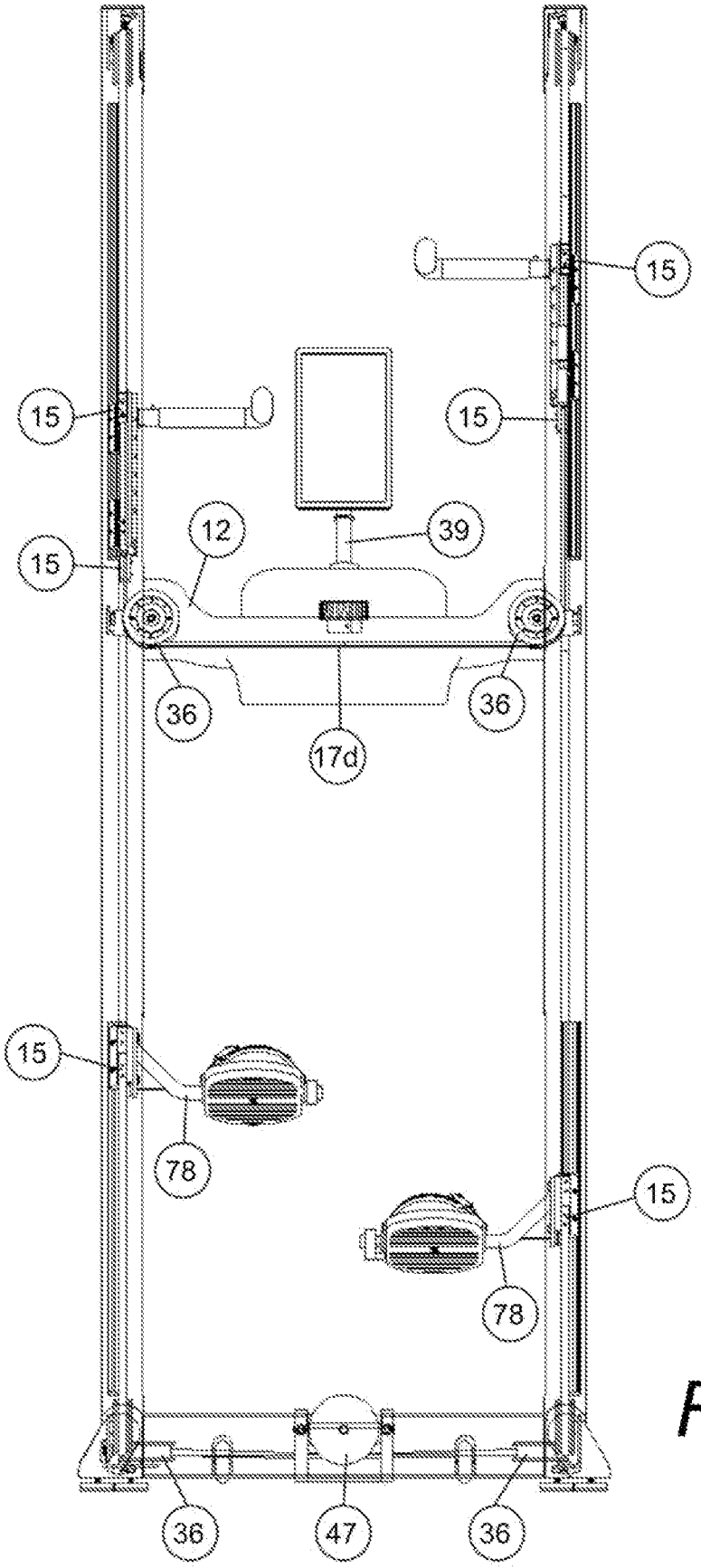
FIG. 16 is a front view of a climbing exercise machine, according to embodiments of the present invention.
Figure 17:
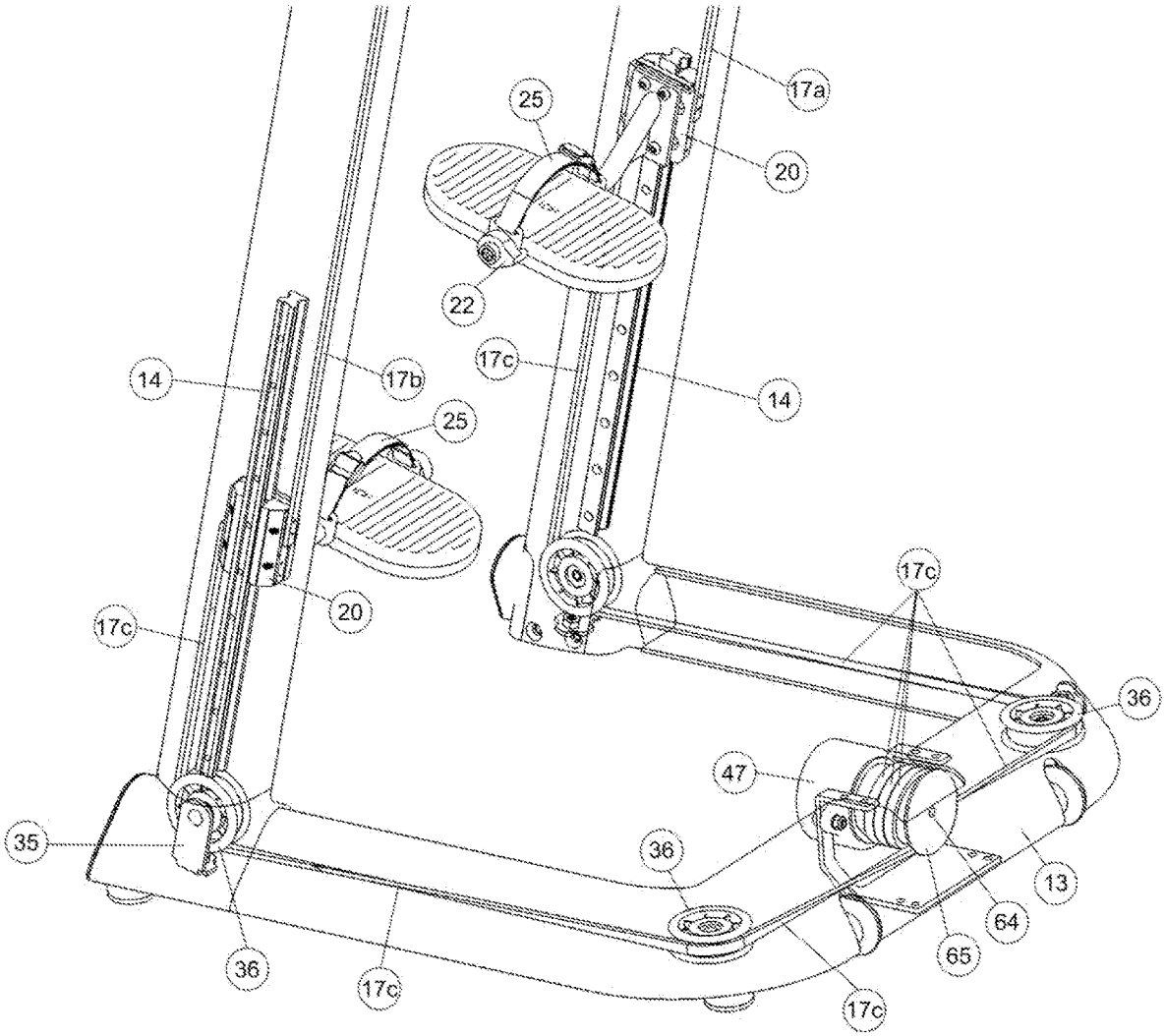
FIG. 17 is a rear perspective closeup view of the lower section of a climbing exercise machine, according to embodiments of the present invention.
Figure 18:
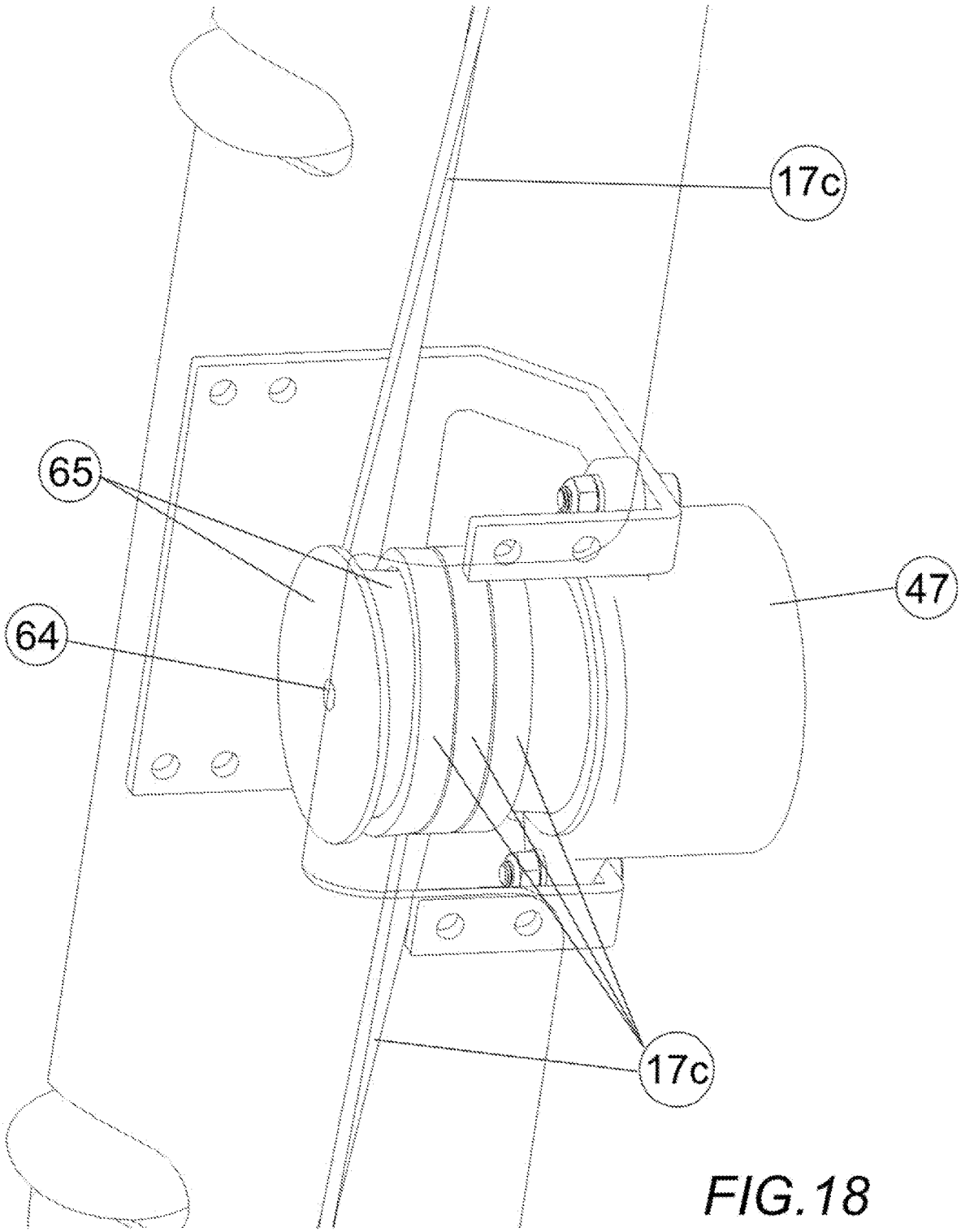
FIG. 18 is a closeup view of a resistance motor, according to embodiments of the present invention.

FIG. 14 is a block diagram illustrating elements of an exemplary computing device in which embodiments of the present disclosure may be implemented. More specifically, this example illustrates one embodiment of a computer system 200 upon which the servers, user computers, computing devices, or other systems or components described above may be deployed or executed. The computer system 200 is shown comprising hardware elements that may be electrically coupled via a bus 204. The hardware elements may include one or more Central Processing Units (CPUs) 208; one or more input devices 212 (e.g., a mouse, a keyboard, etc.); and one or more output devices 216 (e.g., a display device, a printer, etc.). The computer system 200 may also include one or more storage devices 220. By way of example, storage device(s) 220 may be disk drives, optical storage devices, solid-state storage devices such as a Random-Access Memory (RAM) and/or a Read-Only Memory (ROM), which can be programmable, flash-updateable and/or the like.

The computer system 200 may additionally include a computer-readable storage media reader 224; a communications system 228 (e.g., a modem, a network card (wireless or wired), an infra-red communication device, etc.); and working memory 236, which may include RAM and ROM devices as described above. The computer system 200 may also include a processing acceleration unit 232, which can include a Digital Signal Processor (DSP), a special-purpose processor, and/or the like.

The computer-readable storage media reader 224 can further be connected to a computer-readable storage medium, together (and, optionally, in combination with storage device(s) 220) comprehensively representing remote, local, fixed, and/or removable storage devices plus storage media for temporarily and/or more permanently containing computer-readable information. The communications system 228 may permit data to be exchanged with a network and/or any other computer described above with respect to the computer environments described herein. Moreover, as disclosed herein, the term "storage medium" may represent one or more devices for storing data, including ROM, RAM, magnetic RAM, core memory, magnetic disk storage mediums, optical storage mediums, flash memory devices and/or other machine-readable mediums for storing information.

The computer system 200 may also comprise software elements, shown as being currently located within a working memory 236, including an operating system 240 and/or other code 244. It should be appreciated that alternate embodiments of a computer system 200 may have numerous variations from that described above. For example, customized hardware might also be used and/or particular elements might be implemented in hardware, software (including portable software, such as applets), or both. Further, connection to other computing devices such as network input/output devices may be employed.

Examples of the processors 208 as described herein may include, but are not limited to, at least one of Qualcomm® Snapdragon® 800 and 801, Qualcomm® Snapdragon® 620 and 615 with 4G LTE Integration and 64-bit computing, Apple® A7 processor with 64-bit architecture, Apple® M7 motion coprocessors, Samsung® Exynos® series, the Intel® Core™ family of processors, the Intel® Xeon® family of processors, the Intel® Atom™ family of processors, the Intel Itanium® family of processors, Intel® Core® i5-4670K and i7-4770K 22 nm Haswell, Intel® Core® i5-3570K 22 nm Ivy Bridge, the AMD® FX™ family of processors, AMD® FX-4300, FX-6300, and FX-8350 32 nm Vishera, AMD® Kaveri processors, Texas Instruments® Jacinto C6000™ automotive infotainment processors, Texas Instruments® OMAP™ automotive-grade mobile processors, ARM® Cortex™-M processors, ARM® Cortex-A and ARM926EJ-S™ processors, other industry-equivalent processors, and may perform computational functions using any known or future-developed standard, instruction set, libraries, and/or architecture.

FIGS. 15-36 illustrate various views of climbing exercise machines according to additional or alternative embodiments of the invention. In certain figures, portions of the structural frame are illustrated as transparent to best illustrate various features and components located within various portions of the frame and to illustrate how those features and components interact to create the function of each embodiment. Each of the functional components and features of the embodiments of the invention is clearly illustrated in at least one figure, but in some figures certain components or features are omitted to best illustrate other components that may not be as visible otherwise.

Each embodiment of a climbing exercise machine according to embodiments of the invention is supported by a base, i.e. a structural portion of the machine that contacts a floor surface or ground surface. In some figures, one or more flexible components are represented as belts, while in other figures one or more flexible components are represented as chains; it is to be expressly understood that various flexible components, such as belts, chains, cables, ropes, and the like, can be utilized to interconnect the various components and mechanisms of climbing exercise machines of the invention, and all such variations are within the scope of the invention. Likewise, in some figures, the flexible components are represented as being guided by pulleys and in certain figures the flexible components are represented as being guided by sprockets; it is to be expressly understood that various circular components that rotate on a center axle and are capable of guiding a flexible component can be used to guide the flexible components of the climbing exercise machines of the invention, and all such variations are within the scope of the invention.

A resistance component of climbing exercise machines of the invention that provides resistance to the user while exercising is referred to herein as a "resistance motor," but it is to be expressly understood that various additional or alternative components and/or mechanisms can be utilized to provide resistance to the user, and all such variations are within the scope of the invention. A component referred to herein as a "slide" is a component that (1) engages with a substantially planar surface, e.g. by sliding or rolling on the substantially planar surface, and (2) is interconnected to or with other components of the climbing exercise machine and causing those other components to move linearly with the sliding or rolling of the slide along the substantially planar surface.

When structures or components of the invention are referred to as being located on a left or right side of a climbing exercise machine, it is to be understood that this refers to a user's left or right, respectively, when the user is engaged with and operating the machine. When referring to a forward or rearward portion of a climbing exercise machine, it is to be understood that forward aspects of the machine are proximate to a side of the machine from which the user mounts and dismounts the machine, and rearward aspects of the machine are distant from a side of the machine from which the user mounts and dismounts the machine.

FIGS. 15-23 illustrate an embodiment of the invention comprising two uprights 11, wherein a linkage assembly that interconnects handles, foot pedals, and a resistance mechanism of the machine comprises multiple flexible components that are guided by pulleys (hereinafter a "multiple flexible component assembly"). A resistance motor 47 is rotated by one of these multiple flexible components, in a configuration referred to as a "capstan;" in this configuration, as illustrated in isolated view in FIGS. 17 and 18, a central portion of a belt 17*c* is wrapped in multiple circular windings on the surface of a resistance motor axle pulley 65. The resistance motor axle pulley 65 is rigidly attached to the resistance motor axle 64 such that the reciprocating motion of belt 17*c* on the resistance motor axle pulley 65 rotates the resistance motor axle 64 to activate the resistance motor 47 during operation of the machine 1.

FIGS. 15, 16, 22, and 23 illustrate a climbing exercise machine 1 of an embodiment of the invention utilizing a multiple flexible component assembly, wherein the lower ends of left and right uprights 11, which are mostly vertical, parallel, and spaced, are rigidly attached to a forward and open end of a base 13 at an obtuse angle; while the figures illustrate the base 13 as being U- or horseshoe-shaped, it is to be expressly understood that the base 13 can be configured in any of various shapes capable of supporting uprights 11, a user U, and the other components of the machine 1, and such variations are within the scope of the invention. Uprights 11 and base 13 are constructed of a rigid material capable of supporting the components and functions of the machine 1 and the user U; any of various metals, steels, and alloys may be commonly employed, but other materials are contemplated and are within the scope of the invention. Each upright 11 houses a stationary upper rail 14 and a stationary lower rail 14, and each rail 14 supports at least one slide 20 such that each slide 20 can slide on a rail 14 to create a linear reciprocating motion along the uprights 11. The slides 20 can be constructed with various components, such as wheels, linear motion bearings, or other linear motion components, for engaging with and moving along the rails 14. Upper left linear slide 20 is rigidly connected to a handle adjustment plate 19 that in turn is operatively connected to a left handle 18*a*, and lower left linear slide 20 is rigidly connected to a foot pedal support axle 78 that in turn is operatively connected to a left foot pedal 21*a*. Upper right linear slide 20 is rigidly connected to a handle adjustment plate 19 that in turn is operatively connected to a right handle 18*b*, and lower right linear slide 20 is rigidly connected to a foot pedal support axle 78 that in turn is operatively connected to a right foot pedal 21*b*. A crossbar 12 connects left upright 11 to right upright 11. As illustrated, the crossbar 12 connects a central portion of left upright 11 to a central portion of right upright 11, but it is to be expressly understood that crossbar 12 can connect at various locations on left and right uprights 11 and allow for the climbing exercise machine 1 to provide substantially similar functions, and such variations are within the scope of the invention. The crossbar 12 can be constructed of any of various rigid materials capable of supporting the components connected to crossbar 12; any of various metals, steels, and alloys may be commonly employed, but other materials are contemplated and are within the scope of the invention. Vertically oriented pulleys 36 are mounted within the upper ends of left and right uprights 11. A vertically oriented pulley 36 is mounted within the lower ends of left and right uprights 11 such that a portion of pulley 36 extends into the left and right forward portions of base 13. Horizontally oriented pulleys 36 are mounted within the left and right sides of the base 13 at the rearward closed end of the base 13 such that a portion of each of these pulleys 36 extends into the cross section of the base 13. Vertically oriented pulleys 36 are mounted within the left and right ends of the crossbar 12 such that a portion of each of these pulleys 36 extends into the left and right uprights 11, respectively. The uprights 11, crossbar 12, and base 13 are constructed of rigid materials capable of supporting the user U and the components and functions of the climbing exercise machine 1; any of various metals, steels, and alloys may be commonly employed, but other materials are contemplated and are within the scope of the invention.

Figure 20A:
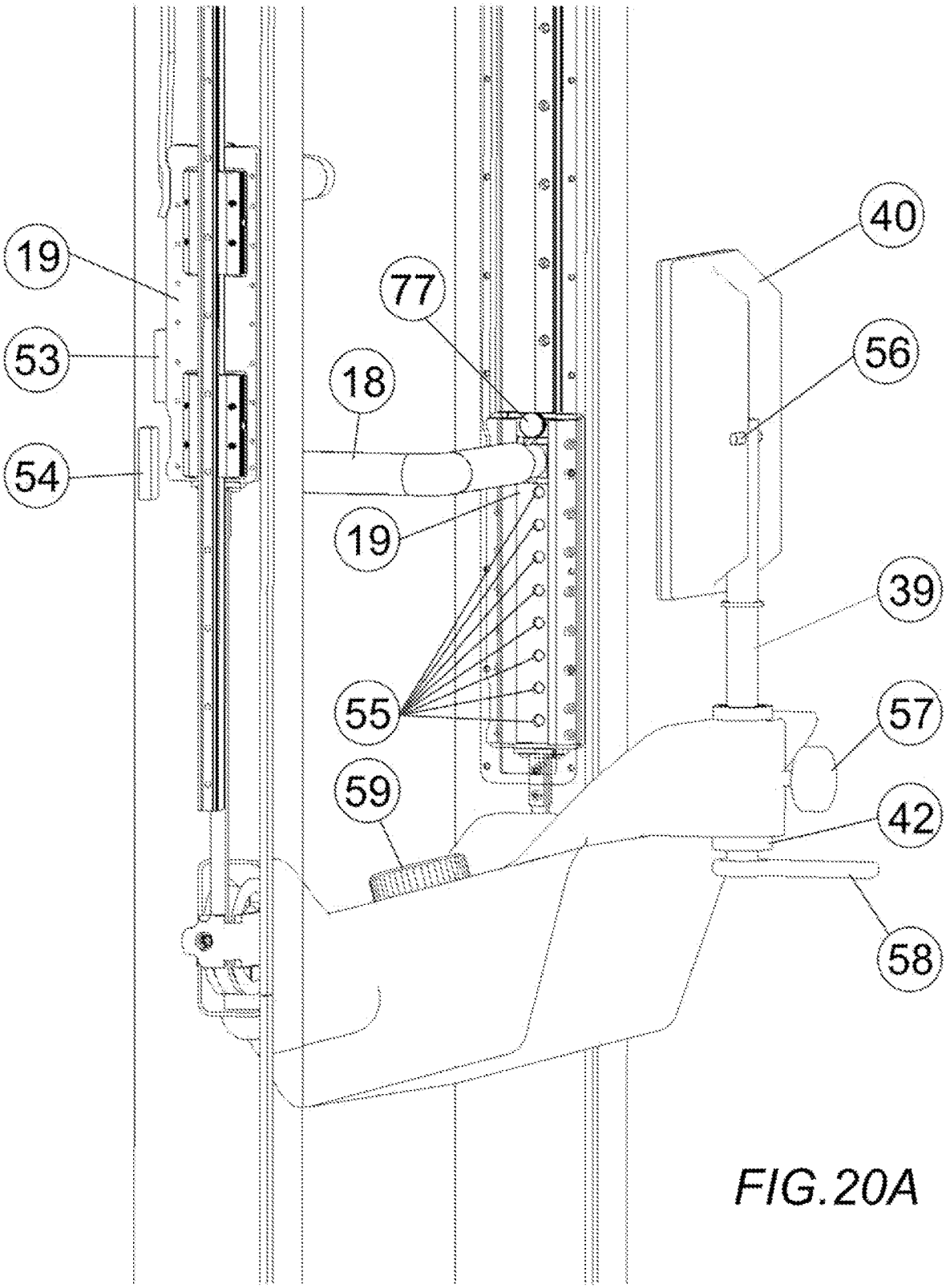
FIG. 20A is a rear perspective center section view of a climbing exercise machine with a computer tablet facing forward, according to embodiments of the present invention.

FIGS. 15, 16, and 20A-23 illustrate various views of left handle 18*a* and right handle 18*b* of embodiments of the invention. Each handle 18 is adjustably mounted on a handle adjustment plate 19. FIGS. 20A and 20B illustrate closeup views of a handle adjustment plate 19 and a handle 18, wherein the handle 18 is rigidly connected to a handle adjustment latching pin 77 and handle adjustment plate 19 is configured with multiple handle adjustment latching pin receivers 55. To optimize operation of the climbing exercise machine 1 for each individual user U, the location of the handle 18 on the handle adjustment plate 19 can be adjusted prior to operating the machine 1 by disengaging the adjustment latching pin 77 from a first handle adjustment latching pin receiver 55, moving the handle 18 to a different location on the handle adjustment plate 19, and engaging handle adjustment latching pin 77 with a second adjustment latching pin receiver 55. FIG. 20A illustrates the handle 18 in a first location on the handle adjustment plate 19, and FIG. 20B illustrates the handle 18 in a second location on the handle adjustment plate 19.

Figure 19A:
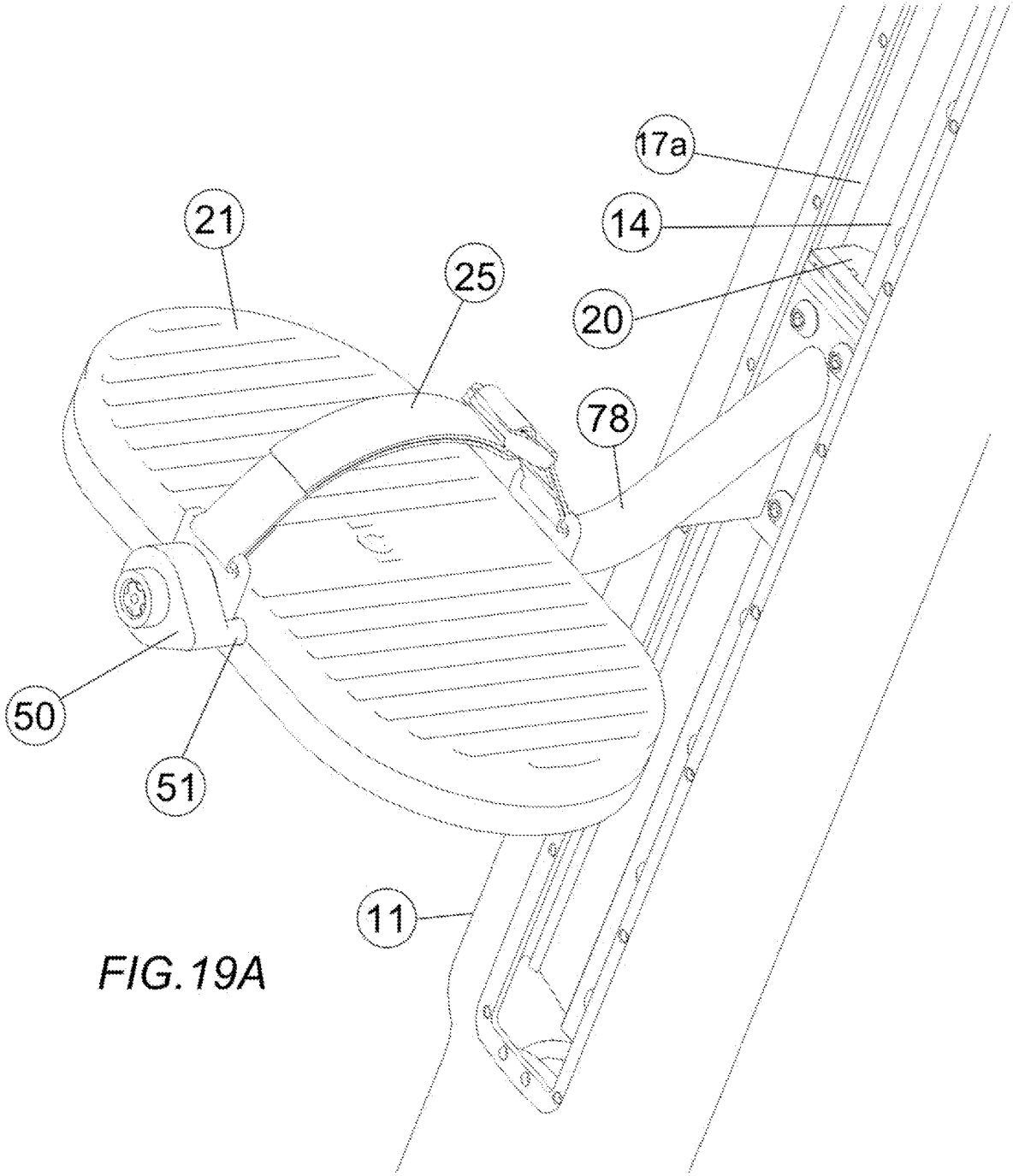
FIG. 19A is a closeup view of a pedal assembly and pedal latch, with the latch engaged, according to embodiments of the present invention.
Figure 19B:
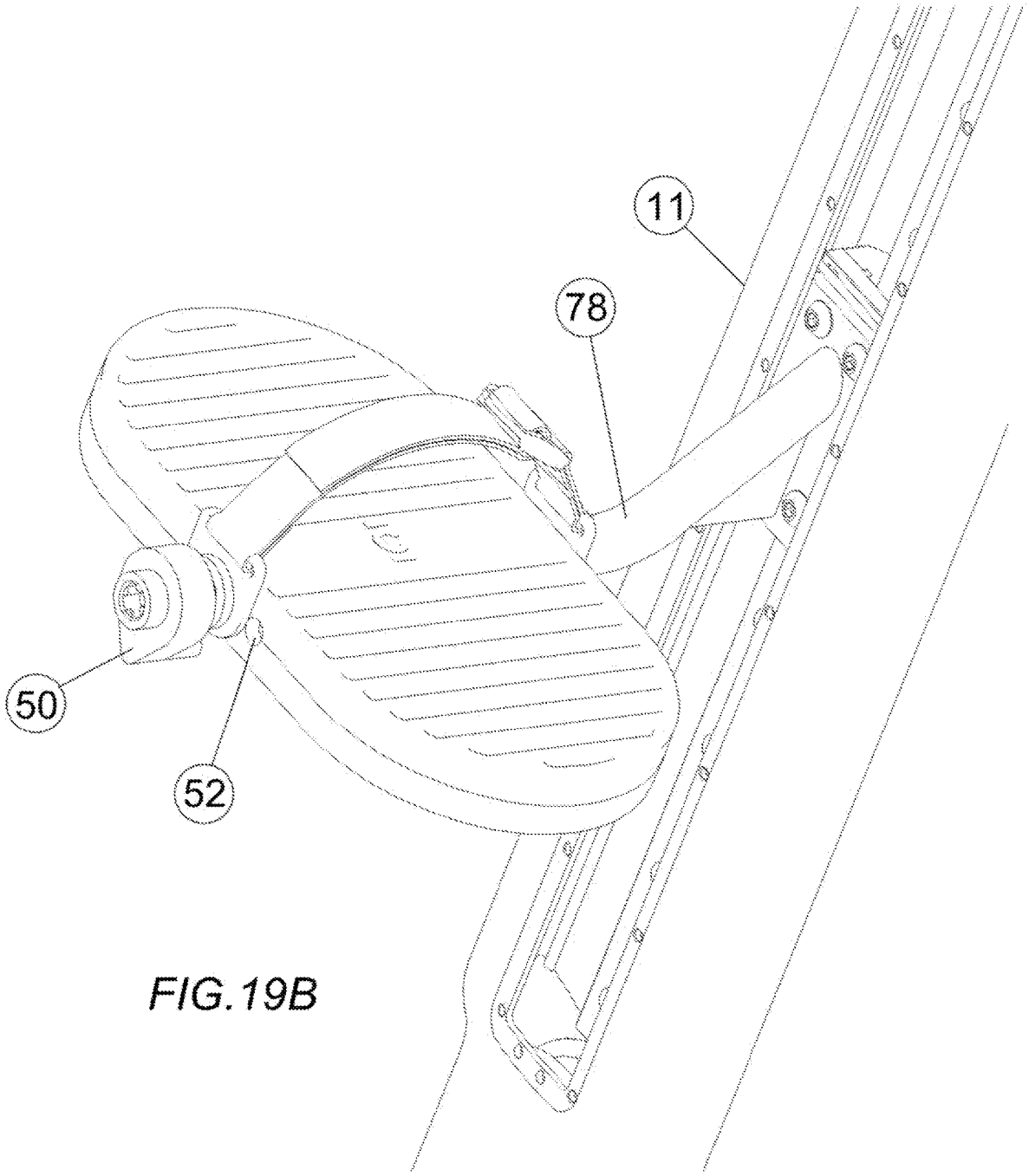
FIG. 19B is a closeup view of a pedal assembly and pedal latch with the latch disengaged, according to embodiments of the present invention.

FIGS. 15-17, 19A, 19B, 22, and 23 illustrate various views of a left foot pedal 21*a* and a right foot pedal 21*b* of embodiments of the invention. Each foot pedal 21 is operatively mounted on a foot pedal support axle 78. FIGS. 19A and 19B illustrate closeup views of a foot pedal 21, an adjustable strap 25, a foot pedal support axle 78, and a foot pedal latch 50. The foot pedal latch 50 is a spring-loaded latch that is operatively mounted to the end of the foot pedal support axle 78 that is distant from an upright 11. When the internal spring of the foot pedal latch 50 is extended and the foot pedal latch 50 is proximate to upright 11, the foot pedal latch 50 cannot rotate on foot pedal support axle 78, but when the internal spring of the foot pedal latch 50 is contracted and the foot pedal latch 50 is distant from upright 11, the foot pedal latch 50 can be rotated. FIG. 19A illustrates the foot pedal latch 50 as rigidly connected to foot pedal 21, wherein the internal spring of the foot pedal latch 50 is extended and a foot pedal latch pin 51 is engaged with a foot pedal latch receiver 52 such that the foot pedal 21 is rigidly connected to the foot pedal support axle 78 at a fixed angle. FIG. 19B illustrates the foot pedal latch 50 as disconnected from the foot pedal 21, wherein the internal spring of the foot pedal latch 50 is compressed, the foot pedal latch 50 is rotated downward, and the foot pedal latch pin 51 is disengaged from the foot pedal latch receiver 52 such that the foot pedal 21 can articulate about the foot pedal support axle 78. The adjustable strap 25 is connected to either side of the foot pedal 21 to secure the user U's foot during operation of the climbing exercise machine 1.

FIGS. 15-18 and 20A-23 illustrate various views of the belt patterns of the linkage assembly, in this case a multiple flexible component assembly, of embodiments of the invention, wherein a belt 17*a* operatively connects left handle 18*a* to left foot pedal 21*a* and a belt 17*b* operatively connects right handle 18*b* to right foot pedal 21*b*. A first end of belt 17*a* is connected to the forward side of left handle adjustment plate 19 with a belt connector 15, whereby the first end of belt 17*a* is operatively connected to left handle 18*a* and belt 17*a* extends upward within the forward side of left upright 11, wraps over a pulley 36, and extends downward within the rearward side of left upper upright 11, and a second end of belt 17*a* is connected to the rearward side of a slide 20 with a belt connector 15 such that the second end of belt 17*a* is operatively connected to left foot pedal support axle 78 and left foot pedal 21*a*. Belt 17*b* is operatively connected to right handle 18*b* and right foot pedal 21*b* in an identical configuration, mutatis mutandis.

FIGS. 15-18 and 20A-23 also illustrate that, in this configuration, a belt 17*c* operatively connects left foot pedal 21*a* to the resistance motor 47 and to right foot pedal 21*b*, and a belt 17*d* operatively connects left handle 18*a* to right handle 18*b*. The first end of belt 17*c* connects to the forward side of a slide 20 with a belt connector 15 such that the first end of belt 17*c* is operatively connected to left foot pedal support axle 78 and left foot pedal 21*a*, extends downward within the front side of left upright 11 and into the forward end of the base 13, wraps underneath a pulley 36, extends through a left side tube of base 13 to the forward end of the left side tube, wraps around the left side of a pulley 36, extends within a cross tube of the base 13 to a center section of the cross tube, wraps multiple times about the resistance motor axle pulley 65, extends through the cross tube of the base 13 to the forward end of a right side tube of base 13, wraps around the forward side of a pulley 36, extends through the right side tube of the base 13 to the forward end of the right side tube, wraps underneath a pulley 36, and extends upward within the forward side of right upright 11. The second end of belt 17*c* connects to the forward side of a slide 20 with a belt connector 15 such that the second end of belt 17*c* is operatively connected to left foot pedal support axle 78 and left foot pedal 21*a*. The first end of belt 17*d* is connected to the lower center section of left handle adjustment plate 19 with a belt connector 15 such that the first end of belt 17*d* is operatively connected to left handle 18*a*, extends downward within left upright 11, wraps around an outer side of a pulley 36, extends through the crossbar 12 to the right end of the crossbar 12, wraps around the bottom side of a pulley 36, and extends upward through right upright 11. The second end of belt 17*d* connects to the lower center section of right handle adjustment plate 19 with a belt connector 15 such that the second end of belt 17*d* is operatively connected to right handle 18*b*.

As a result of the interconnection of the handles 18 and foot pedals 21 created by the multiple flexible component linkage assembly illustrated in FIGS. 15-18 and 20A-23, a concurrent pattern of reciprocating motion of the handles 18 and foot pedals 21 is created, such that (1) when left handle 18*a* moves upward, left foot pedal 21*a* moves downward (and vice versa); (2) when right handle 18*b* moves upward, right foot pedal 21*b* moves downward (and vice versa); (3) when left handle 18*a* moves upward, right handle 18*b* moves downward (and vice versa); and (4) when left foot pedal 21*a* moves upward, right foot pedal 21*b* moves downward (and vice versa). This pattern causes the reciprocating motion of belt 17*c*, which is wrapped multiple times about the resistance motor axle pulley 65, to rotate the resistance motor axle pulley 65 and thus the resistance motor axle 64, which activates the resistance motor 47 during operation of the climbing exercise machine 1.

FIGS. 15, 16, and 20A-23 illustrate various views of the crossbar 12, and various components and features mounted on and within the crossbar 12, of embodiments of the invention. As previously described herein, pulleys 36 are mounted on each end of crossbar 12 to guide a belt 17*d* through the crossbar 12. A resistance adjustment dial 59 is mounted on a central portion of the crossbar 12, in a location easily accessible by the user U during operation of the machine 1, and is operatively connected to the resistance motor 47 such that the user U can move and adjust the resistance adjustment dial 59 to a preferred setting to manipulate the amount of resistance to the exercise motion of the machine 1 created by the resistance motor 47.

Figure 20B:
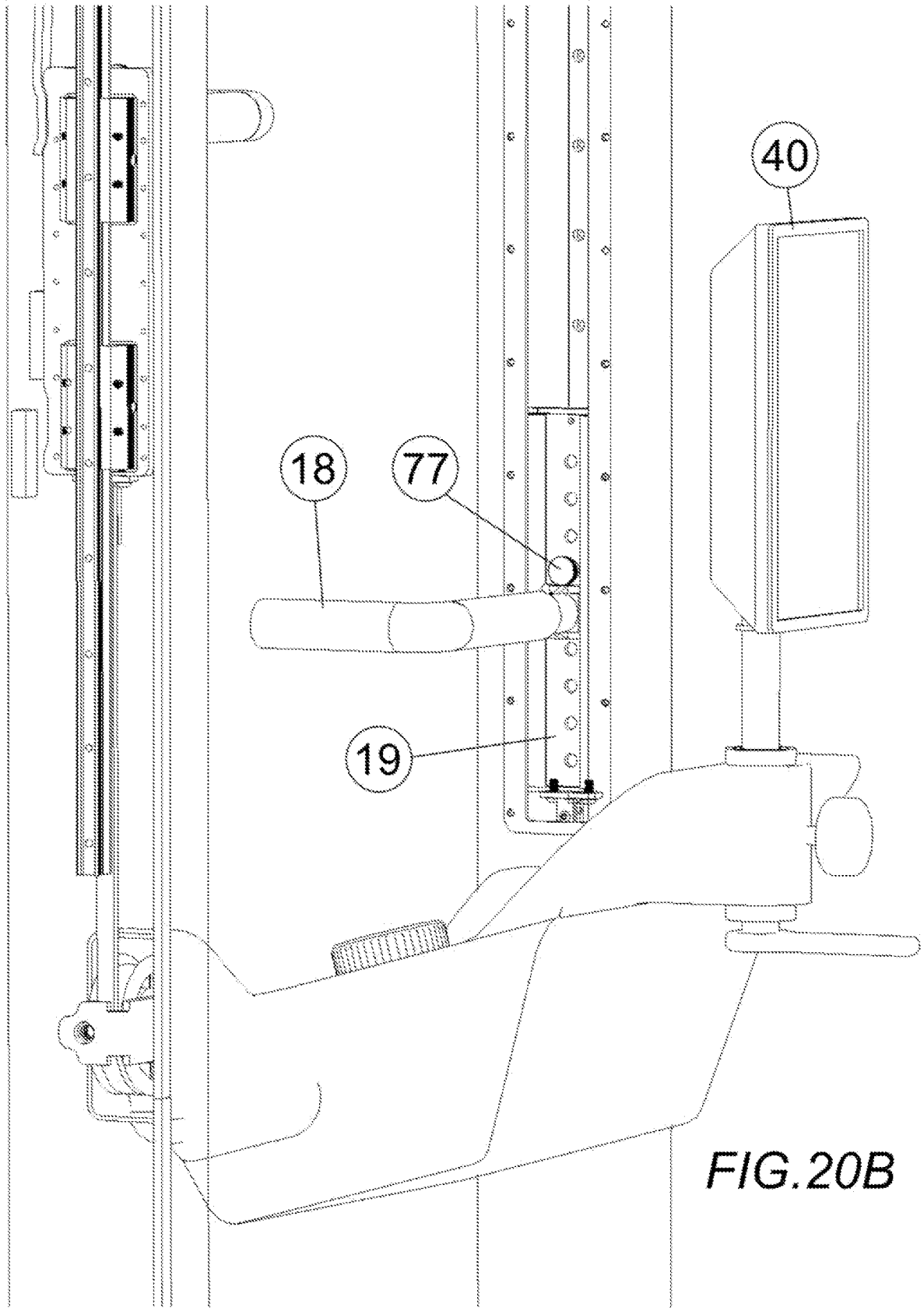
FIG. 20B is a rear perspective center section view of a climbing exercise machine with a computer tablet facing rearward, according to embodiments of the present invention.
Figure 21:
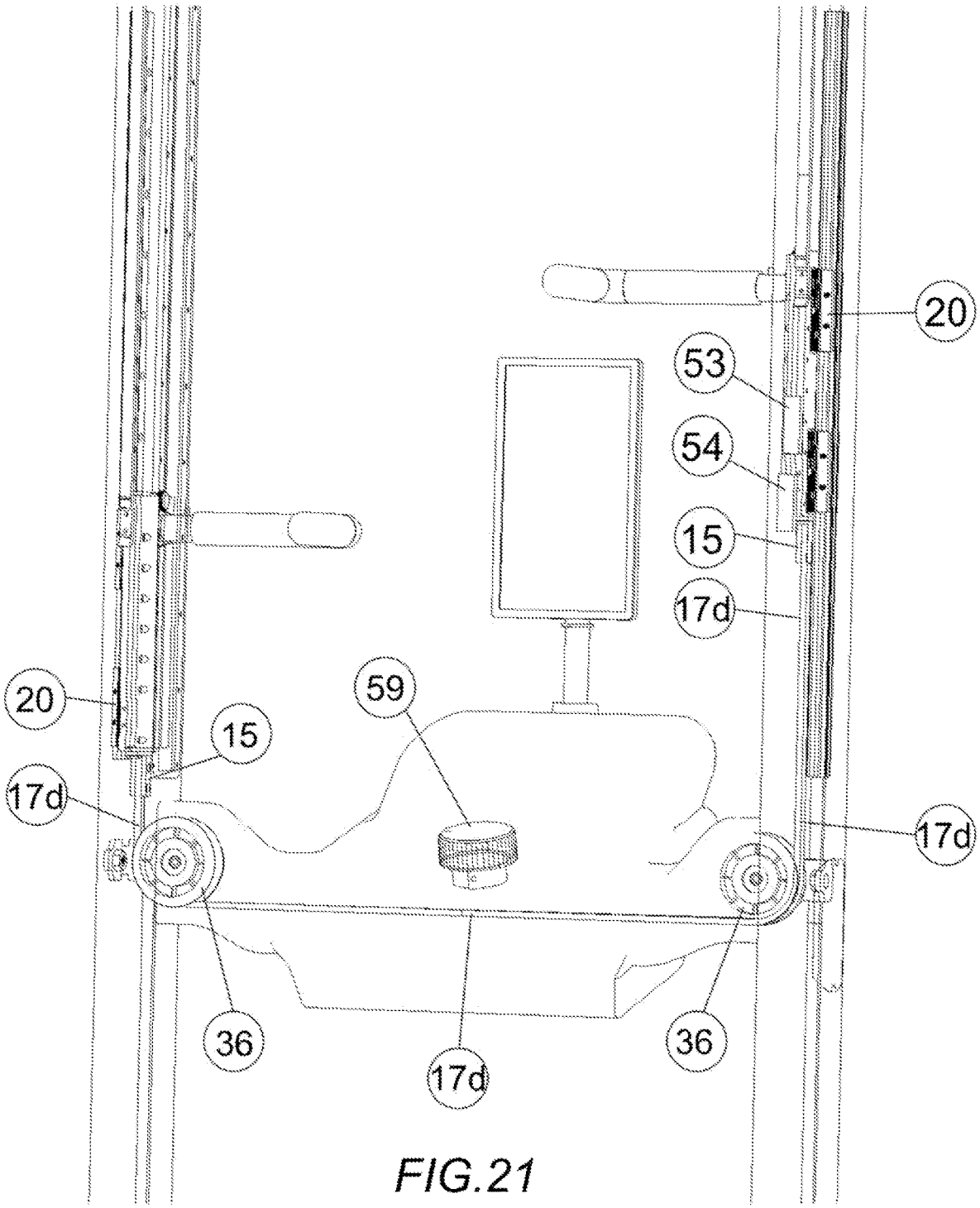
FIG. 21 is a front perspective center section view of a climbing exercise machine, according to embodiments of the present invention.

A tablet computer 40 is mounted on the crossbar 12, in a location easily accessible by a user U, such that the user U can operate the tablet computer 40 while operating the machine 1. Tablet computer 40 includes a viewing screen that allows a user U to perceive digital content while operating the machine 1. Tablet computer 40 can also collect and display data pertaining to the user U's performance while operating the machine 1. At least a portion of the performance data corresponding to user U's use of the machine 1 can be captured by sensors located on various components of the machine 1, such as one or more movable electronic sensors 53 and/or one or more stationary electronic sensors 54. As best illustrated in FIGS. 20A and 20B, a movable electronic sensor 53 is mounted on a forward section of a handle adjustment plate 19 and a stationary electronic sensor 54 is mounted on an adjacent section of an upright 11, such that when handle adjustment plate 19 moves in a reciprocating linear pattern along upright 11, the movable electronic sensor 53 passes in close proximity to stationary electronic sensor 54, and either or both of the movable electronic sensor 53 and the stationary electronic sensor 54 collects data and transfers these data to tablet computer 40. Tablet computer 40 can also collect and display data from the resistance motor 47 and other electronic devices and components that interact with machine 1. Although FIGS. 20A and 20B depict a single movable electronic sensor 53 and a single stationary electronic sensor 54, it is to be expressly understood that the climbing exercise machine 1 may include any number of movable electronic sensors 53 and/or stationary electronic sensors 54, within the scope of the present invention.

Tablet computer 40 is connected to the crossbar 12 via a mounting bracket 42 and is supported by an adjustable arm 39. The adjustable arm 39 can telescope within the mounting bracket 42 to adjust the height of the tablet computer 40, and can rotate within the mounting bracket 42 to adjust the angle of the tablet computer 40 in a horizontal plane relative to the user U. An adjustable arm movement lever 58 can be used to manipulate the position of the adjustable arm 39 and the tablet computer 40. Tablet computer 40 is connected to the adjustable arm 39 via a tablet pivot rod 56, such that the tablet computer 40 can be adjusted to various vertical angles. Tablet computer 40 can also be rotated up to 180 degrees in a horizontal plane, as illustrated in FIGS. 20A and 20B, to face in a rearward direction, such that a user U can perceive digital content from the tablet computer 40 while being behind the machine 1; this feature may be useful for user U to interact with the tablet computer 40 while not operating the machine 1 but performing other exercises.

Figure 22:
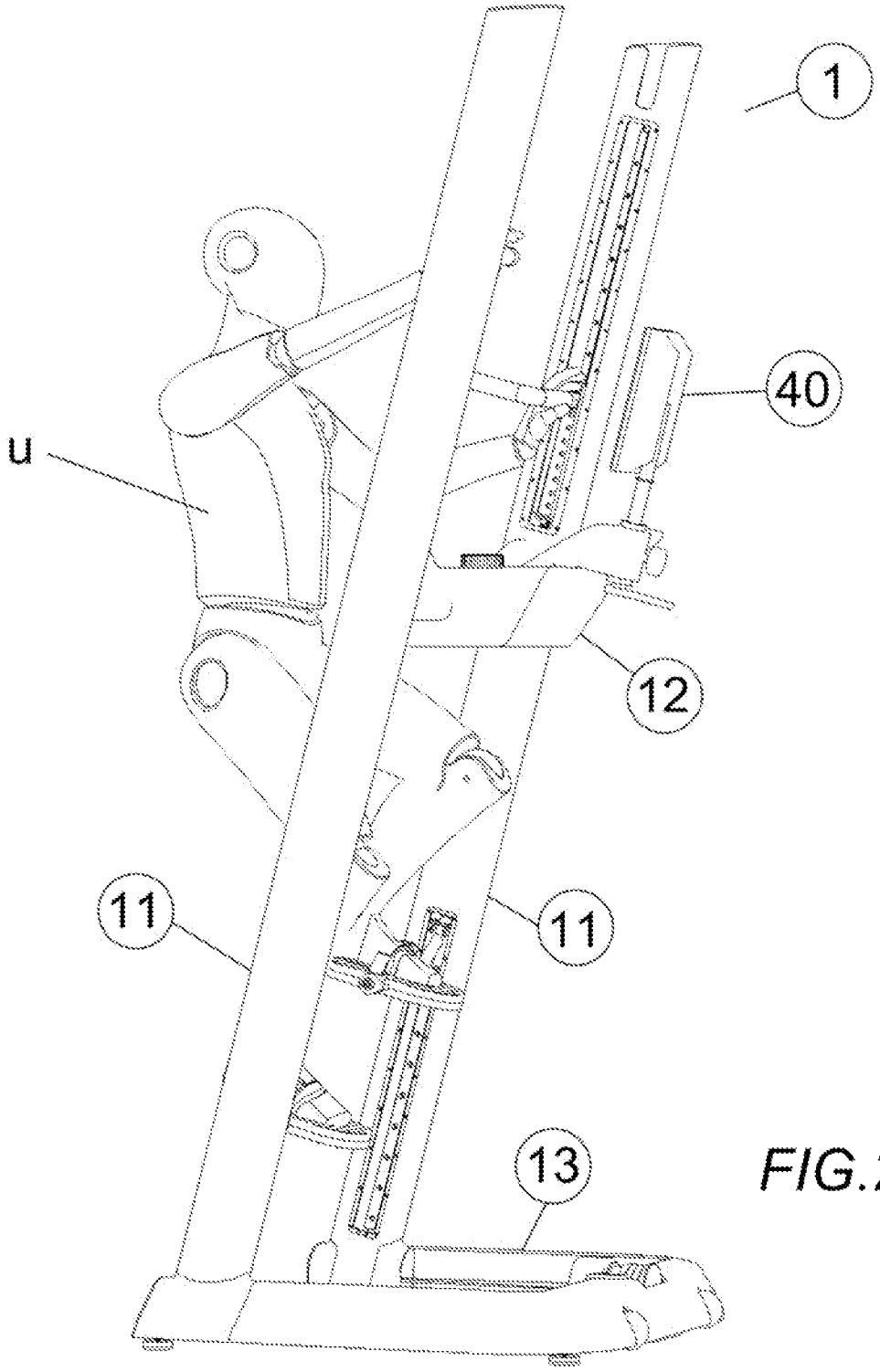
FIG. 22 is a rear perspective view of a user operating a climbing exercise machine, according to embodiments of the present invention.
Figure 23:
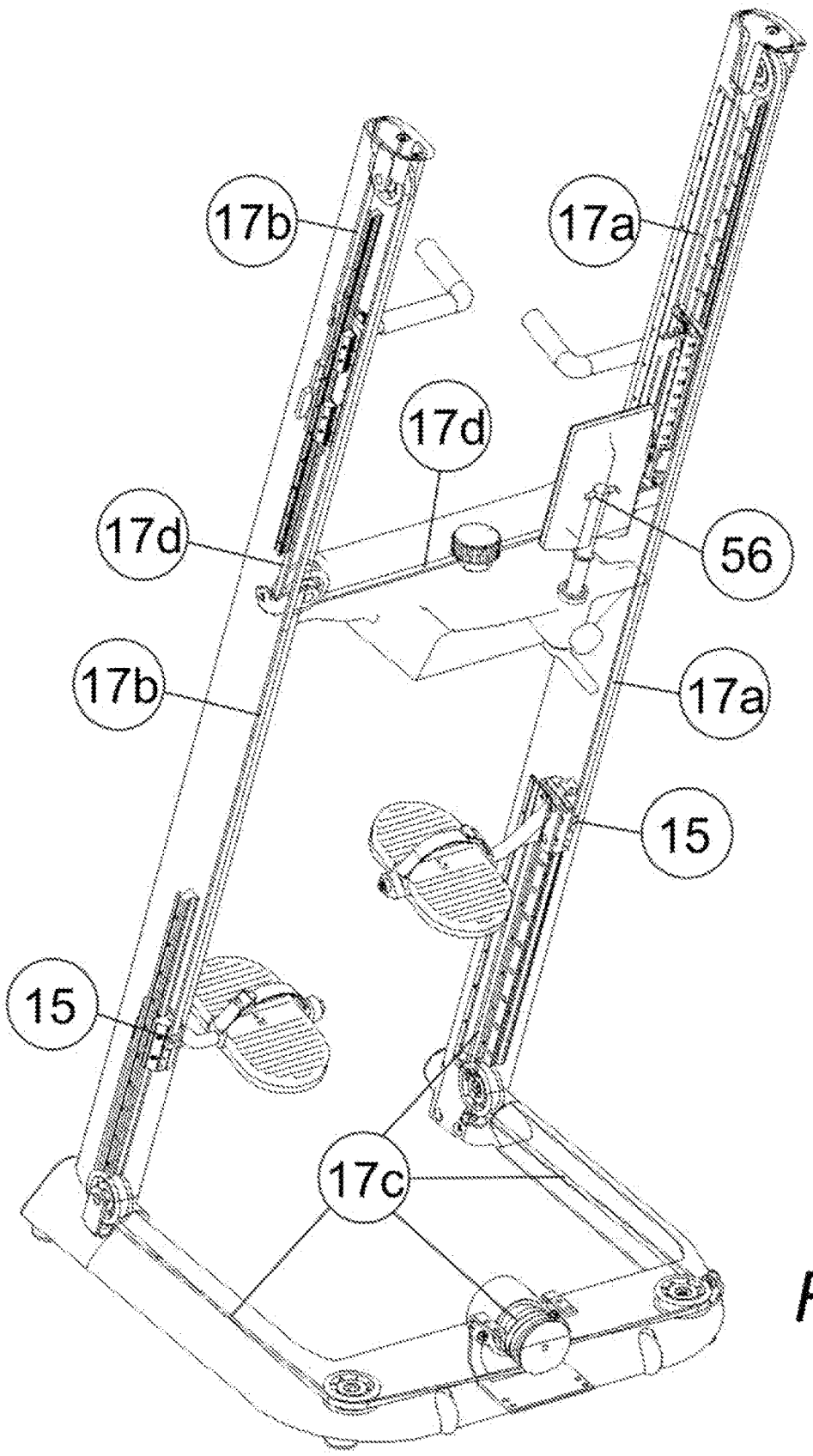
FIG. 23 is an elevated rear perspective view of a climbing exercise machine, according to embodiments of the present invention.

As illustrated in FIG. 22, to operate the machine 1 of the illustrated embodiment of the invention, a user U may enter or mount the machine by stepping onto left foot pedal 21*a* with their left foot, stepping onto right foot pedal 21*b* with their right foot, grasping left handle 18*a* with their left hand, and grasping right handle 18*b* with their right hand. If the left foot pedal 21*a* and the left handle 18*a* are relatively proximate to each other, as illustrated in FIG. 22, then the right foot pedal 21*b* and the right handle 18*b* are relatively distant from each other, and vice versa. To begin exercising, user U may push downward with their left foot and push upward with their left hand, causing left foot pedal 21*a* to move downward and left handle 18*b* to move upward, and concurrently pull their right foot upward and pull their right hand downward, causing right foot pedal 21*b* to move upward and right handle 18*b* to move downward. This motion concurrently activates and moves the interconnected belts 17*a,b,c,d* and the resistance motor 47. The reverse motion of the user's feet and hands would cause a reverse motion of the handles 18*a,b* and foot pedals 21*a,b* and the interconnected belts 17*a,b,c,d* and the resistance motor 47. The user U can perform any desired number of repetitions, adjust the resistance to the exercise motion as previously described herein, and control the distance of movement of left foot pedal 21*a*, left handle 18*a*, right foot pedal 21*b*, and right handle 18*b* for each repetition.

Figure 24:
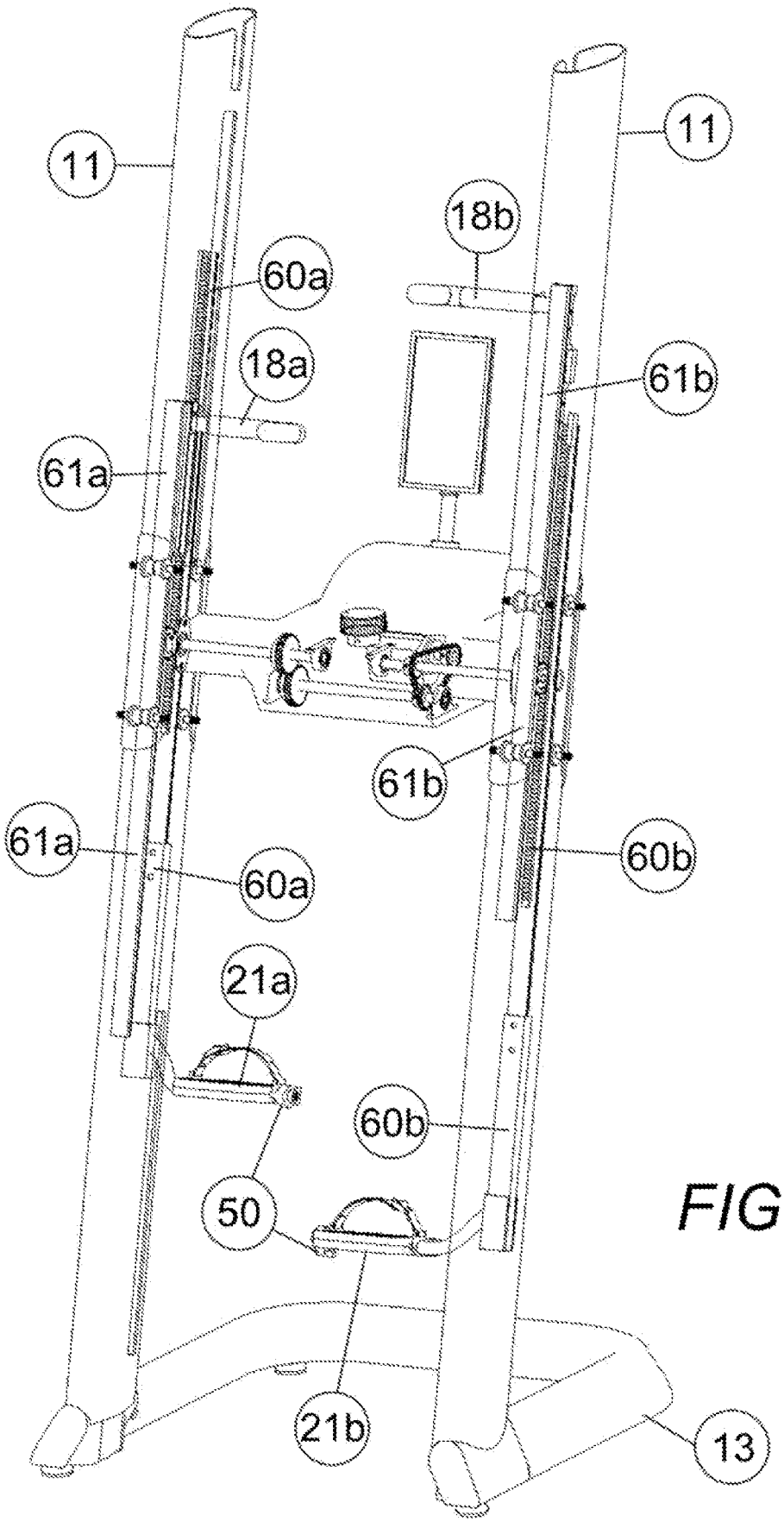
FIG. 24 is a front perspective view of a climbing exercise machine, according to embodiments of the present invention.
Figure 25:
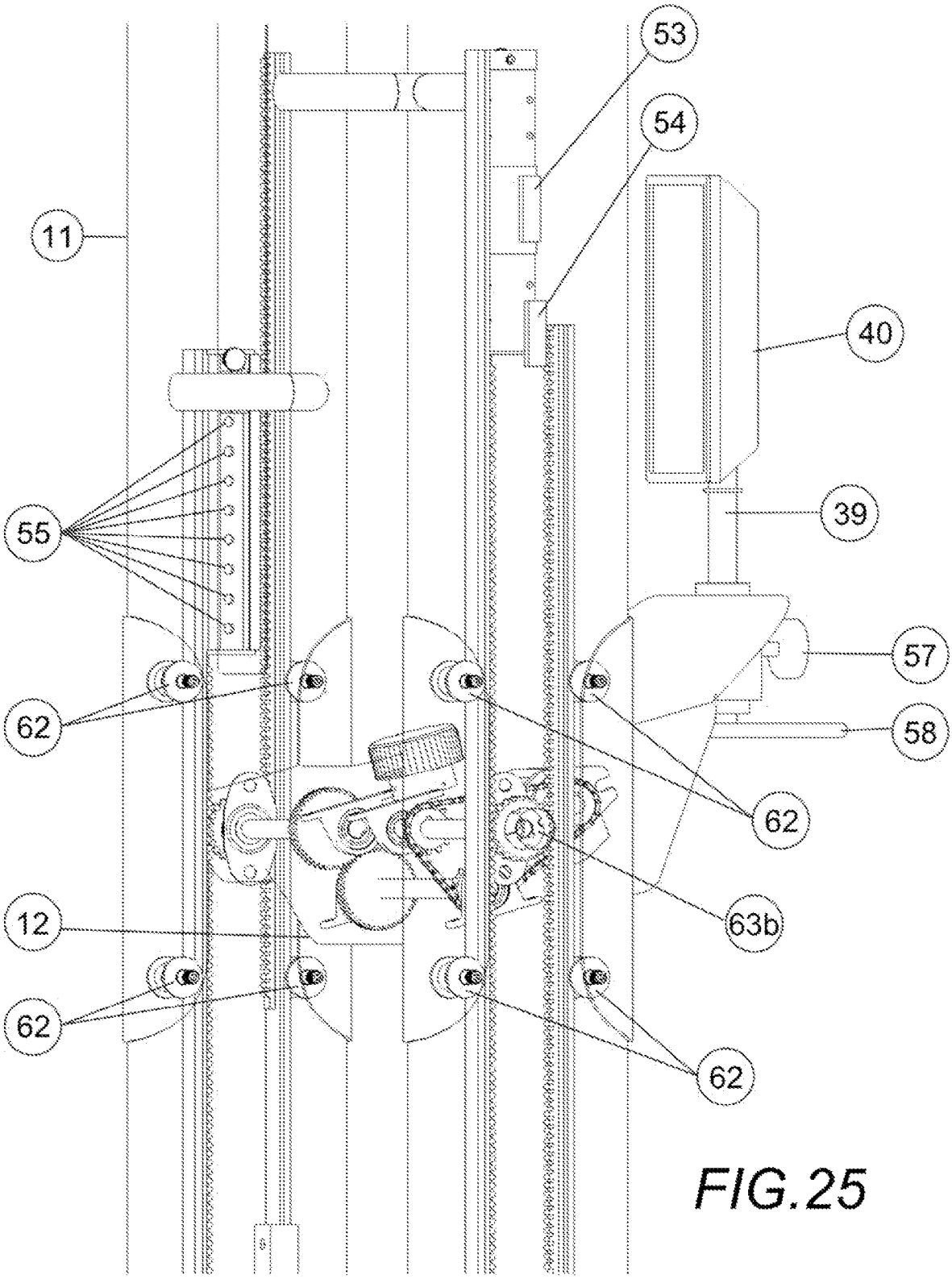
FIG. 25 is a center section side perspective view of a climbing exercise machine, according to embodiments of the present invention.
Figure 26:
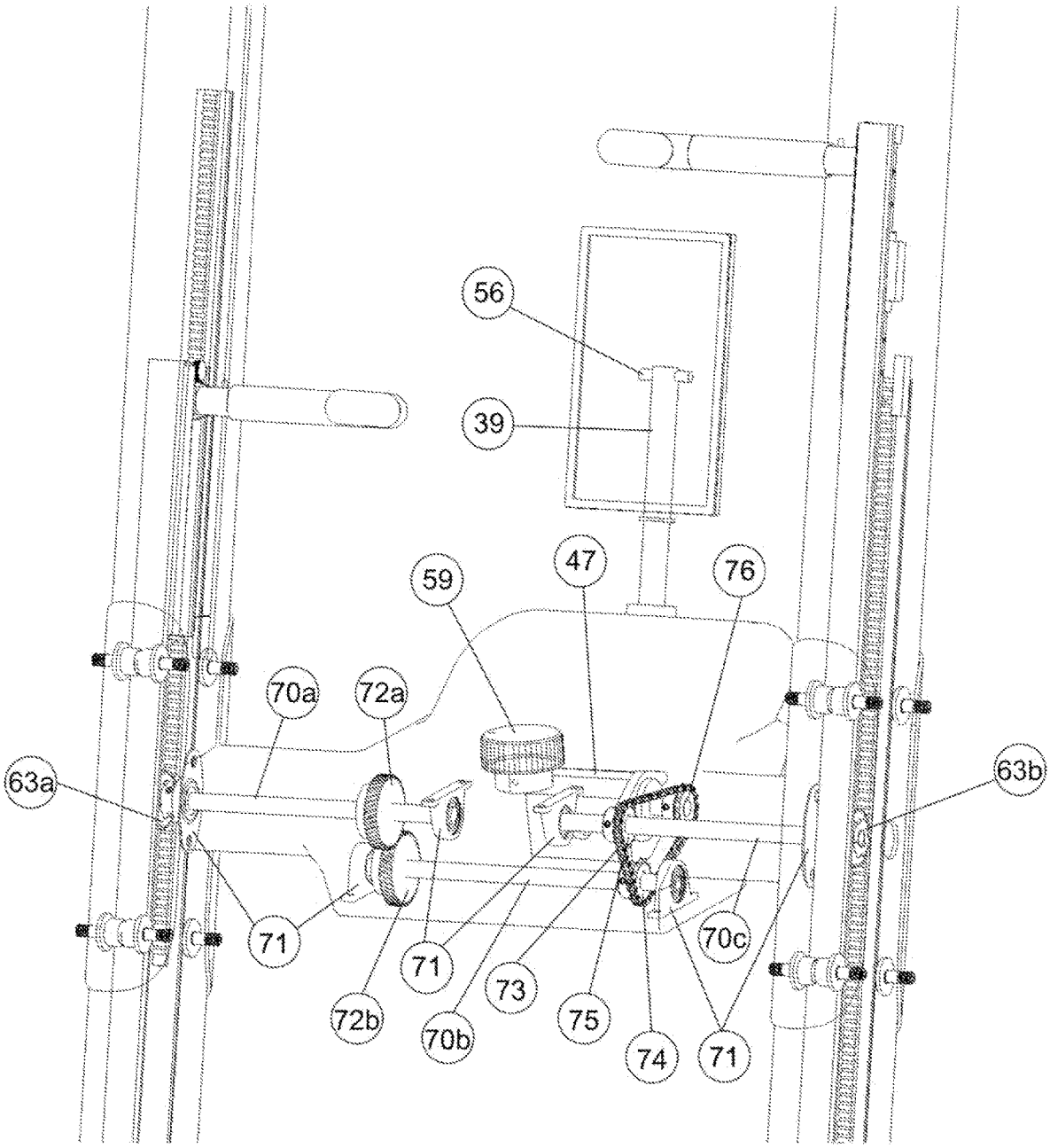
FIG. 26 is a center section side perspective view of a climbing exercise machine, according to embodiments of the present invention.
Figure 27:
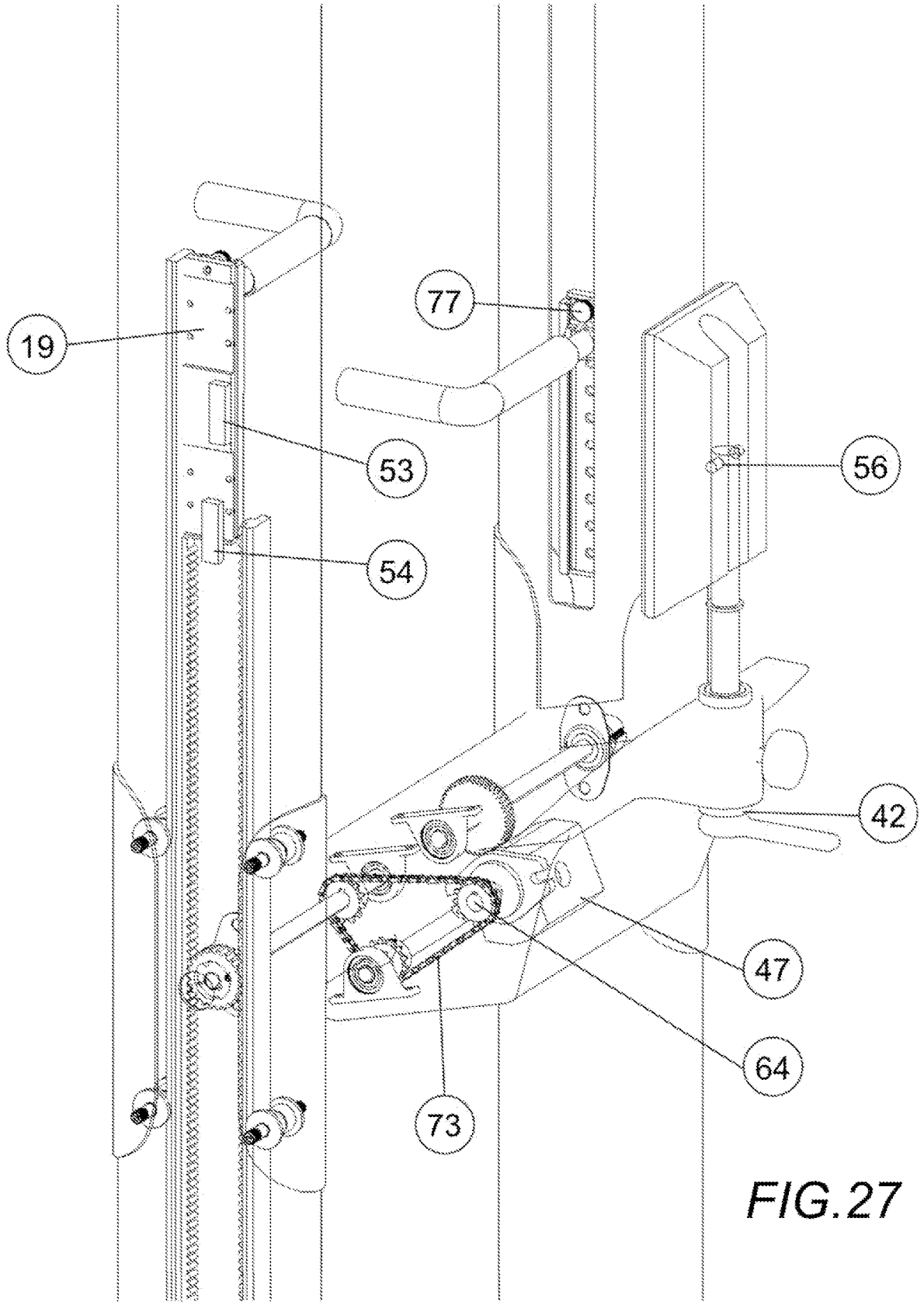
FIG. 27 is a center section rear perspective view of a climbing exercise machine, according to embodiments of the present invention.

FIGS. 24-28 illustrate a climbing exercise machine 1, according to an embodiment of the invention, comprising two uprights 11, wherein the linkage assembly that interconnects the handles 18, foot pedals 21, and resistance mechanism of the machine comprises multiple gear racks and drive gears and at least one flexible component guided by pulleys (hereinafter a "multiple gear linkage assembly"). More specifically, FIGS. 25-27 illustrate a closeup view of this linkage assembly, wherein handles 18 and foot pedals 21 are rigidly connected to elongated gear racks. These gear racks, together with multiple rotating drive gears, multiple axles, multiple sprockets or pulleys, and a flexible member such as a belt or chain, are interconnected to create the motion of the machine 1 and to drive the resistance motor 47 that provides the resistance to the exercise motion of the machine 1.

Figure 28:
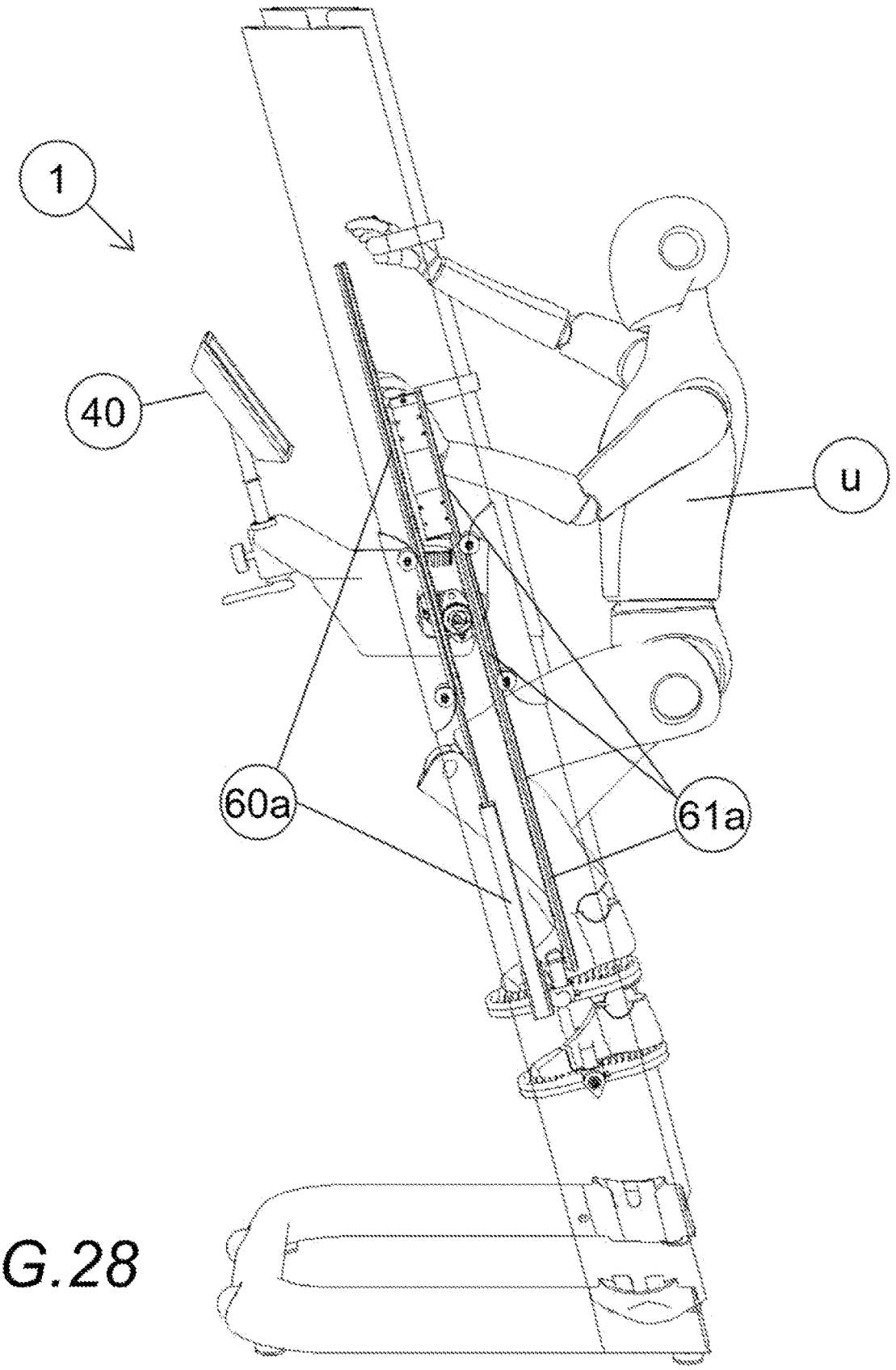
FIG. 28 is a side view of a user operating a climbing exercise machine, according to embodiments of the present invention.
Figure 29:
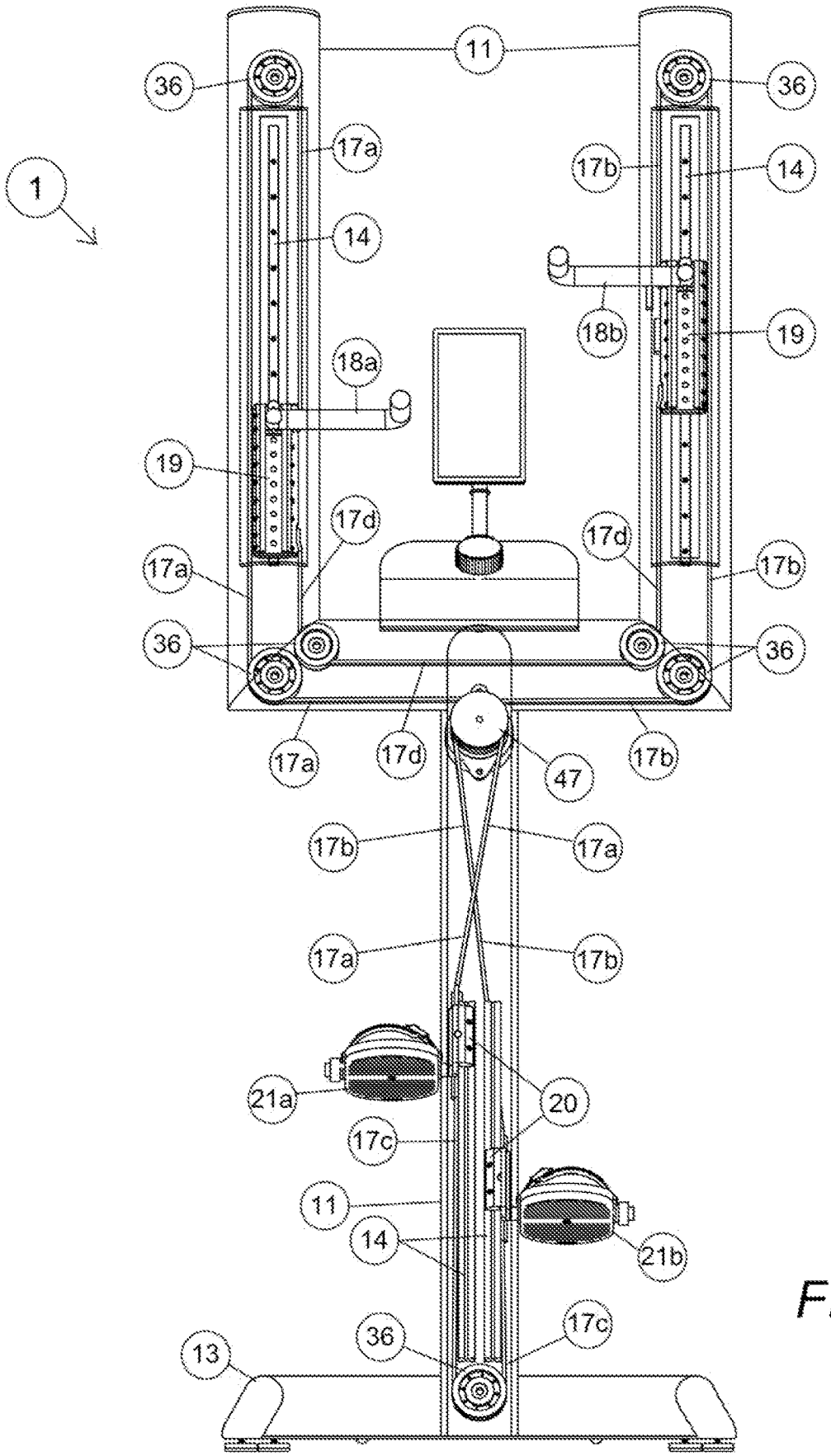
FIG. 29 is a front view of a climbing exercise machine, according to embodiments of the present invention.
Figure 30:
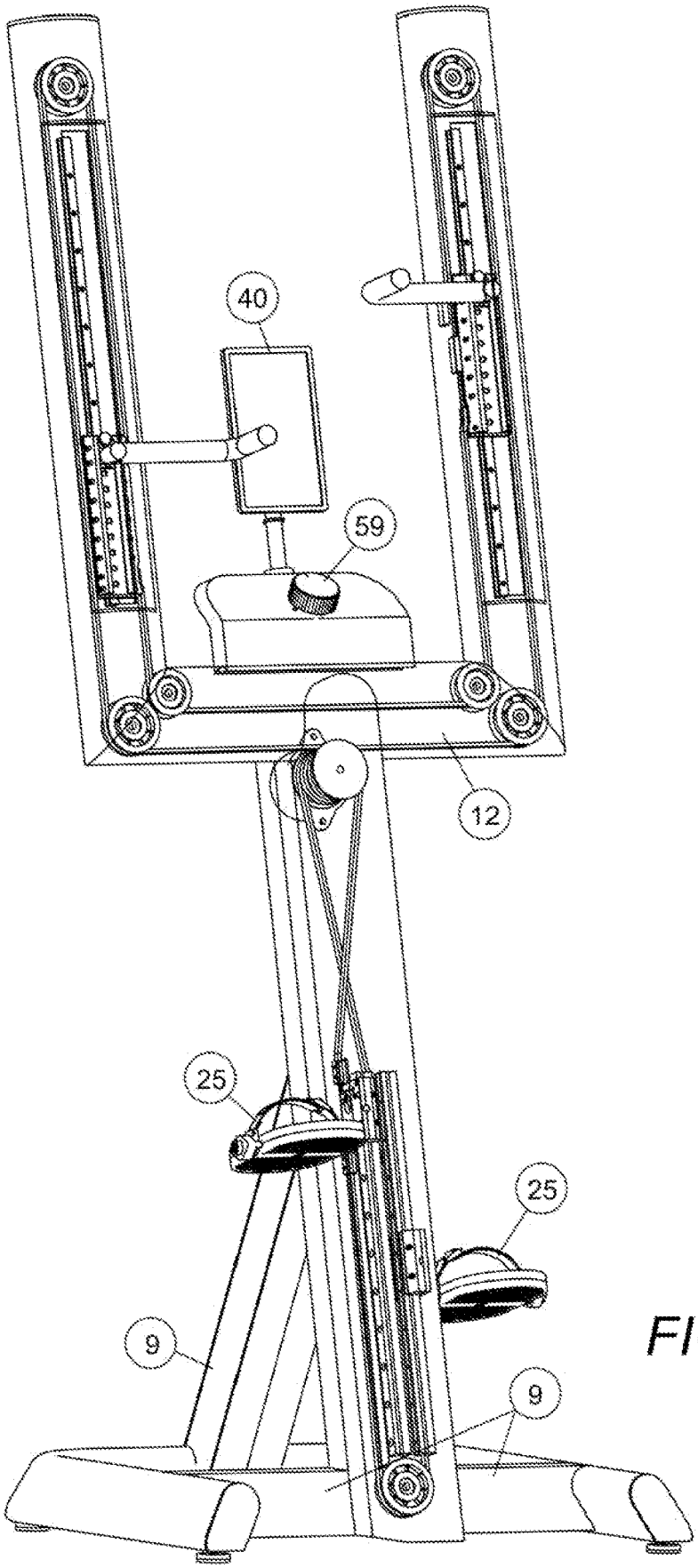
FIG. 30 is a front perspective view of a climbing exercise machine, according to embodiments of the present invention.

FIGS. 24 and 28 illustrate views of the climbing exercise machine 1 of an embodiment of the invention utilizing a multiple gear linkage assembly, wherein left and right uprights 11 and the base 13 are constructed and interconnected substantially as described with respect to the embodiment illustrated in FIGS. 15-23. Each upright 11 houses multiple guide components that guide the linear reciprocating motion of a set of interconnected gear racks. As illustrated, these guide components are represented as gear rack guide wheels 62, but it is to be expressly understood that various components, such as linear bearings, linear bushings, cam followers, and other linear guide components, could be utilized to guide the gear racks with identical or nearly identical function, and such variations are within the scope of the invention. Within left upright 11, an upper end of a left handle gear rack 61*a* is rigidly connected to a handle adjustment plate 19 that in turn is operatively connected to a left handle 18*a*; a lower end of left foot pedal gear rack 60*a* is rigidly connected to a foot pedal support axle 78 that in turn is operatively connected to a left foot pedal 21*a*; and left handle gear rack 61*a* and left pedal gear rack 60*a* are operatively engaged with and interconnected by a left gear rack drive gear 63*a*. Within right upright 11, an upper end of a right handle gear rack 61*b* is rigidly connected to a handle adjustment plate 19 that in turn is operatively connected to a right handle 18*b*; a lower end of right foot pedal gear rack 60*b* is rigidly connected to a foot pedal support axle 78 that in turn is operatively connected to a right foot pedal 21*b*; and right handle gear rack 61*b* and right foot pedal gear rack 60*b* are operatively engaged with and interconnected by a right gear rack drive gear 63*b*. The crossbar 12 connects left upright 11 to right upright 11, substantially as described with respect to the embodiment illustrated in FIGS. 15-23.

FIGS. 24-28 illustrate various views of a left handle 18*a* and a right handle 18*b* of embodiments of the invention. Each handle 18 is adjustably mounted on a handle adjustment plate 19. FIGS. 25 and 27 illustrate closeup views of a handle adjustment plate 19 and a handle 18, wherein the handle 18 is rigidly connected to a handle adjustment latching pin 77 and the handle adjustment plate 19 is configured with multiple handle adjustment latching pin receivers 55. To optimize operation of the climbing exercise machine 1 for each individual user U, the location of the handle 18 on the handle adjustment plate 19 can be adjusted prior to operating the machine 1 by disengaging the adjustment latching pin 77 from a first handle adjustment latching pin receiver 55, moving handle 18 to another location on the handle adjustment plate 19, and engaging the handle adjustment latching pin 77 with a second adjustment latching pin receiver 55. The handle adjustment mechanism illustrated in FIGS. 25 and 27 may thus function in the same way as the handle adjustment mechanism previously described herein and illustrated in FIGS. 20A and 20B.

FIGS. 24 and 28 illustrate various views of a left foot pedal 21*a* and a right foot pedal 21*b* of embodiments of the invention. Each foot pedal 21 is operatively mounted on a foot pedal support axle 78. This operative mounting generally functions in the same way as the foot pedal mounting mechanism previously described herein and illustrated in FIGS. 19A and 19B.

As illustrated in FIGS. 24-28, the left handle gear rack 61*a* and the left foot pedal gear rack 60*a* are located in opposing parallel positions within left upright 11 and are operatively engaged with opposing sides of the left gear rack drive gear 63*a* such that the teeth of the left handle gear rack 61*a* are engaged with the teeth of the left gear rack drive gear 63*a* relatively proximate to the forward side of left upright 11 and the teeth of the left foot pedal gear rack 61*a* are engaged with the teeth of the left gear rack drive gear 63*a* relatively proximate to the rearward side of left upright 11. This operative engagement of the left handle gear rack 61*a* and the left foot pedal gear rack 60*a* with the left gear rack drive gear 63*a* synchronizes the linear motion of the left handle gear rack 61*a* with the linear motion of the left foot pedal gear rack 60*a* and causes the left handle gear rack 61*a* to always move in the opposite direction of the motion of the left foot pedal gear rack 60*a* during operation of the machine 1. Multiple gear rack guide wheels 62 guide the linear motion of the left handle gear rack 61*a* and the left foot pedal gear rack 60*a* and keep the left handle gear rack 61*a* and the left foot pedal gear rack 60*a* in parallel planes of motion during the operation of the machine 1. As also illustrated in FIGS. 24-28, the right handle gear rack 61*b* and the right foot pedal gear rack 60*b* are located in opposing parallel positions within right upright 11 and the right handle gear rack 61*b* and the right foot pedal gear rack 60*b* are operatively engaged with opposing sides of the right gear rack drive gear 63*b*. The operative engagement of the right foot pedal gear rack 60*b*, the right handle gear rack 61*b*, and the right gear rack drive gear 63*b* is identical, mutatis mutandis, to the operative engagement of the left foot pedal gear rack 60*a*, the left handle gear rack 61*a*, and the left gear rack drive gear 63*a* described above.

FIGS. 24-28 illustrate various views of the crossbar 12 and the various components and features mounted on and within the crossbar 12 of embodiments of the invention. A resistance adjustment dial 59 is mounted on a central portion of the crossbar 12, in a location easily accessible by the user U during operation of the machine 1, and is operatively connected to the resistance motor 47 such that the user U can move and adjust the resistance adjustment dial 59 to a preferred setting to manipulate the amount of resistance to the exercise motion of the machine 1 created by the resistance motor 47.

A tablet computer 40 is mounted on the crossbar 12, in a location easily accessible by a user U, such that the user U can operate the tablet computer 40 while operating the machine 1. Tablet computer 40 includes a viewing screen that allows a user U to perceive digital content while operating the machine 1. Tablet computer 40 can also collect and display data pertaining to the user U's performance while operating the machine 1. At least a portion of the performance data corresponding to user U's use of the machine 1 can be captured by sensors located on various components of the machine 1, such as one or more movable electronic sensors 53 and/or one or more stationary electronic sensors 54. A movable electronic sensor 53 is mounted on a forward section of a handle adjustment plate 19 and a stationary electronic sensor 54 is mounted on an adjacent section of an upright 11, such that when handle adjustment plate 19 moves in a reciprocating linear pattern along upright 11, the movable electronic sensor 53 passes in close proximity to stationary electronic sensor 54, and either or both of the movable electronic sensor 53 and the stationary electronic sensor 54 collects data and transfers these data to tablet computer 40. Tablet computer 40 can also collect and display data from the resistance motor 47 and other electronic devices and components that interact with machine 1. Although FIGS. 24-28 depict a single movable electronic sensor 53 and a single stationary electronic sensor 54, it is to be expressly understood that the climbing exercise machine 1 may include any number of movable electronic sensors 53 and/or stationary electronic sensors 54, within the scope of the present invention.

Tablet computer 40 is connected to the crossbar 12 via a mounting bracket 42 and is supported by an adjustable arm 39. The adjustable arm 39 can telescope within the mounting bracket 42 to adjust the height of the tablet computer 40, and can rotate within the mounting bracket 42 to adjust the angle of the tablet computer 40 in a horizontal plane relative to the user U. An adjustable arm movement lever 58 can be used to manipulate the position of the adjustable arm 39 and the tablet computer 40. Tablet computer 40 is connected to the adjustable arm 39 via a tablet pivot rod 56, such that the tablet computer 40 can be adjusted to various vertical angles. Tablet computer 40 can also be rotated up to 180 degrees in a horizontal plane to face in a rearward direction, such that a user U can perceive digital content from the tablet computer 40 while being behind the machine 1; this feature may be useful for user U to interact with the tablet computer 40 while not operating the machine 1 but performing other exercises.

FIG. 26 best illustrates the mechanical features of the multiple gear linkage assembly that are located within crossbar 12, wherein a first drive axle 70*a* is located on the left side of the crossbar 12 and is supported on opposing ends by two drive axle mounting bearings 71 that are rigidly connected to the crossbar 12; a second drive axle 70*b* is located in a central section of the crossbar 12 and supported on opposing ends by two drive axle mounting bearings 71 that are rigidly connected to crossbar 12; and a third drive axle 70*c* is located on the right side of the crossbar 12 and supported on opposing ends by two drive axle mounting bearings 71 rigidly connected to the crossbar 12. The drive axles 70*a,b,c* are in alignment such that the second drive axle 70*b* is below the first drive axle 70*a* and a right end portion of the first drive axle 70*a* and a left end portion of second drive axle 70*b* overlap, and such that the third drive axle is located above the second drive axle 70*b* and a left end portion of the third drive axle 70*c* and a right end portion of the second drive axle 70*b* overlap. The resistance motor 47 is rigidly mounted in a central rearward section of crossbar 12.

The left end of the first drive axle 70*a* extends through a drive axle mounting bearing 71 and is rigidly connected to the left gear rack drive gear 63*a*. A first axle drive gear 72*a* is rigidly connected to a right-side section of the first drive axle 70*a*, and a second drive axle drive gear 72*b* is rigidly connected to a left-side section of second drive axle 70*b*; the first drive axle drive gear 72*a* and the second drive axle drive gear 72*b* are in aligned contact and operatively engaged with each other. A second drive axle drive chain sprocket 74 is rigidly connected to a right-side section of the second drive axle 70*b*, and a third drive axle drive chain sprocket 75 is rigidly connected to a left-side section of the third drive axle 70*c*. A resistance motor drive chain sprocket 76 is rigidly connected to the right end of the resistance motor axle 64, and the resistance motor drive chain sprocket 76, third drive axle drive chain sprocket 75, and second drive axle drive chain sprocket 74 are in alignment and operatively connected by a drive chain 73.

When a user U operates a climbing exercise machine 1 incorporating a multiple gear linkage assembly as illustrated in FIG. 26 by urging handles 18 and foot pedals 21 into reciprocating linear motion, the entire linkage assembly and the resistance motor 47 concurrently move such that the left handle gear rack 61*a* and the left foot pedal gear rack 60*a* move against opposite sides of the left gear rack drive gear 63*a* and cause the left gear rack drive gear 63*a* to rotate, and the right handle gear rack 61*b* and the right foot pedal gear rack 60*b* move against opposite sides of the right gear rack drive gear 63*b* and cause the right gear rack drive gear 63*b* to rotate. The rotation of the left gear rack drive gear 63*a* rotates the first drive axle 70*a* and the first drive axle gear 72*a*, and the rotation of the right gear rack drive gear 63*b* rotates the third drive axle 70*c* and the third drive axle drive chain sprocket 73. The rotation of the first drive axle drive gear 72*a* rotates the second drive axle drive gear 72*b*, the second drive axle 70*b*, and the second drive axle drive chain sprocket 74. The drive chain 73 is looped about the second drive axle drive chain sprocket 74, the third drive axle drive chain sprocket 75, and the resistance motor drive chain sprocket 76 to form a closed-loop connection of the second drive axle drive chain sprocket 74, the third drive axle drive chain sprocket 75, and the resistance motor drive chain sprocket 76 such that the rotation of the second drive axle drive chain sprocket 74 and the third drive axle drive chain sprocket 75 causes movement of the drive chain 73 and rotation of the resistance motor drive chain sprocket 76 and the resistance motor axle 64, which in turn activates the resistance motor 47 during operation of the machine 1.

As a result of the interconnection of the handles 18 and foot pedals 21 created by the multiple gear linkage assembly illustrated in FIG. 26, a concurrent pattern of reciprocating motion of the handles 18 and foot pedals 21 is created, such that (1) when left handle 18*a* moves upward, left foot pedal 21*a* moves downward (and vice versa); (2) when right handle 18*b* moves upward, right foot pedal 21*b* moves downward (and vice versa); (3) when left handle 18*a* moves upward, right handle 18*b* moves downward (and vice versa); and (4) when left foot pedal 21*a* moves upward, right foot pedal 21*b* moves downward (and vice versa).

As illustrated in FIG. 28, to operate the machine 1 of the illustrated embodiment of the invention, a user U may enter or mount the machine by stepping onto left foot pedal 21*a* with their left foot, stepping onto right foot pedal 21*b* with their right foot, grasping left handle 18*a* with their left hand, and grasping right handle 18*b* with their right hand. If the left foot pedal 21*a* and the left handle 18*a* are relatively proximate to each other, as illustrated in FIG. 28, then the right foot pedal 21*b* and the right handle 18*b* are relatively distant from each other, and vice versa. To begin exercising, user U may push downward with their left foot and push upward with their left hand, causing left foot pedal 21*a* to move downward and left handle 18*b* to move upward, and concurrently pull their right foot upward and pull their right hand downward, causing right foot pedal 21*b* to move upward and right handle 18*b* to move downward. This motion concurrently activates and moves the interconnected left and right gear racks 60*a,b*, 61*a,b*, drive axles 70*a,b,c*, and resistance motor 47. The reverse motion of the user's feet and hands would cause a reverse motion of the handles 18*a,b* and foot pedals 21*a,b* and the interconnected left and right gear racks 60*a,b*, 61*a,b*, drive axles 70*a,b,c*, and resistance motor 47. The user U can perform any desired number of repetitions, adjust the resistance to the exercise motion as previously described herein, and control the distance of movement of left foot pedal 21*a*, left handle 18*a*, right foot pedal 21*b*, and right handle 18*b* for each repetition.

FIGS. 29-36 illustrate an embodiment of the invention comprising three uprights and a multiple flexible component assembly. The resistance motor 47 is also rotated by two of the multiple flexible components in a "capstan" configuration; more specifically, as illustrated in isolated closeup view in FIG. 35, central portions of belts 17*a* and 17*b* are wrapped multiple times, in opposite directions, about the surface of the resistance motor axle pulley 65. The resistance motor axle pulley 65 is rigidly attached to the resistance motor axle 64 such that the concurrent reciprocating motion of belts 17*a* and 17*b* on the resistance motor axle pulley 65 rotates the resistance motor axle 64 to activate the resistance motor 47 during operation of the machine 1.

FIGS. 29, 30, 33, and 36 illustrate views of the climbing exercise machine 1 of an embodiment of the invention utilizing the multiple flexible component assembly, wherein the lower end of a mostly vertical lower upright 11 is rigidly attached to a central portion of a base 13 at an obtuse angle; while the figures illustrate the base 13 as being U- or horseshoe-shaped, it is to be expressly understood that the base 13 can be configured in any of various shapes capable of supporting uprights 11, a user U, and the other components of the machine 1, and such variations are within the scope of the invention. The upper end of the lower upright 11 is rigidly connected to a central section of the crossbar 12. The left end of the crossbar 12 is rigidly connected to the lower end of an upper left upright 11, and the lower upright 11 and upper left upright 11 are in parallel planes on opposite sides of the cross bar 12. The right end of the crossbar 12 is rigidly connected to the lower end of an upper right upright 11, and the lower upright 11 and upper right upright 11 are in parallel planes on opposite sides of the crossbar 12. The uprights 11, the crossbar 12, and the base 13 are constructed of a rigid material capable of supporting the components and functions of the machine 1 and the user U; any of various metals, steels, and alloys may be commonly employed, but other materials are contemplated and are within the scope of the invention. Left and right upper uprights 11 each house a stationary rail 14, and lower upright 11 houses two back-to-back stationary left and right rails 14; each rail 14 supports at least one slide 20 such that each slide 20 can slide on a rail 14 to create a linear reciprocating motion along uprights 11. Slides 20 can be constructed with various components, such as wheels, linear motion bearings, or other linear motion components, for engaging with and moving on rails 14. Upper left linear slide 20 is rigidly connected to a handle adjustment plate 19 that in turn is operatively connected to a left handle 18*a*, and upper right linear slide 20 is rigidly connected to a handle adjustment plate 19 that in turn is operatively connected to a right handle 18*b*. The two back-to-back left and right rails housed within lower upright 11 are mounted in a central location within lower upright 11 such that a left slide 20 is rigidly connected to a foot pedal support axle 78 that in turn is operatively connected to a left foot pedal 21*a* and lower right slide 20 is rigidly connected to a foot pedal support axle 78 that in turn is operatively connected to a right foot pedal 21*b*; the left foot pedal 21*a* and the right foot pedal 21*b* extend laterally outward from the lower upright 11 on opposing sides of the lower upright 11.

Pulleys 36 are mounted within the upper ends of left and right upper uprights 11. Two pulleys 36 are also mounted within lower and upper sections, respectively, of each end of the crossbar 12, with the upper pulley 36 being disposed inward of the first pulley 36. Another pulley 36 is mounted in a central section of the lower end of lower upright 11. A resistance motor 47 comprising a resistance motor axle 64 and a resistance motor axle pulley 65 is mounted partially within the crossbar 12 and partially within the lower upright 11 at the junction of the crossbar 12 and the lower upright 11, such that portions of the resistance motor 47 may extend into the crossbar 12 and the lower upright 11.

Figure 31:
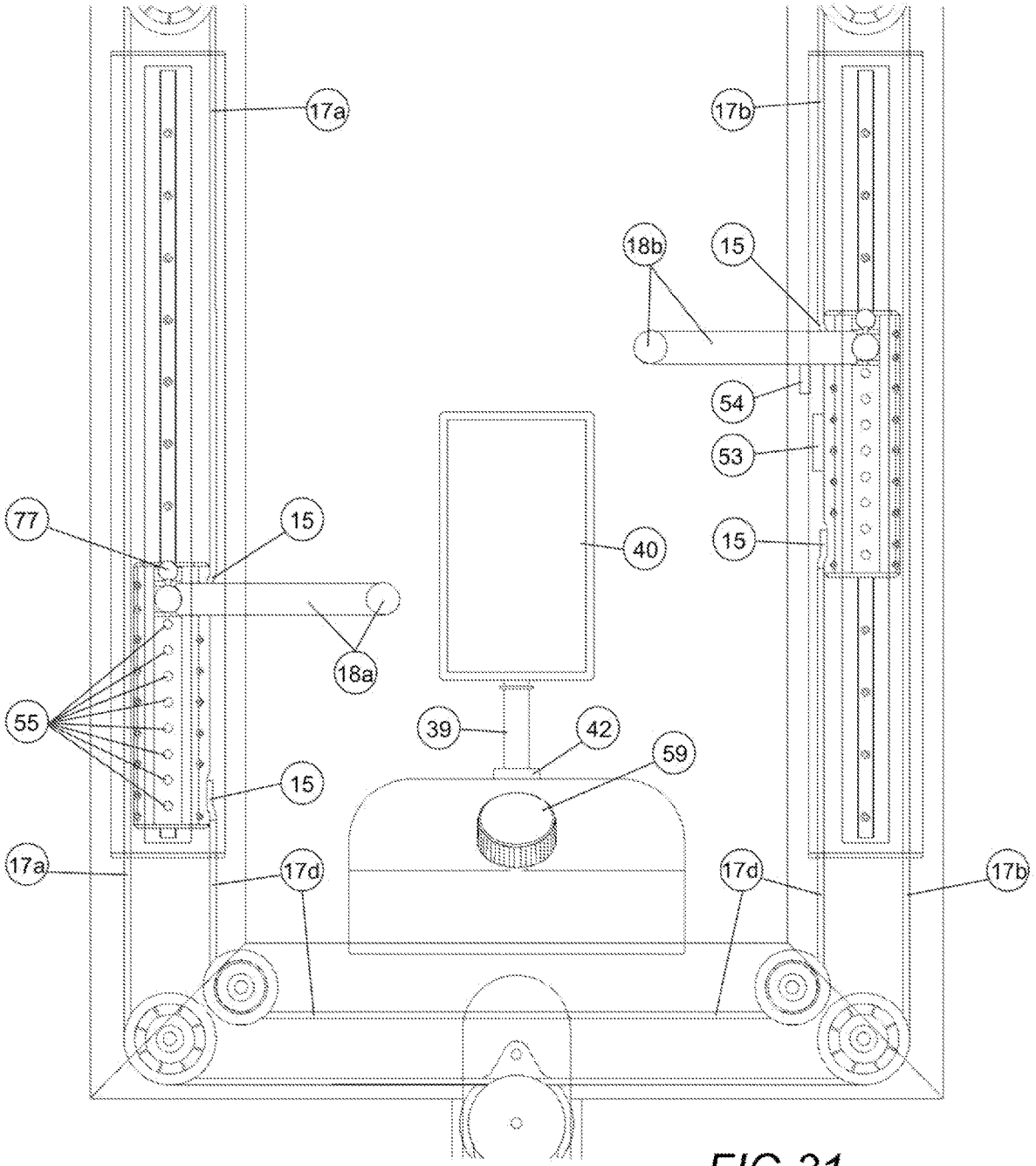
FIG. 31 is a front center section closeup view of a climbing exercise machine, according to embodiments of the present invention.

FIGS. 29-33 and 36 illustrate various views of the left handle 18*a* and the right handle 18*b* of embodiments of the invention. Each handle 18 is adjustably mounted on a handle adjustment plate 19. FIG. 31 illustrates a closeup view of a handle adjustment plate 19 and a handle 18, wherein the handle 18 is rigidly connected to a handle adjustment latching pin 77 and the handle adjustment plate 19 is configured with multiple handle adjustment latching pin receivers 55. To optimize operation of the climbing exercise machine 1 for each individual user U, the location of the handle 18 on the handle adjustment plate 19 can be adjusted prior to operating the machine 1 by disengaging the adjustment latching pin 77 from a first handle adjustment latching pin receiver 55, moving handle 18 to another location on the handle adjustment plate 19, and engaging the handle adjustment latching pin 77 with a second adjustment latching pin receiver 55. The handle adjustment mechanism illustrated in FIG. 31 may thus function in the same way as the handle adjustment mechanism previously described herein and illustrated in FIGS. 20A and 20B.

Figure 34:
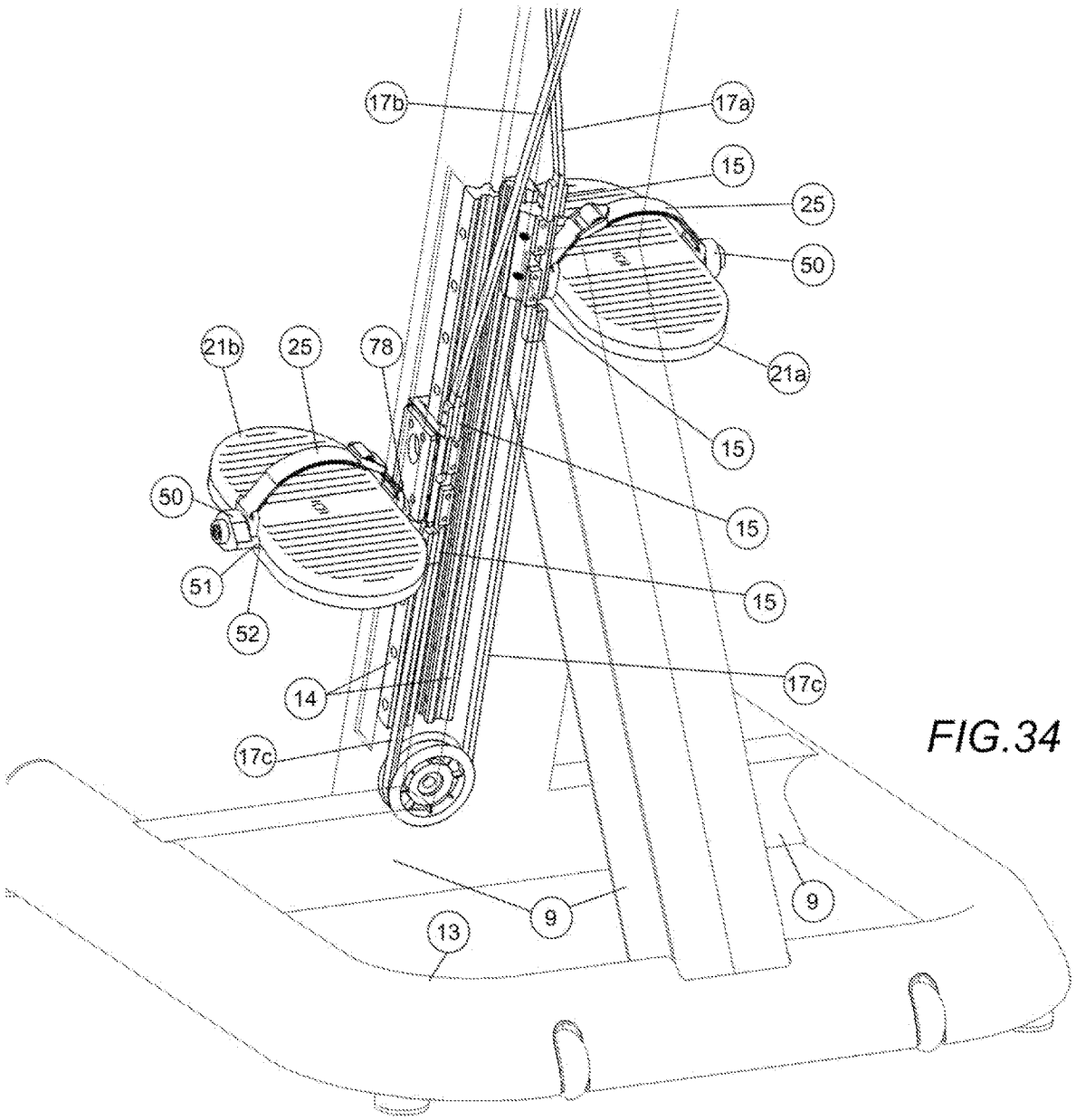
FIG. 34 is a rear closeup view of a lower section of a climbing exercise machine, according to embodiments of the present invention.
Figure 35:
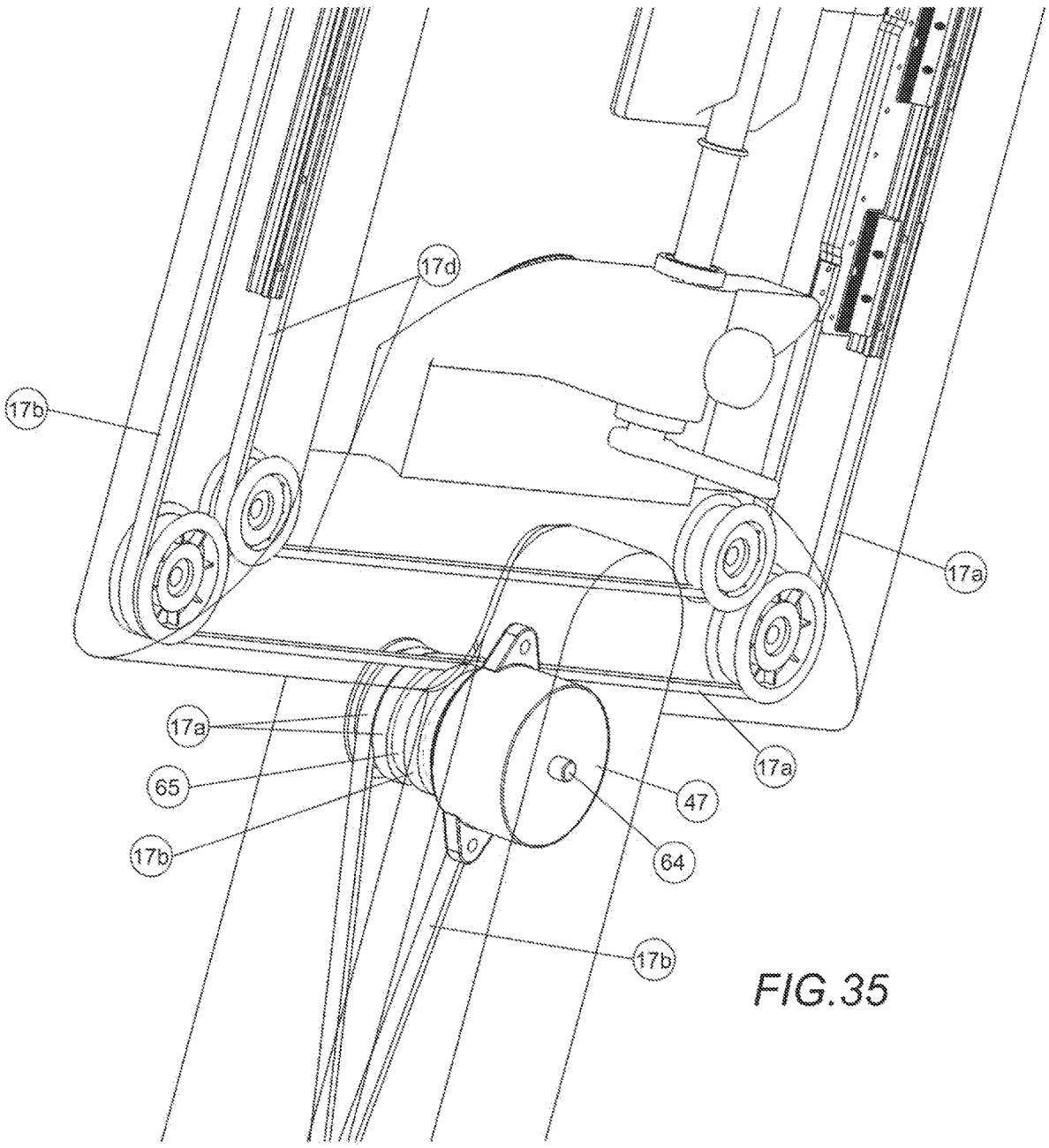
FIG. 35 is a rear perspective closeup view of a center section of a climbing exercise machine, according to embodiments of the present invention.

FIGS. 29, 30, 33, 34, and 36 illustrate various views of a left foot pedal 21*a* and a right foot pedal 21*b* of embodiments of the invention which are each operatively mounted on a foot pedal support axle 78. FIG. 34 illustrates a closeup view of a foot pedal 21, an adjustable strap 25, a foot pedal support axle 78, and a foot pedal latch 50. The foot pedal latch 50 is a spring-loaded latch that is operatively mounted to the end of the foot pedal support axle 78 that is distant from the lower upright 11. The foot pedal latch 50 generally functions in the same way as the foot pedal latch 50 previously described herein and illustrated in FIGS. 19A and 19B.

FIGS. 29-35 illustrate various views of the belt patterns of the multiple flexible component linkage assembly of the three uprights 11 of embodiments of the invention. In this configuration, the first end of belt 17*a* is connected to an inside section of the left handle adjustment plate 19 with a belt connector 15, whereby the first end of belt 17*a* is operatively connected to the left handle 18*a*, extends upward within the right side of left upper upright 11 to the upper end of left upper upright 11, wraps over a pulley 36, extends downward within the left side of left upper upright 11 to the lower left section of the crossbar 12, wraps underneath a pulley 36, extends within the lower side of the crossbar 12 and midway through crossbar 12, wraps over the top of the resistance motor axle pulley 65, wraps multiple times about the resistance motor axle pulley 65, extends downward within lower upright 11 to the left side of lower upright 11, and connects to a slide 20 such that the second end of belt 17*a* is operatively connected to the left foot pedal axle 78 and left foot pedal 21*a*. Belt 17*b* is operatively connected to right handle 18*b* and right foot pedal 21*b* in an identical configuration, mutatis mutandis. Therefore, belt 17*a* and belt 17*b* are interconnected such that a middle section of each belt wraps multiple times about the resistance motor axle pulley 65, but in opposite directions. A first end of belt 17*c* is connected to a slide 20 within the left side of lower upright 11 with a belt connector 15, whereby the first end of belt 17*c* is operatively connected to the left foot pedal support axle 78 and the left foot pedal 21*a* and belt 17*c* extends downward within the left side of lower upright 11 to the lower end of lower upright 11, wraps underneath a pulley 36, extends upward within the right side of lower upright 11, and connects to a slide 20 within the right side of lower upright 11 such that the second end of belt 17*c* is operatively connected to the right foot pedal support axle 78 and the right foot pedal 21*b*. A first end of belt 17*d* is connected to an inside section of the left handle adjustment plate 19 with a belt connector 15, whereby the first end of belt 17*d* is operatively connected to left handle 18*a* and belt 17*d* extends downward within the right side of left upper upright 11 to the upper left section of crossbar 12, wraps underneath a pulley 36, extends through the upper side of the crossbar 12 to the upper right section of the crossbar 12, wraps underneath a pulley 36, extends upward within the left side of right upper upright 11, and connects to the inside section of the right handle adjustment plate 19 with a belt connector 15 such that the second end of belt 17*d* is operatively connected to the right handle 18*b*.

As a result of the interconnection of the handles 18 and foot pedals 21 created by the multiple flexible component linkage assembly illustrated in FIGS. 29-35, a concurrent pattern of reciprocating motion of the handles 18 and foot pedals 21 is created, such that (1) when left handle 18*a* moves upward, left foot pedal 21*a* moves downward (and vice versa); (2) when right handle 18*b* moves upward, right foot pedal 21*b* moves downward (and vice versa); (3) when left handle 18*a* moves upward, right handle 18*b* moves downward (and vice versa); and (4) when left foot pedal 21*a* moves upward, right foot pedal 21*b* moves downward (and vice versa). This pattern causes the reciprocating motion of belts 17*a* and 17*b*, which are each wrapped multiple times about the resistance motor axle pulley 65, to rotate the resistance motor axle pulley 65 and thus the resistance motor axle 64, which activates the resistance motor 47 during operation of the climbing exercise machine 1.

FIGS. 29-32 and 34-36 illustrate various views of the crossbar 12, and the various components and features mounted on and within the crossbar 12, in embodiments of the invention. As previously described, pulleys 36 are mounted on each upper side end of the crossbar 12 to guide belt 17*d* through the crossbar 12 and on each lower side end of the crossbar 12 to guide belts 17*a,b* partly through the crossbar 12, and a resistance motor 47 is at least partially mounted within crossbar 12. A resistance adjustment dial 59 is mounted on a central portion of the crossbar 12, in a location easily accessible by the user U during operation of the machine 1, and is operatively connected to the resistance motor 47 such that the user U can move and adjust the resistance adjustment dial 59 to a preferred setting to manipulate the amount of resistance to the exercise motion of the machine 1 created by the resistance motor 47.

Figure 32:
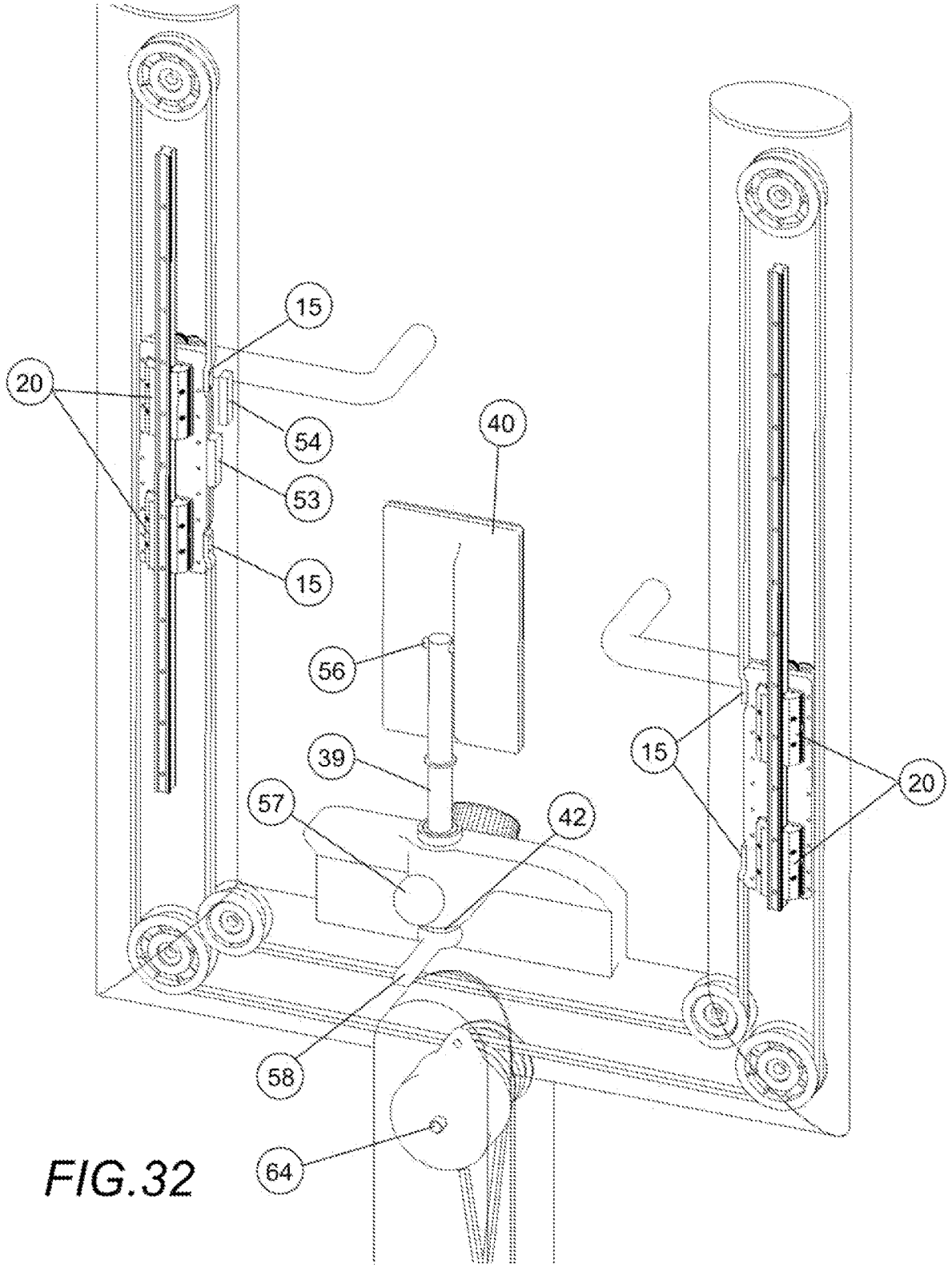
FIG. 32 is a rear upper section view of a climbing exercise machine, according to embodiments of the present invention.
Figure 33:
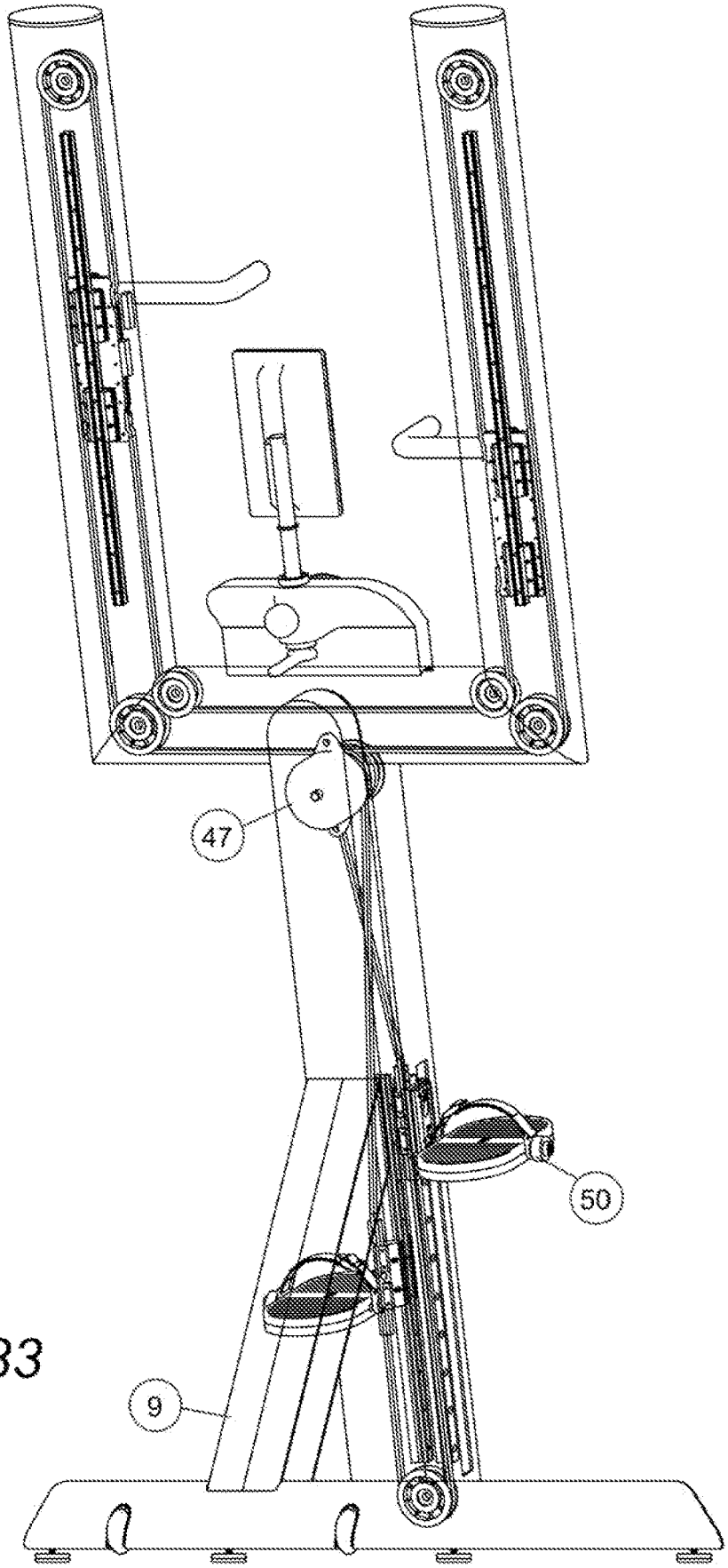
FIG. 33 is a rear perspective view of a climbing exercise machine, according to embodiments of the present invention.

A tablet computer 40 is mounted on the crossbar 12, in a location easily accessible by a user U, such that the user U can operate the tablet computer 40 while operating the machine 1. Tablet computer 40 includes a viewing screen that allows a user U to perceive digital content while operating the machine 1. Tablet computer 40 can also collect and display data pertaining to the user U's performance while operating the machine 1. At least a portion of the performance data corresponding to user U's use of the machine 1 can be captured by sensors located on various components of the machine 1, such as one or more movable electronic sensors 53 and one or more stationary electronic sensors 54. As best illustrated in FIGS. 31 and 32, a movable electronic sensor 53 is mounted on a forward section of a handle adjustment plate 19 and a stationary electronic sensor 54 is mounted on an adjacent section of an upright 11, such that when handle adjustment plate 19 moves in a reciprocating linear pattern along upright 11, the movable electronic sensor 53 passes in close proximity to stationary electronic sensor 54, and either or both of the movable electronic sensor 53 and the stationary electronic sensor 54 collects data and transfers these data to tablet computer 40. Tablet computer 40 can also collect and display data from the resistance motor 47 and other electronic devices and components that interact with machine 1. Although FIGS. 31 and 32 depict a single movable electronic sensor 53 and a single stationary electronic sensor 54, it is to be expressly understood that the climbing exercise machine 1 may include any number of movable electronic sensors 53 and/or stationary electronic sensors 54, within the scope of the present invention.

Tablet computer 40 is connected to the crossbar 12 via a mounting bracket 42 and is supported by an adjustable arm 39. The adjustable arm 39 can telescope within the mounting bracket 42 to adjust the height of the tablet computer 40, and can rotate within the mounting bracket 42 to adjust the angle of the tablet computer 40 in a horizontal plane relative to the user U. An adjustable arm movement lever 58 can be used to manipulate the position of the adjustable arm 39 and the tablet computer 40. Tablet computer 40 is connected to the adjustable arm 39 via a tablet pivot rod 56, such that the tablet computer 40 can be adjusted to various vertical angles. Tablet computer 40 can also be rotated up to 180 degrees in a horizontal plane to face in a rearward direction, such that a user U can perceive digital content from the tablet computer 40 while being behind the machine 1; this feature may be useful for user U to interact with the tablet computer 40 while not operating the machine 1 but performing other exercises.

Figure 36:
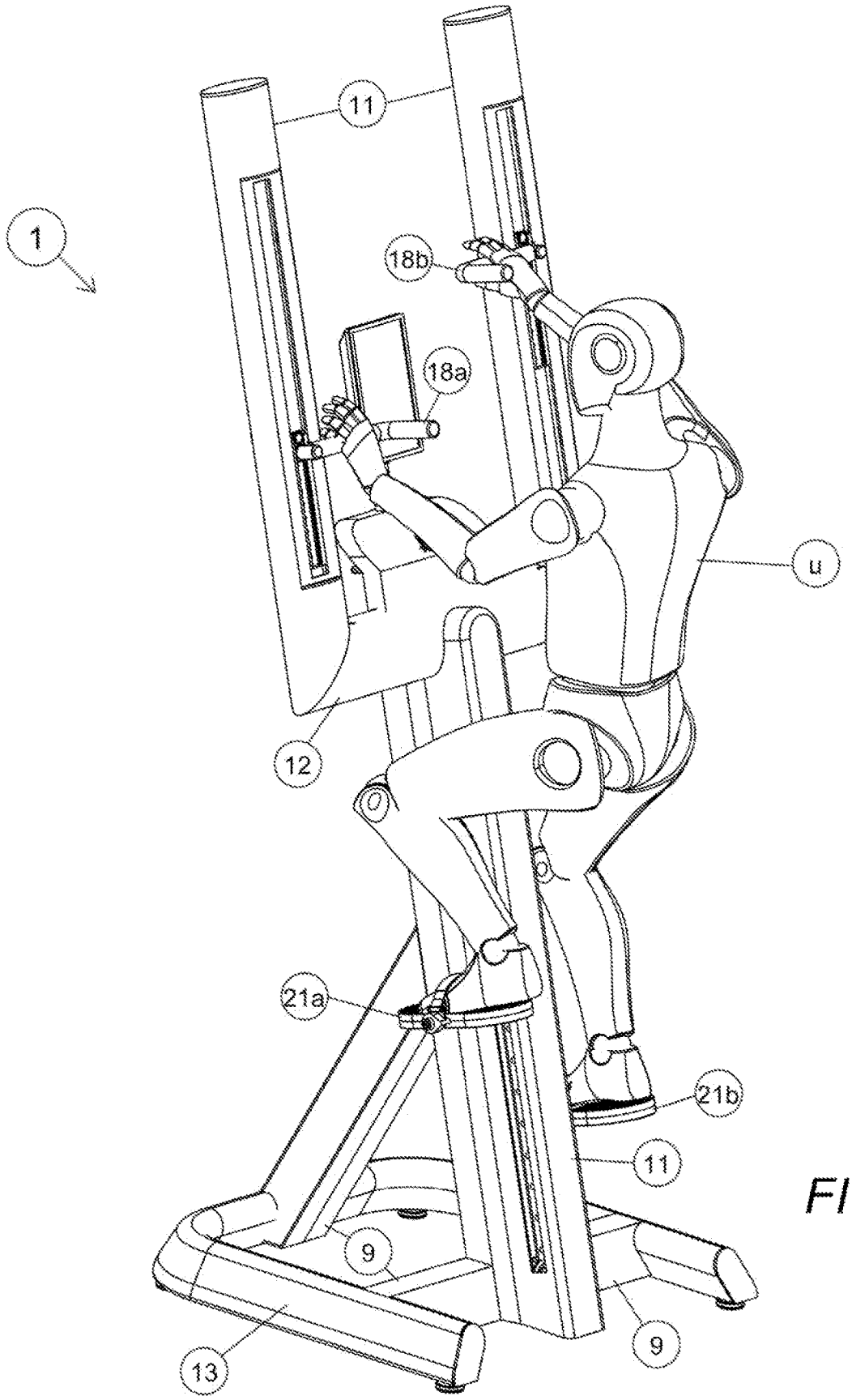
FIG. 36 is a front perspective view of a user operating a climbing exercise machine, according to embodiments of the present invention.

As illustrated in FIG. 36, to operate the machine 1 of the illustrated embodiment of the invention, a user U may enter or mount the machine by stepping onto left foot pedal 21*a* with their left foot, stepping onto right foot pedal 21*b* with their right foot, grasping left handle 18*a* with their left hand, and grasping right handle 18*b* with their right hand. If the left foot pedal 21*a* and the left handle 18*a* are relatively proximate to each other, as illustrated in FIG. 28, then the right foot pedal 21*b* and the right handle 18*b* are relatively distant from each other, and vice versa. To begin exercising, user U may push downward with their left foot and push upward with their left hand, causing left foot pedal 21*a* to move downward and left handle 18*b* to move upward, and concurrently pull their right foot upward and pull their right hand downward, causing right foot pedal 21*b* to move upward and right handle 18*b* to move downward. This motion concurrently activates and moves the interconnected belts 17*a,b,c,d* and the resistance motor 47. The reverse motion of the user's feet and hands would cause a reverse motion of the handles 18*a,b* and foot pedals 21*a,b* and the interconnected belts 17*a,b,c,d* and the resistance motor 47. The user U can perform any desired number of repetitions, adjust the resistance to the exercise motion as previously described herein, and control the distance of movement of left foot pedal 21*a*, left handle 18*a*, right foot pedal 21*b*, and right handle 18*b* for each repetition.

Referring now to FIGS. 37 through 49C, a climbing exercise machine 300 is illustrated that simulates a continuous vertical climbing motion for a user U. The machine includes a first upright 310A and a second upright 310B, rigidly mounted parallel to each other, at an angle of between about 45° and about 90° relative to a floor or ground surface, on opposing lateral sides of a base frame 313. A cross connector housing 312 connects a middle, central, or intermediate portion of upright 310A to a middle, central, or intermediate portion of upright 310B such that the uprights 310A, 310B and the cross connector housing 312 generally form an "H" shape. A first linear motion carriage 320A and a second linear motion carriage 320B are engaged with upright 310A for independent reciprocating linear motion within upright 310A; first linear motion carriage 320A is vertically spaced above second linear motion carriage 320B. A third linear motion carriage 320C and a fourth linear motion carriage 320D are engaged with upright 310B for independent reciprocating linear motion within upright 310B; third linear motion carriage 320C is vertically spaced above fourth linear motion carriage 320D. A first handle 318A is operatively connected to linear motion carriage 320A and a first foot pedal 321A is operatively connected to linear motion carriage 320B. A second handle 318B is operatively connected to linear motion carriage 320C and a second foot pedal 321B is operatively connected to linear motion carriage 320D. Handle 318A and foot pedal 321A extend away from upright 310A towards upright 310B and handle 318B and foot pedal 321A extend away from upright 310B and towards upright 310A. A first linkage assembly 350A interconnects the linear motion carriages 320A and 320B such that the handle 318A and the foot pedal 321A cooperate and move concurrently in opposite directions relative to each other along upright 310A. A second linkage assembly 350B interconnects the linear motion carriages 320C and 320D such that the handle 318B and the foot pedal 321B cooperate and move concurrently in opposite directions relative to each other along upright 310B. A cross connector axle 370 having a first end and a second end is mounted on the cross connector housing 312 in parallel with cross connector housing 312. The first end of the cross connector axle 370 is operatively connected with linkage assembly 350A and the second end of the cross connector axle 370 is operatively connected with the linkage assembly 350B such that linear motion carriages 320A, 320B, 320C, 320D are interconnected and synchronized to move concurrently. A flywheel resistance assembly 349 is operatively connected with the cross connector axle 370 at a middle, central, or intermediate portion of the cross connector axle 370 to create resistance to the motion of the linear motion carriages 320A,320B,320C,320D. Climbing exercise machine 300 may also include an electronic user interface display 340 that is mounted on cross connector housing 312.

Figure 37:
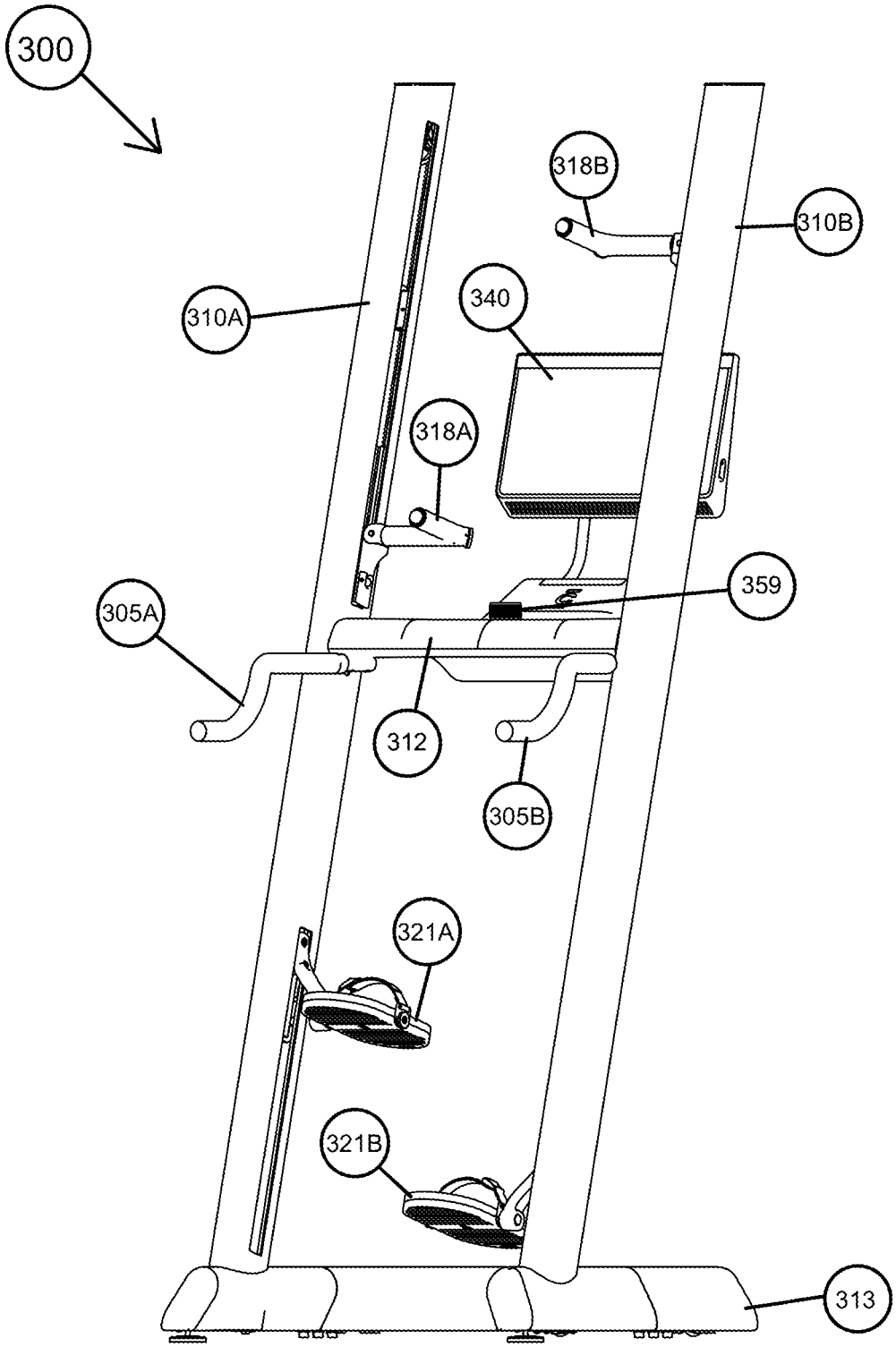
FIG. 37 illustrates a front perspective view of a climbing exercise machine, according to embodiments of the present invention.

FIG. 37 illustrates a climbing exercise machine 300 comprising a base frame 313. While base frame 313 is represented in FIG. 37 as having a "horseshoe" or "U" shape and being made of a tubular material having a generally ovular cross section, it is to be expressly understood that base frame 313 can be constructed in any of various shapes and from any of various materials capable of securely supporting user U and the various components of the climbing exercise machine 300 during operating of the climbing exercise machine 300. Any of various metals, steels, and alloys may be commonly employed to construct base frame 313, but other materials are contemplated and are within the scope of the invention.

As illustrated in FIG. 37, uprights 310A and 310B each have a first end and a second end and are rigidly mounted at their first ends onto base frame 313 at an obtuse angle, but it is to be expressly understood that uprights 310A and 310B can be rigidly mounted on base frame 313 at an acute angle, or perpendicular, to base frame 313 and such embodiments are within the scope of the present invention. Uprights 310A and 310B house various functional components that are further described in detail herein.

A handle 318A is operatively engaged with upright 310A so as to move along the portion of upright 310A that is nearer to the second end of 310A in a linear reciprocating motion. A foot pedal 321A is operatively engaged with upright 310A so as to move along the portion of upright 310A that is nearer to the first end of 310A in a linear reciprocating motion. A handle 318B is operatively engaged with upright 310B so as to move along the portion of upright 310B that is nearer to the second end of 310A in a linear reciprocating motion. A foot pedal 321B is operatively engaged with upright 310B so as to move along the portion of upright 310B that is nearer to the first end of 310B in a linear reciprocating motion.

A cross connector housing 312 has a first end and a second end; the first end is rigidly connected to upright 310A at a perpendicular angle at a middle, central, or intermediate portion of upright 310A and the second end of cross connector housing 312 is rigidly connected to upright 310B at a perpendicular angle at a middle, central, or intermediate portion of upright 310B such that uprights 310A and 310B combined with cross connector housing 312 generally form an "H" shape. A stationary handle 305A is rigidly connected to cross connector housing 312 proximal to the first end of cross connector housing 312 and extends rearward from cross connector housing 312 such that portions of handle grip 305A are substantially parallel with base frame 313. A stationary handle 305B is rigidly connected to cross connector housing 312 proximal to the second end of cross connector housing 312 and extends rearward of from cross connector housing 312 such that portions of stationary handle 305B are substantially parallel with base frame 313. A resistance adjustment dial 359 is operatively mounted on cross connector housing 312 at a location within comfortable reach of user U during operation of machine 300. An electronic user interface display 340 is mounted on cross connector housing 312 at a location within comfortable reach of user U and at a location within viewing distance by user U during operation of machine 300.

Figure 38:
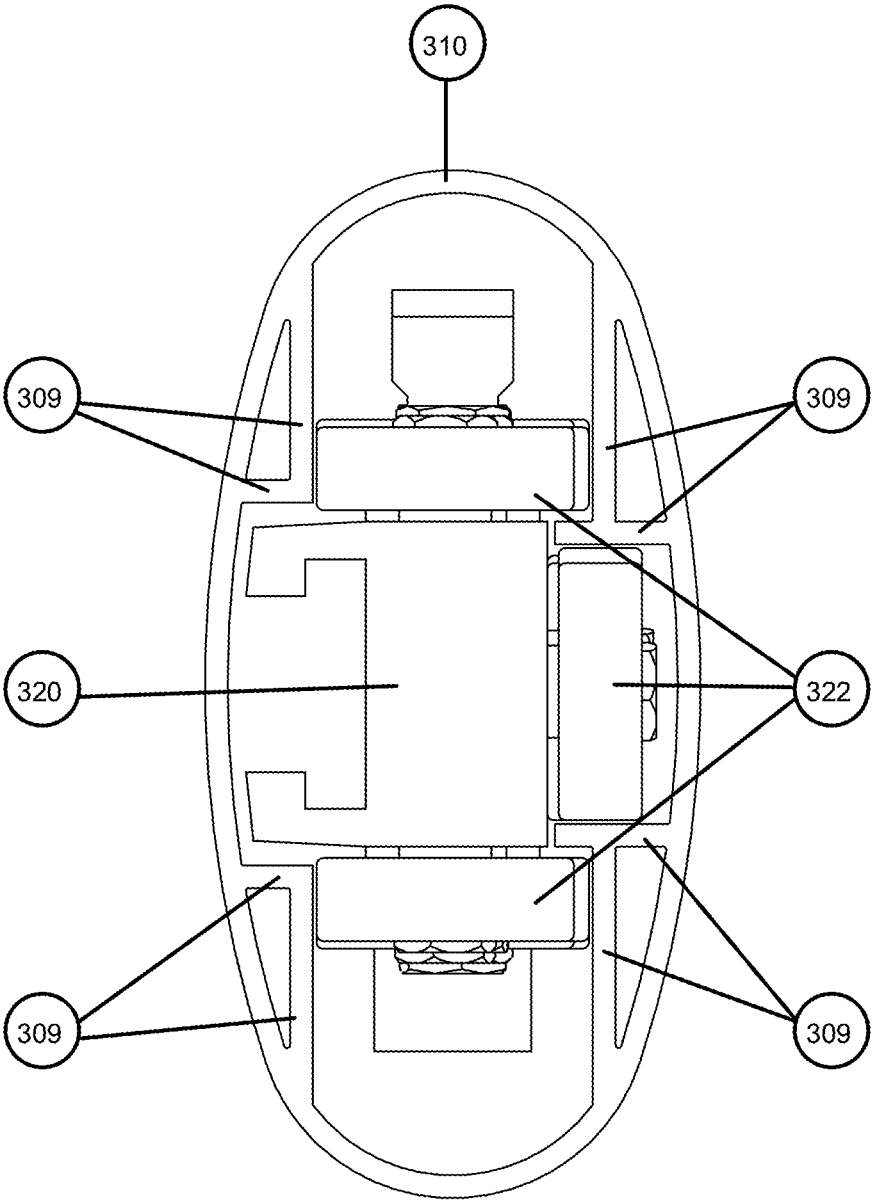
FIG. 38 illustrates a top isolated cross section view of an upright and a linear motion carriage that is housed within the upright, according to embodiments of the present invention.

FIG. 38 illustrates a cross section of an upright 310 and a cross section of a linear motion carriage 320 that is housed within upright 310, wherein the structural profile of upright 310 includes an integrated track that captures and guides linear motion carriage 320. Upright 310 is represented as being constructed from an extruded tube, wherein upright 310 is formed with interior walls 309 that create multiple chambers that run the length of upright 310. These chambers created by the interior walls 309 provide multiple rolling surfaces for linear motion carriage wheels 322. Any of various metals, steels, and alloys may be commonly employed to construct the upright 310, but other materials are contemplated and are within the scope of the invention.

Figure 39:
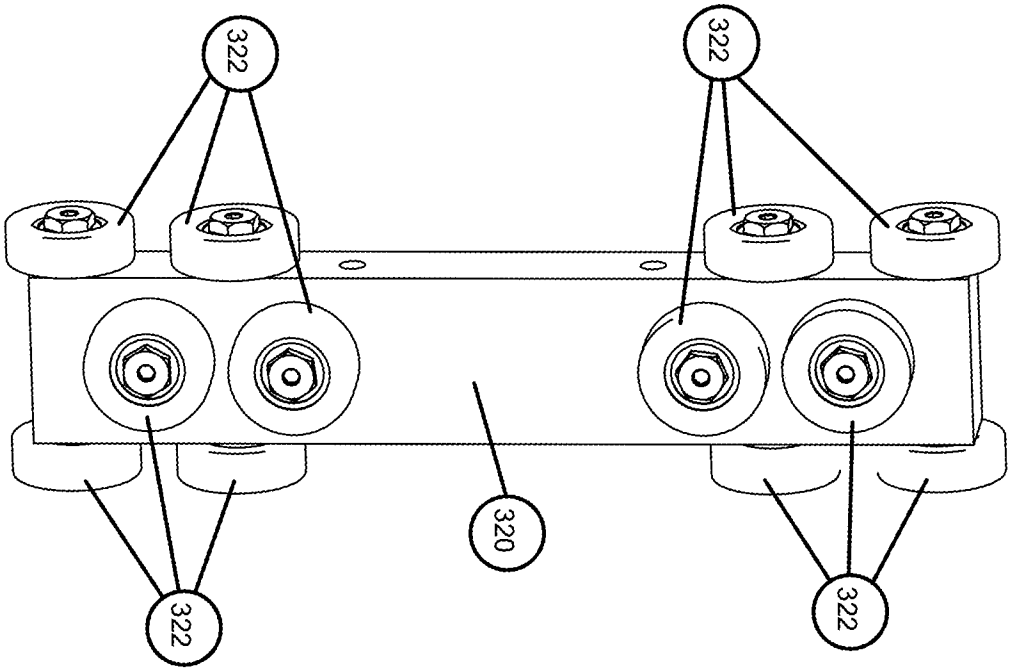
FIG. 39 illustrates a perspective view of a linear motion carriage, according to embodiments of the present invention.

FIGS. 38 and 39 illustrate a linear motion carriage 320, which in this embodiment is constructed from an elongated bar with a four-sided, mostly rectangular profile. A series of linear motion carriage wheels 322 are fastened to three of the four sides of linear motion carriage 320 in an offset pattern such that each of the linear motion carriage wheels 322 concurrently contacts and rolls on an interior wall 309 of upright 310 to stabilize and move linear motion carriage 320 with minimal friction. The fourth side of the linear motion carriage 320 receives a user engagement assembly such as a foot pedal assembly 311 or a handle assembly 308, each of which is further described in detail herein. Any of various metals, steels, and alloys may be commonly employed to construct the linear motion carriage 320, but other materials are contemplated and are within the scope of the invention.

Figure 40:
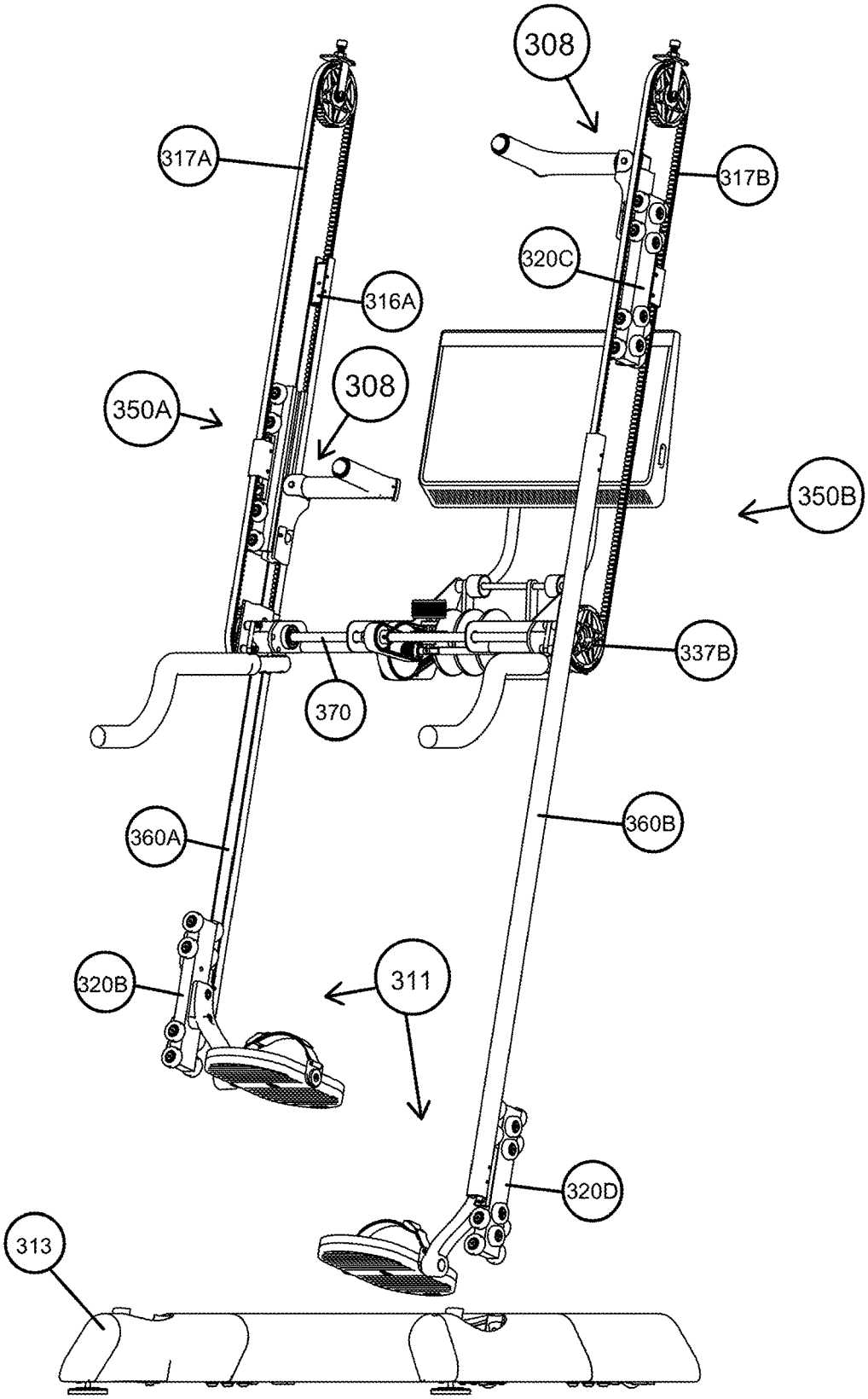
FIG. 40 illustrates a front perspective view of a climbing exercise machine and some of the components of the machine are removed to better illustrate other components of the machine, according to embodiments of the present invention.
Figure 41:
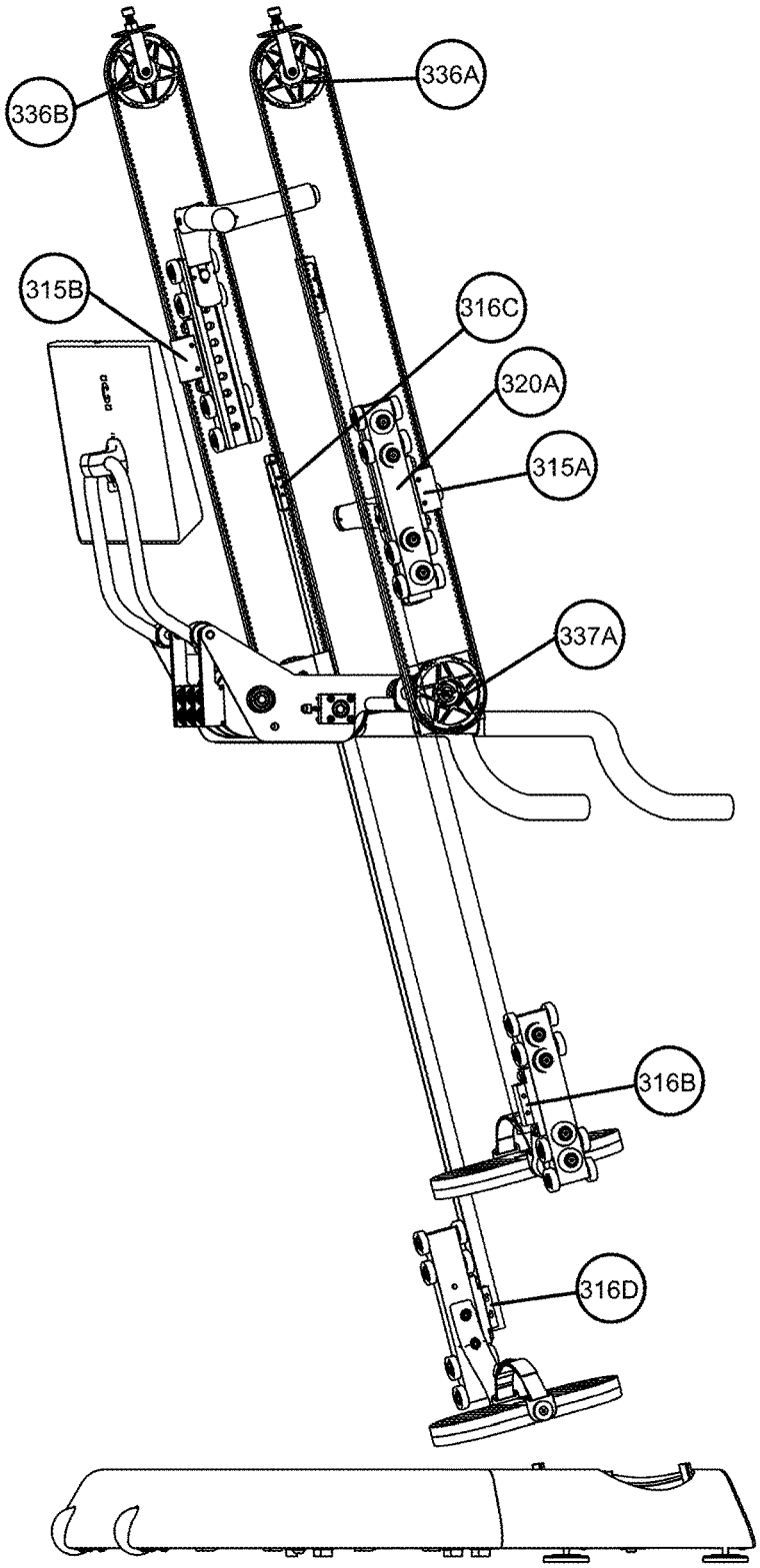
FIG. 41 illustrates a rear perspective view of a climbing exercise machine and some of the components of the machine are removed to better illustrate other components of the machine, according to embodiments of the present invention.

FIGS. 40 and 41 illustrate views of the components housed within upright 310A and 310B that create the synchronized motions that transport handle assemblies 308 and foot pedal assemblies 311. The structure of uprights 310A and 310B have been removed from these views to best illustrate these components. These components include a first linear motion carriage 320A, a second linear motion carriage 320B, a third linear motion carriage 320C, a fourth linear motion carriage 320D, a first linkage assembly 350A, and a second linkage assembly 350B. Linkage assembly 350A interconnects and synchronizes the motion of linear motion carriages 320A,320B. Linkage assembly 350B interconnects and synchronizes the motion of linear motion carriages 320C,320D.

As illustrated in FIGS. 40 and 41, linkage assembly 350A comprises a first linkage belt 317A, which forms a continuous loop supported on the second end of upright 310A by a first guide pulley mounting bracket 335A and a first guide pulley 336A and supported on a middle, central, or intermediate section of upright 310A with a first cross connector axle drive pulley 337A, such that linkage belt 317A rotates on guide pulley 336A and cross connector axle drive pulley 337A. Linear motion carriage 320A is positioned for reciprocating movement within the loop formed by linkage belt 317A along the upper section of upright 310A. A first belt connector 315A rigidly connects a rearward section of linkage belt 317A to linear motion carriage 320A such that linkage belt 317A and linear motion carriage 320A move concurrently during operation of machine 300. Linear motion carriage 320B is positioned to move along the lower section of upright 310A. A first connector bar 360A has a first end and a second end; the first end is rigidly connected to a forward section of linkage belt 317A by a first connector bar bracket 316A and the second end of connector bar 360A is rigidly connected to the forward side of linear motion carriage 320B by a second connector bar bracket 316B such that linear motion carriage 320A, linear motion carriage 320B, guide pulley 336A, cross connector axle drive pulley 337A, linkage belt 317A, and connector bar 360A move concurrently during operation of machine 300. This concurrent motion of linkage assembly 350A causes handle 318A and foot pedal 321A to move in opposite directions, such that upward motion of the rearward section of linkage belt 317A causes linear motion carriage 320A and handle 318A to move upward, which concurrently causes the forward section of linkage belt 317A to move downward, which in turn causes connector bar 360A, linear motion carriage 320B, and foot pedal 321A to move downward. The opposite motion of linkage assembly 350A would cause the opposite motion of all of the components of linkage assembly 350A, handle 318A, and foot pedal 321A as described.

As illustrated in FIGS. 40 and 41, linkage assembly 350B comprises a second linkage belt 317B, which forms a continuous loop supported on the second end of upright 310B by a second guide pulley mounting bracket 335B and a second guide pulley 336B and supported on a middle, central, or intermediate section of upright 310B with a second cross connector axle drive pulley 337B, such that linkage belt 317B rotates on guide pulley 336B and cross connector axle drive pulley 337B. Linear motion carriage 320C is positioned for reciprocating movement within the loop formed by linkage belt 317B along the upper section of upright 310B. A second belt connector 315B rigidly connects a forward section of linkage belt 317B to linear motion carriage 320C such that linkage belt 317B and linear motion carriage 320C move concurrently during operation of machine 300. Linear motion carriage 320D is positioned to move along the lower section of upright 310B. A second connector bar 360B has a first end and a second end; the first end is rigidly connected to a rearward section of linkage belt 317B by a third connector bar bracket 316C and the second end of connector bar 360B is rigidly connected to the rearward side of linear motion carriage 320D by a fourth connector bar bracket 316D such that linear motion carriage 320C, linear motion carriage 320D, guide pulley 336B, cross connector axle drive pulley 337B, linkage belt 317B, and connector bar 360B move concurrently during operation of machine 300. This concurrent motion of linkage assembly 350B causes handle 318B and foot pedal 321B to move in opposite directions, such that downward motion of the forward section of linkage belt 317B causes linear motion carriage 320C and handle 318B to move downward, which concurrently causes the rearward section of linkage belt 317B to move upward, which in turn causes connector bar 360B, linear motion carriage 320D, and foot pedal 321B to move upward. The opposite motion of linkage assembly 350B would cause the opposite motion of all of the components of linkage assembly 350B, handle 318B, and foot pedal 321B as described.

Figure 42:
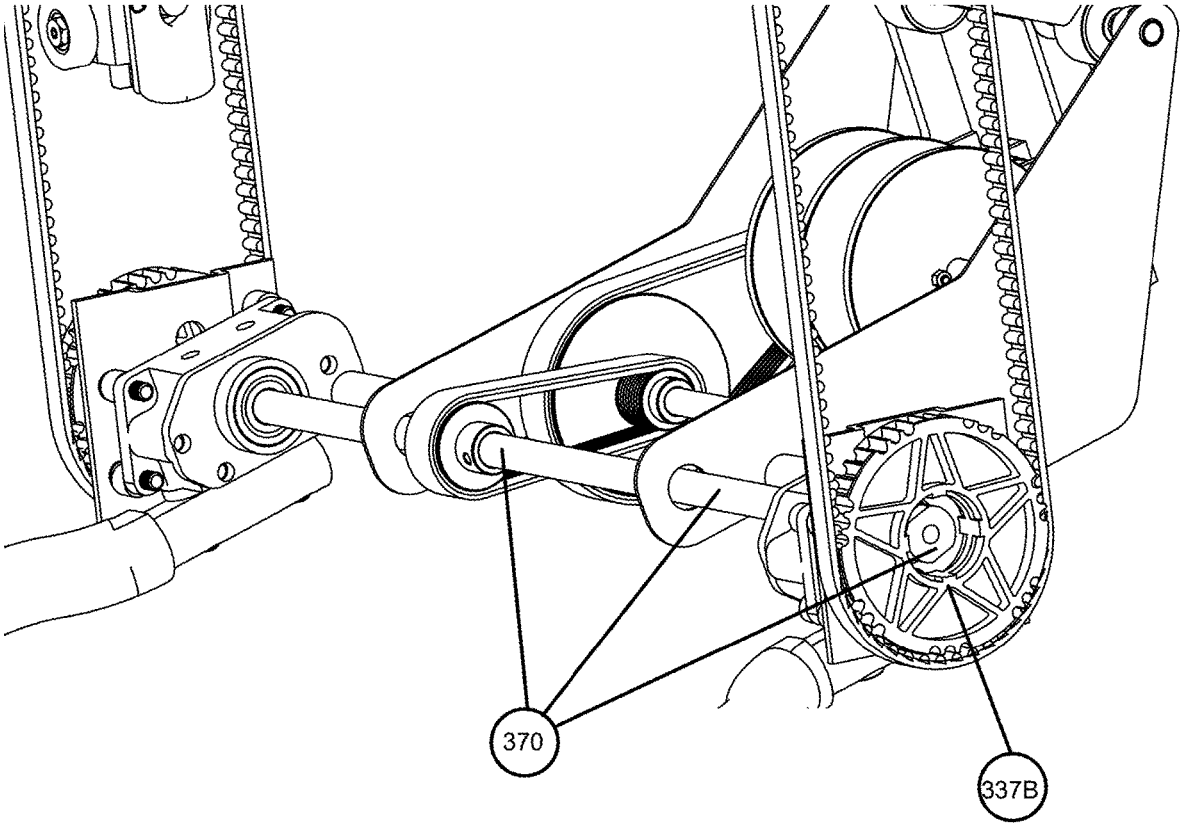
FIG. 42 illustrates a front perspective isolated view of a cross connector axle and the connection of the cross connector axle to a drive pulley, according to embodiments of the present invention.
Figure 43:
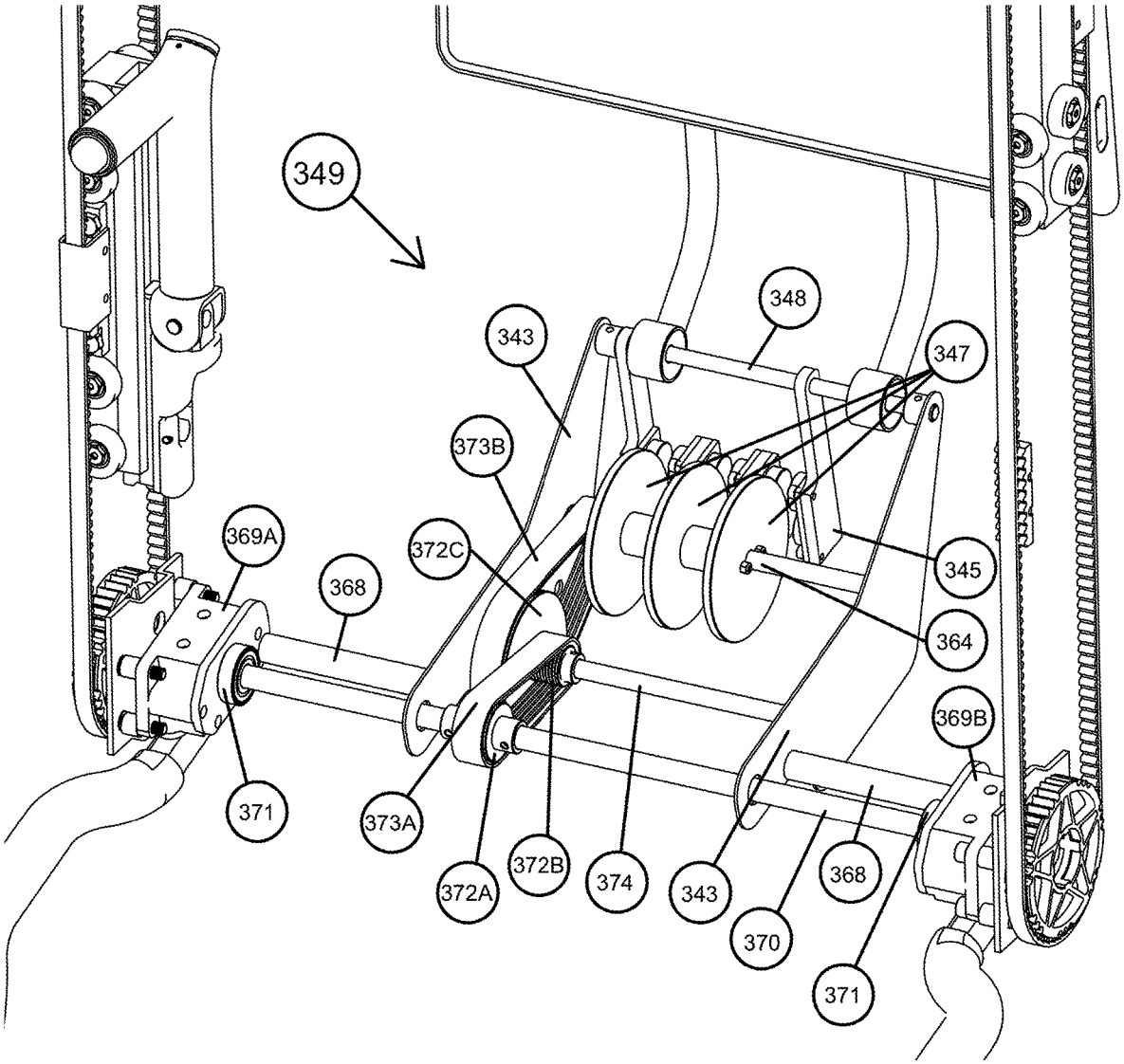
FIG. 43 illustrates a front perspective isolated view of a cross connector axle operatively connected with a resistance assembly, according to embodiments of the present invention.
Figure 44:
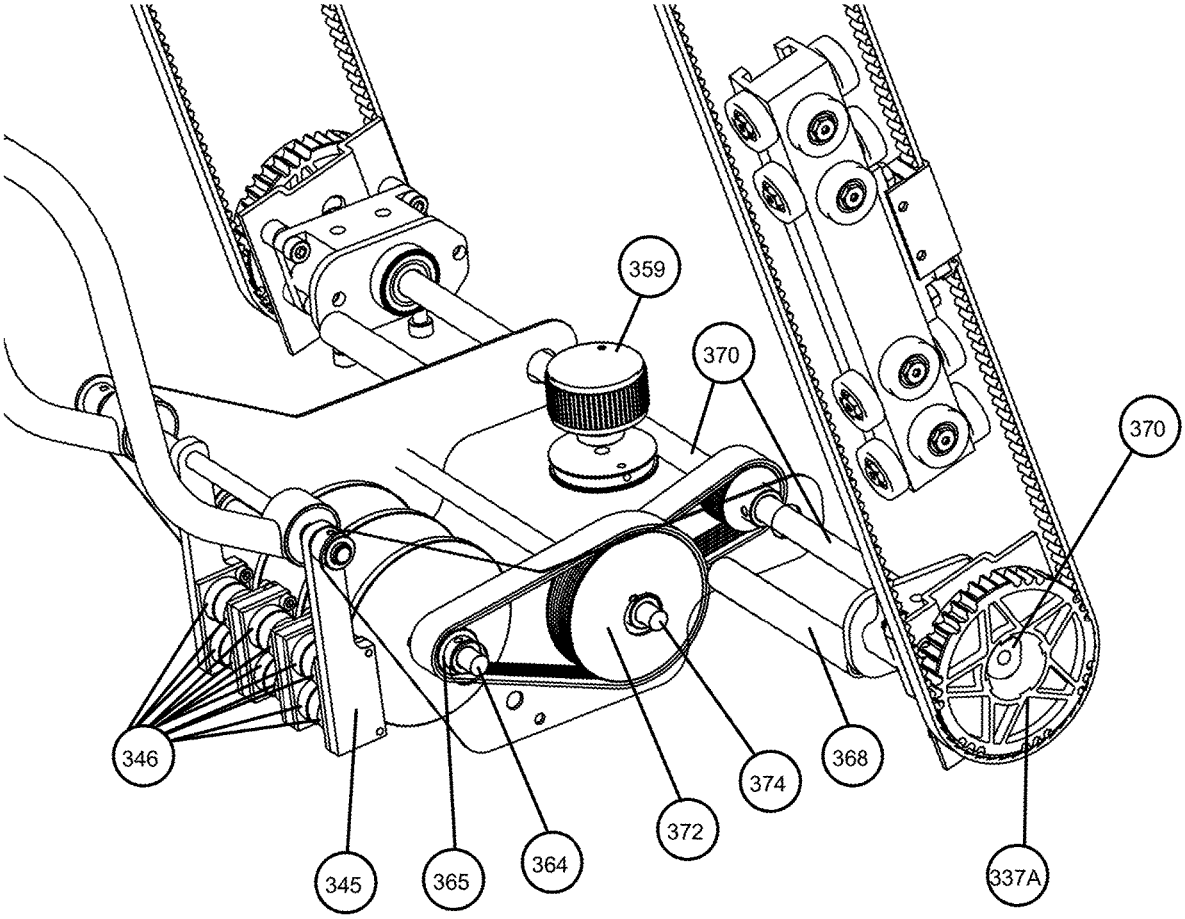
FIG. 44 illustrates a rear perspective isolated view of a cross connector axle operatively connected with a resistance assembly, according to embodiments of the present invention.

FIGS. 42-44 illustrate the components housed within the cross connector housing and the cooperation of those components with linkage assemblies 350A and 350B. To clearly illustrate certain components in these views, some components may be removed or represented with a transparent view. A cross connector axle 370 has a first end and a second end and is mounted on mounting blocks 369A and 369B by two cross connector axle bearings 371. The first end of cross connector axle 370 extends through mounting block 369A and is rigidly connected to cross connector axle drive pulley 337A, and the second end of cross connector axle 370 extends through mounting block 369B and is rigidly connected to cross connector axle drive pulley 337B, such that cross connector axle 370, cross connector axle drive pulley 337A, cross connector axle drive pulley 337B, linkage assembly 350A, linkage assembly 350B, handles 318A, 318B, and foot pedals 321A,321B are synchronized and move concurrently during operation of machine 300.

A flywheel resistance assembly 349 is mounted on flywheel resistance assembly support frame 343 and is operatively connected to cross connector axle 370 at a middle, central, or intermediate portion of cross connector axle 370. Brace tubes 368 rigidly connect flywheel resistance assembly support frame 343 to mounting blocks 369A and 369B.

As illustrated in FIGS. 42-44, a drive pulley axle 374 has a first end and a second end and is mounted within flywheel resistance assembly support frame 343 forward of and parallel to cross connector axle 370. A flywheel axle 364 has a first end and a second end and is mounted within flywheel resistance assembly support frame 343 forward of and parallel to drive pulley axle 374. A resistance magnets housing pivot axle 348 has a first end and a second end and is mounted on flywheel resistance assembly support frame 343 forward of, above, and parallel to flywheel axle 364.

A first flywheel drive pulley 372A is rigidly mounted on a middle, central, or intermediate section of cross connector axle 370. A second flywheel drive pulley 372B, having a diameter the same as or similar to the diameter of drive pulley 372A, is rigidly mounted on drive pulley axle 374 proximal to the first end of drive pulley axle 374, and a third drive pulley axle 372C, having a larger diameter than drive pulley 372B, is rigidly mounted proximal to the first end of drive axle 374. Drive pulleys 372B and 372C are parallel and in close proximity to each other, with drive pulley 372C nearer to the first end of drive axle 374 than drive pulley 372B. A flywheel axle pulley 365 is rigidly mounted on the first end of flywheel axle 364. At least one flywheel 347 is rigidly mounted on a middle, central, or intermediate section of flywheel axle 364. While FIGS. 42-44 depict a flywheel resistance assembly 349 having three flywheels 347, it is to be expressly understood that the flywheel resistance assembly may include any number of flywheels 347, including but not necessarily limited to one, two, four, or more than four flywheels 347, and all such embodiments are within the scope of the present invention. A resistance magnets housing 345 is pivotally connected to a middle, central, or intermediate section of resistance magnets housing pivot axle 348.

A first flywheel drive belt 373A connects drive pulley 372A with drive pulley 372B. A second flywheel drive belt 373B connects drive pulley 372C with flywheel axle pulley 365.

A plurality of disc-shaped resistance magnets 346 are mounted on resistance magnets housing 345 and are offset from and parallel to flywheels 347. A resistance adjustment dial 359 is operatively mounted on cross connector housing 312 and is operatively connected to resistance magnets housing 345 so as to control the pivotal motion of resistance magnets housing 345 and set the location of resistance magnets housing 345. Resistance magnets 346 are mounted on resistance magnets housing 345 such that when resistance magnets housing 345 pivots about resistance magnets housing pivot axle 348 in a direction towards flywheels 347, a portion of the resistance magnets 346 overlap a portion of the flywheels 347, creating a magnetic field that resists the rotation of flywheels 347. When resistance adjustment dial 359 is moved to a position which causes resistance magnets 346 to overlap a larger portion of flywheels 347, more resistance is created, and when resistance adjustment dial 359 is moved to a position which causes resistance magnets 346 to overlap a smaller portion of flywheels 347, less resistance is created.

Figure 45:
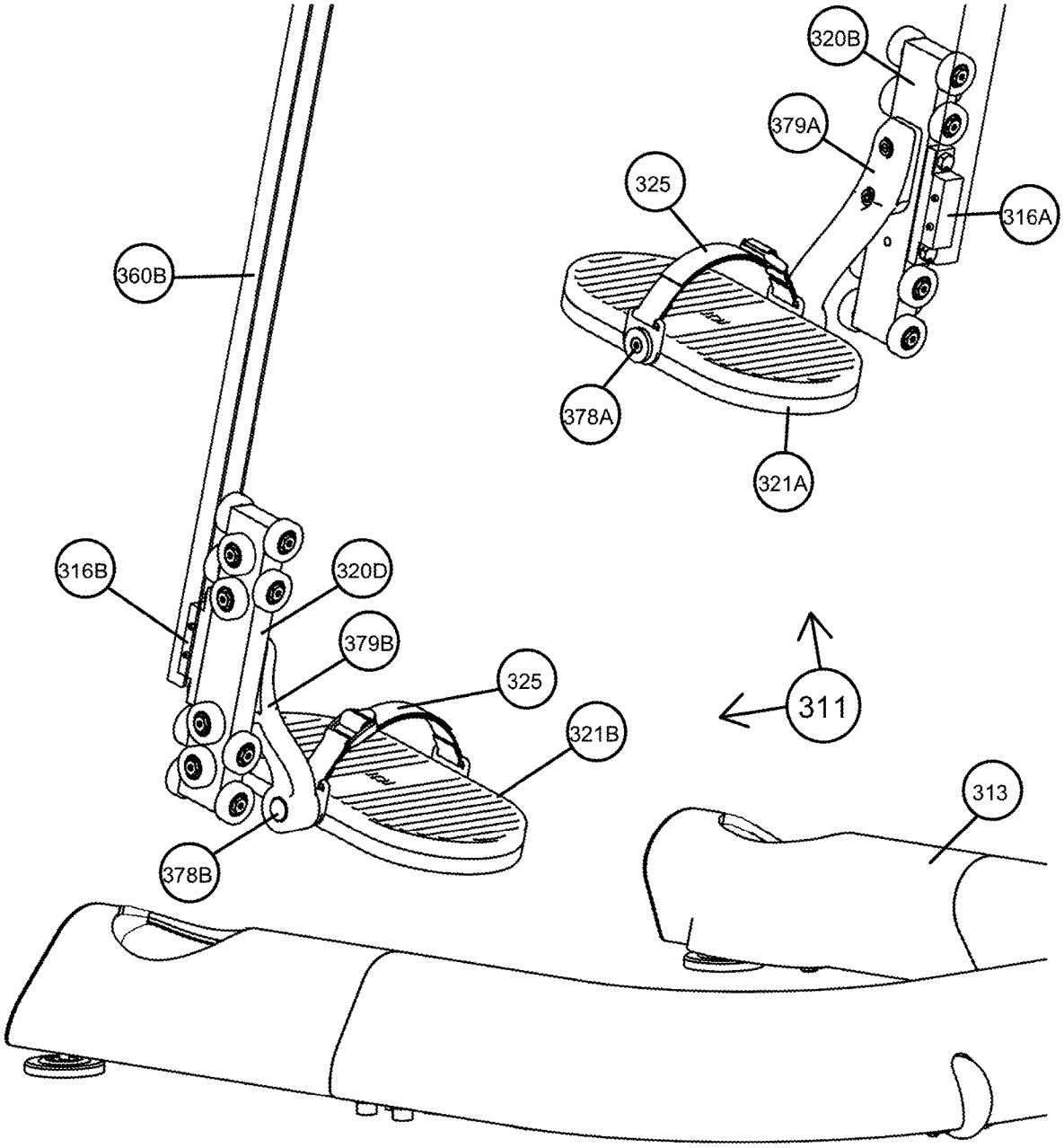
FIG. 45 illustrates a front perspective isolated view of a first pedal assembly operatively connected with a linear motion carriage and a second foot pedal assembly operatively connected with a linear motion carriage, according to embodiments of the present invention.

FIG. 45 illustrates an isolated view of identical sets of left and right components that form a foot pedal assembly 311. For simplicity of disclosure, only a first set of components for a first foot pedal assembly 311 is described, and it is to be expressly understood that a second set of components for a second foot pedal assembly 311 may be identical in both structure and function. As illustrated in FIG. 45, first foot pedal support axle connector bracket 379A has a first end and a second end; the first end is rigidly connected to a middle, central, or intermediate section of linear motion carriage 320B. A first foot pedal support axle 378A has a first end and a second end; the first end is rigidly connected to the second end of foot pedal support axle connector bracket 379A and the second end of first foot pedal support axle 378A extends perpendicularly away from upright 310A towards upright 310B. Foot pedal 321A is a rigid component with a mostly flat surface that has a length and width capable of accepting and supporting the feet of the user U. A center section of foot pedal 321A is mounted transversely onto foot pedal support axle 378A such that foot pedal 321A can pivot about foot pedal support axle 378A, which allows a user U to flex user U's ankles (in either dorsiflexion or plantar flexion) during operation of machine 300 while keeping user U's feet relatively flat on foot pedal 321A. An adjustable foot strap 325A is operatively connected to a central section of foot pedal 321A across the width of foot pedal 321A such that user U's foot can be secured to foot pedal 321A prior to operating machine 300.

Figure 46A:
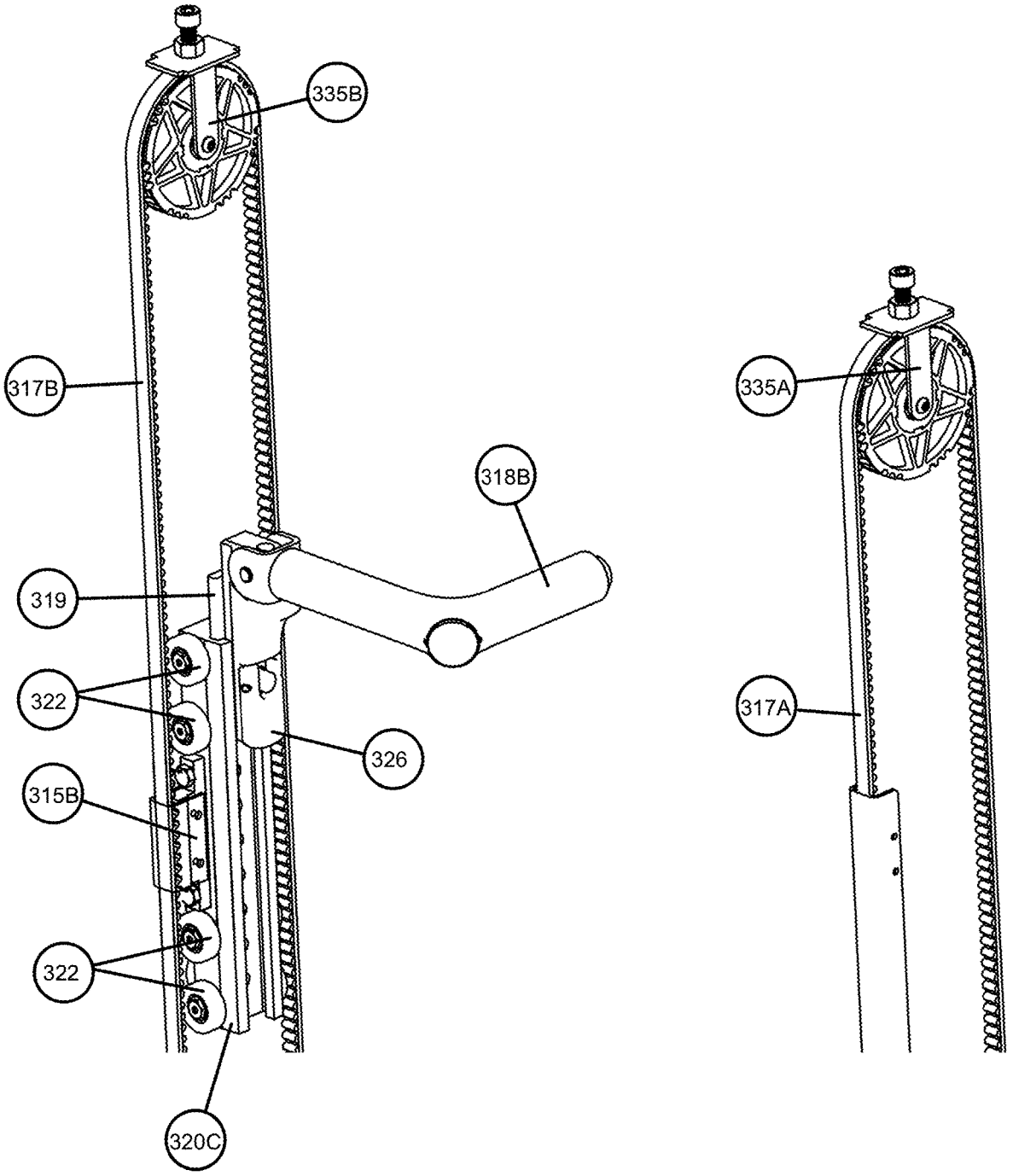
FIG. 46A illustrates a rear perspective isolated view of a handle assembly operatively connected with a linear motion carriage and the handle is in a first linear adjustment position, according to embodiments of the present invention.
Figure 46B:
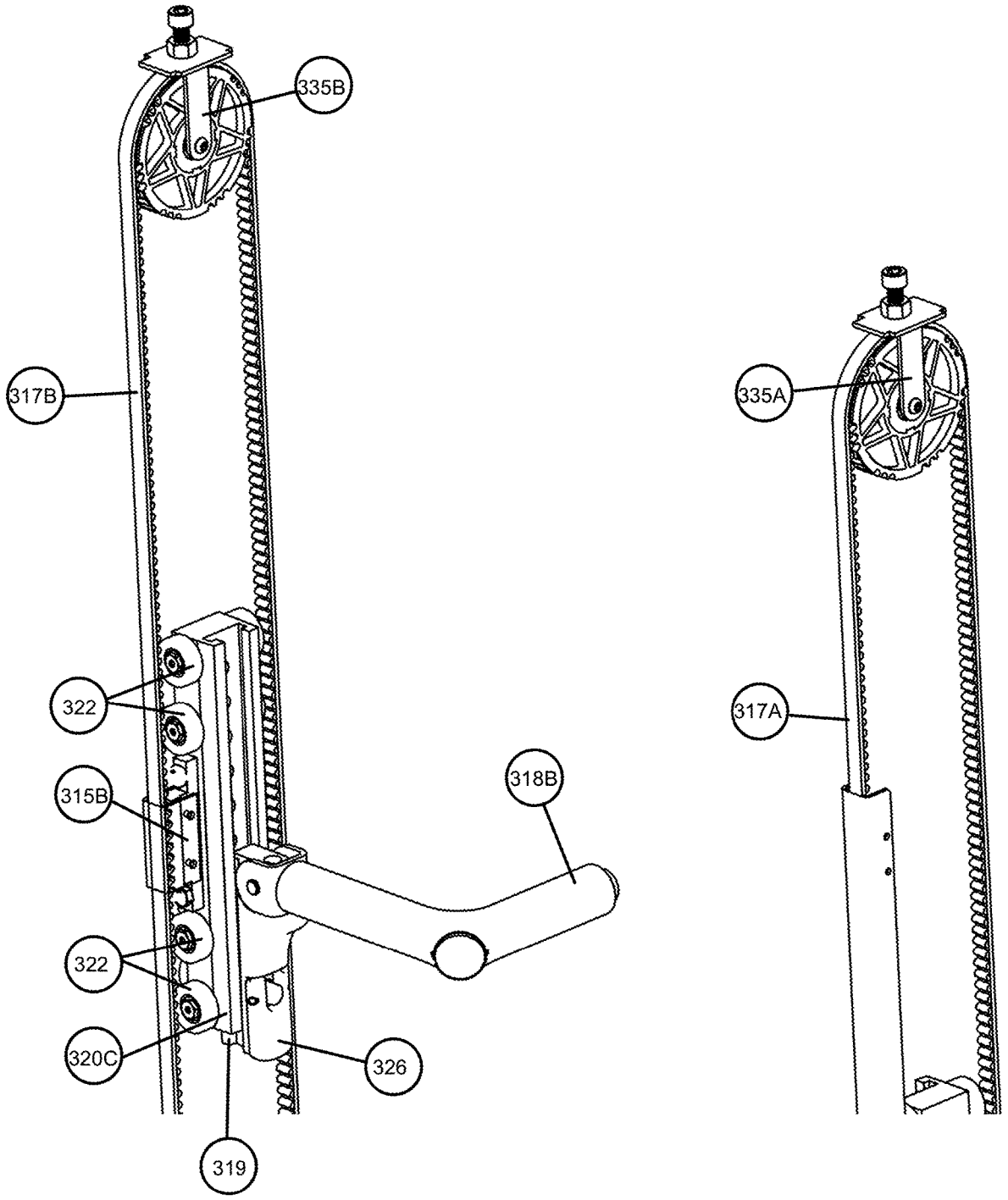
FIG. 46B illustrates a front perspective isolated view of a handle assembly operatively connected with a linear motion carriage and the handle is in a second linear adjustment position, according to embodiments of the present invention.
Figure 47:
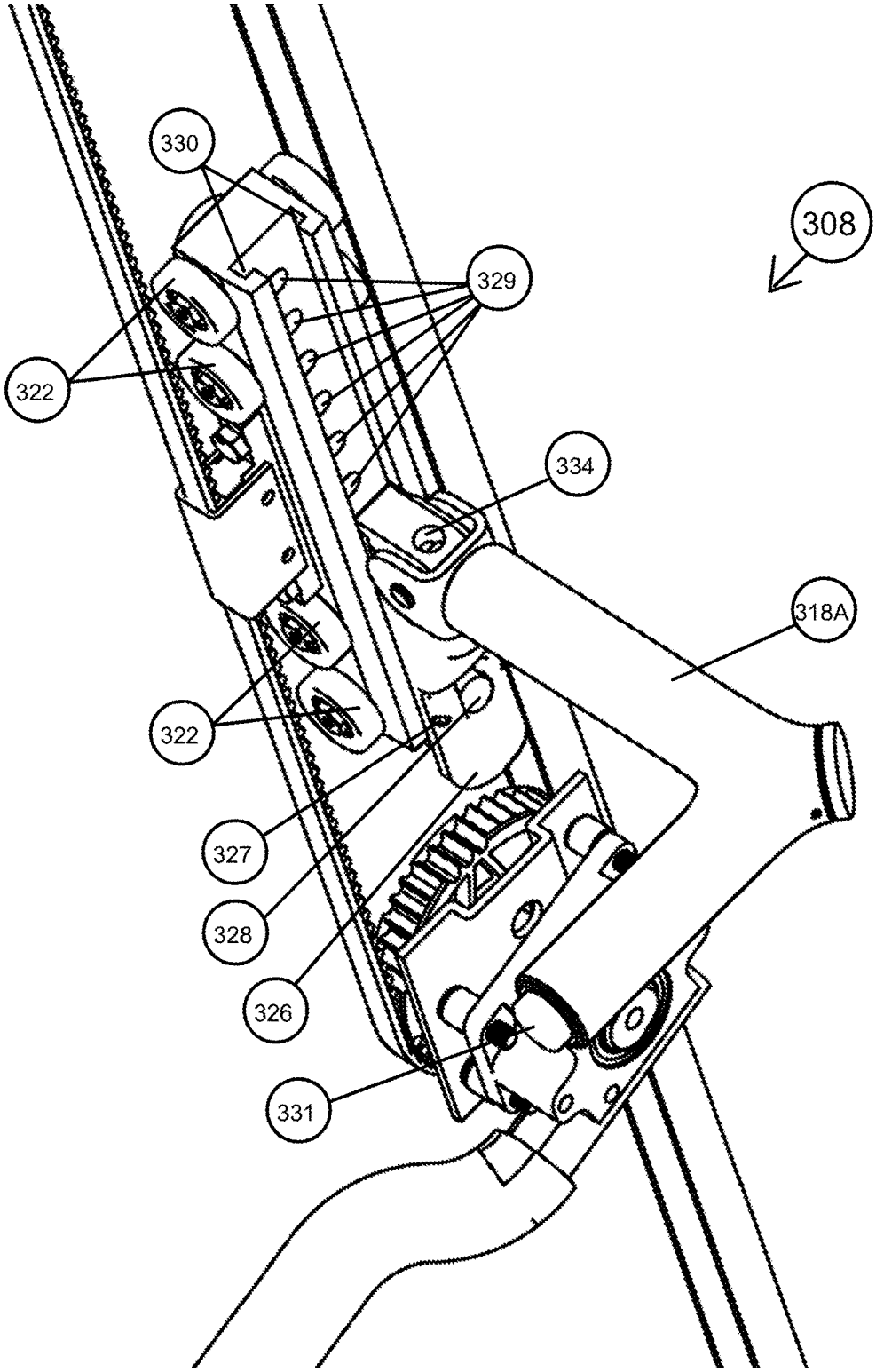
FIG. 47 illustrates a rear perspective view of a handle assembly operatively connected with a linear motion carriage, according to embodiments of the present invention.
Figure 48A:
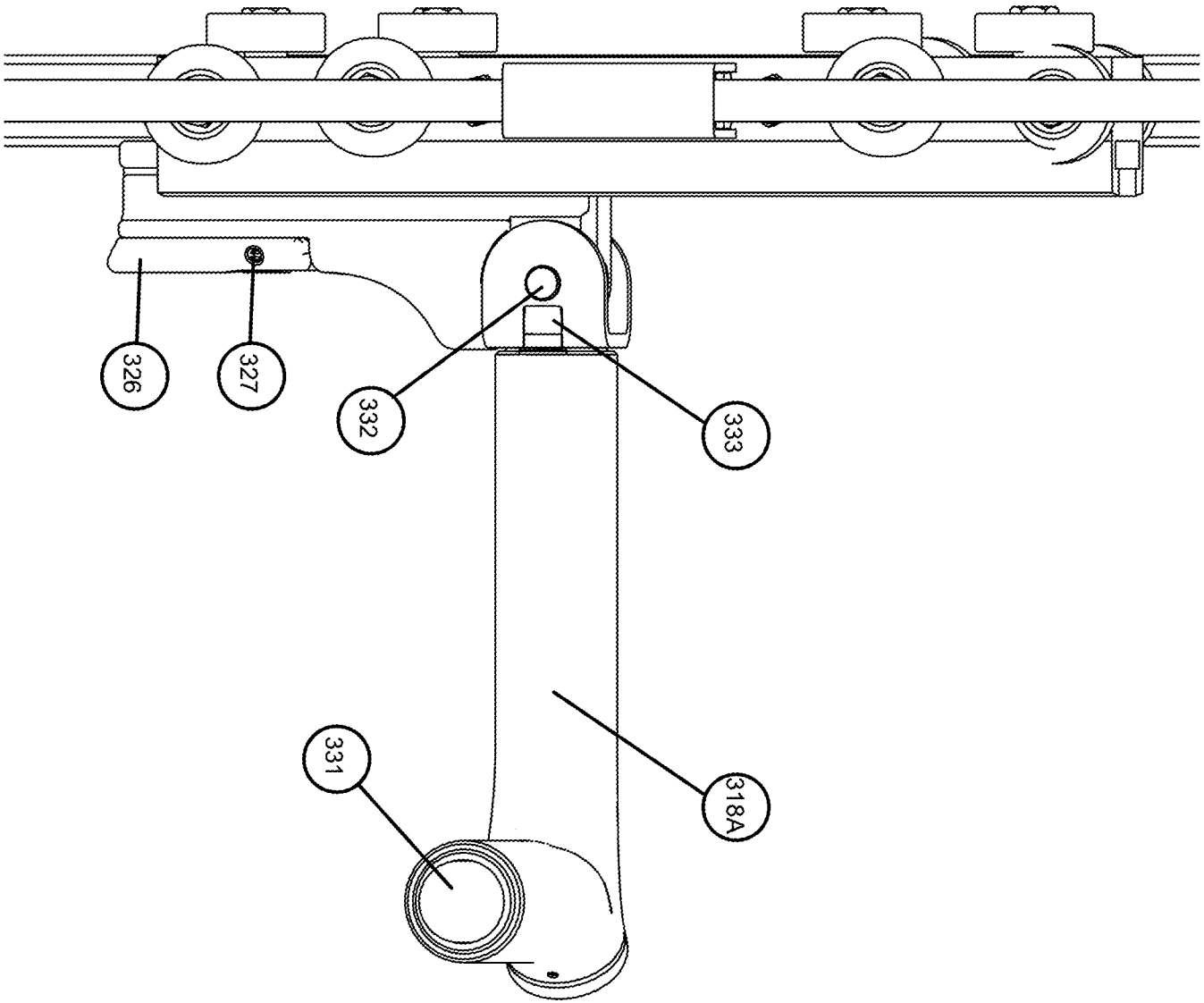
FIG. 48A is a front isolated view of a handle assembly and the handle is latched in a horizontal angle position and a handle slide plate latching lever is in the latched position, according to embodiments of the present invention.
Figure 48B:
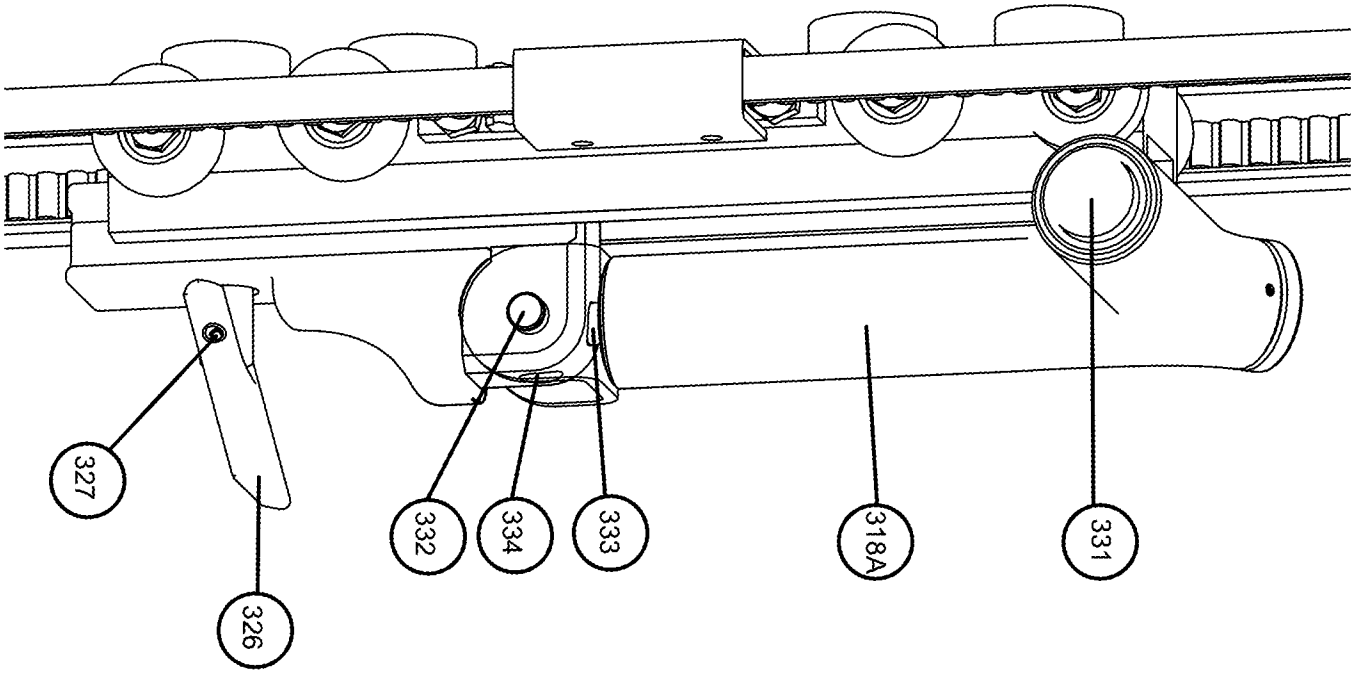
FIG. 48B is a front isolated view of a handle assembly and the handle is latched in a vertical angle position and a handle slide plate latching lever is in the unlatched position, according to embodiments of the present invention.

FIGS. 46A-48B illustrate an isolated view of identical left and right components that form an adjustable handle assembly 308. For simplicity of disclosure, each component of adjustable handle assembly 308 and its function is described only once, but it is to be expressly understood that machine 300 comprises two identical sets of components that create left and right adjustable handle assemblies 308 that may be identical in both structure and function. As illustrated in FIGS. 46A-48B, a handle slide plate 319 is slidably engaged with a handle slide plate receiver slot 330 formed within linear motion carriage 320, such that handle slide plate 319 can be linearly adjusted along linear motion carriage 320. A plurality of handle slide plate latching pin receiver holes 329 are formed into and linearly spaced on linear motion carriage 320 within handle slide plate receiver slot 330. A handle slide plate latching pin 328 has a first end and a second end and is slidably mounted within handle slide plate 319 in a perpendicular orientation relative to linear motion carriage 320. The first end of handle slide plate latching pin 328 is engaged with a handle slide plate latching pin receiver hole 329 and the second end of handle slide plate latching pin 328 is pivotally connected to a handle slide plate latching lever 326 with a handle slide plate latching lever axle 327. FIG. 46A illustrates handle slide plate 319 in a first position on linear motion carriage 320 with handle slide plate latching lever 326 in a latched position, such that handle slide plate latching pin 328 is extended and engaged with a first handle slide plate latching pin receiver hole 329. FIG. 46B illustrates handle slide plate 319 in a second position on linear motion carriage 320 with handle slide plate latching lever 326 in a latched position, such that handle slide plate latching pin 328 is extended and engaged with a second handle slide plate latching pin receiver hole 329. FIG. 48B illustrates handle slide plate latching lever 326 in an unlatched position, such that handle slide plate latching pin 328 is contracted and not engaged with a handle slide plate latching pin receiver hole 328. To adjust handle slide plate 319 from a first linear position on linear motion carriage 320 to a second linear position on linear motion carriage 320, user U may pivot handle slide plate latching lever 326 to the unlatched position, which contracts handle slide plate latching pin 328 and disengages handle slide plate latching pin 328 from a first handle slide plate latching pin receiver hole 329. User U may then slide handle slide plate 319 to a second linear position on linear motion carriage 320 and pivot handle slide plate latching lever 326 to the latched position, which extends handle slide plate latching pin 328 and engages handle slide plate latching pin 328 with a second handle slide plate latching pin receiver hole 329 to secure handle slide plate 319 into a second linear position on linear motion carriage 320.

While handle 318 is represented in FIGS. 46A-48B as having an "L" shape and being made of a tubular material having a generally round (circular or ovular) cross section, it is to be expressly understood that handle 318 can be constructed in any of various shapes and from any of various materials. Handle 318 is pivotally connected to handle slide plate 319 by a handle pivot axle 332. As illustrated in FIG. 48A, handle 318 can be configured in a first angular position relative to upright 310, wherein handle 318 is in a perpendicular position relative to handle slide plate 319 and linear motion carriage 320 such that handle 318 extends away from upright 310A towards upright 310B. Handle 318 may also be pivotally adjusted to a second angular position relative to upright 310, wherein handle 318 is parallel to linear motion carriage 320 and in alignment with handle slide plate 319. As illustrated, handle pivot adjustment latching button 331 is movably mounted on the second end of handle 318 and operatively connected to a handle pivot latching pin 333 located within the first end of handle 318. First and second radially spaced handle pivot adjustment latching pin receiver holes 334 are formed into handle slide plate 319 proximal to handle pivot axle 332. Handle pivot adjustment latching button 331 is a spring-loaded component that is kept in an extended position by the spring when not engaged by user U. When handle pivot adjustment latching button 331 is in the extended position, handle pivot latching pin 333 is also in the extended position and engaged with a handle pivot adjustment latching pin receiver hole 334. To adjust handle 318 from a first angular position to a second angular position on handle slide plate 319, user U may press handle pivot adjustment latching button 331 into a contracted position, which contracts handle pivot latching pin 333 so as to disengage handle pivot latching pin 333 from a first handle pivot adjustment latching pin receiver hole 334. User U may then rotate handle 318 and then release handle pivot adjustment latching button 331, which causes handle pivot adjustment latching button 331 to extend and in turn causes handle pivot latching pin 333 to extend and engage with a second handle pivot adjustment latching pin receiver hole 334 to secure handle 318 into a second angular position on handle slide plate 319. Although handle 318 is shown and described as being adjustable to two unique angular positions on handle slide plate 319, the same or similar components and methods as described may be used to adjust handle 318 to any number of unique angular positions, e.g. three angular positions, four angular positions, or more than four angular positions, on handle slide plate 319, and such embodiments are within the scope of the present invention.

Figure 49A:
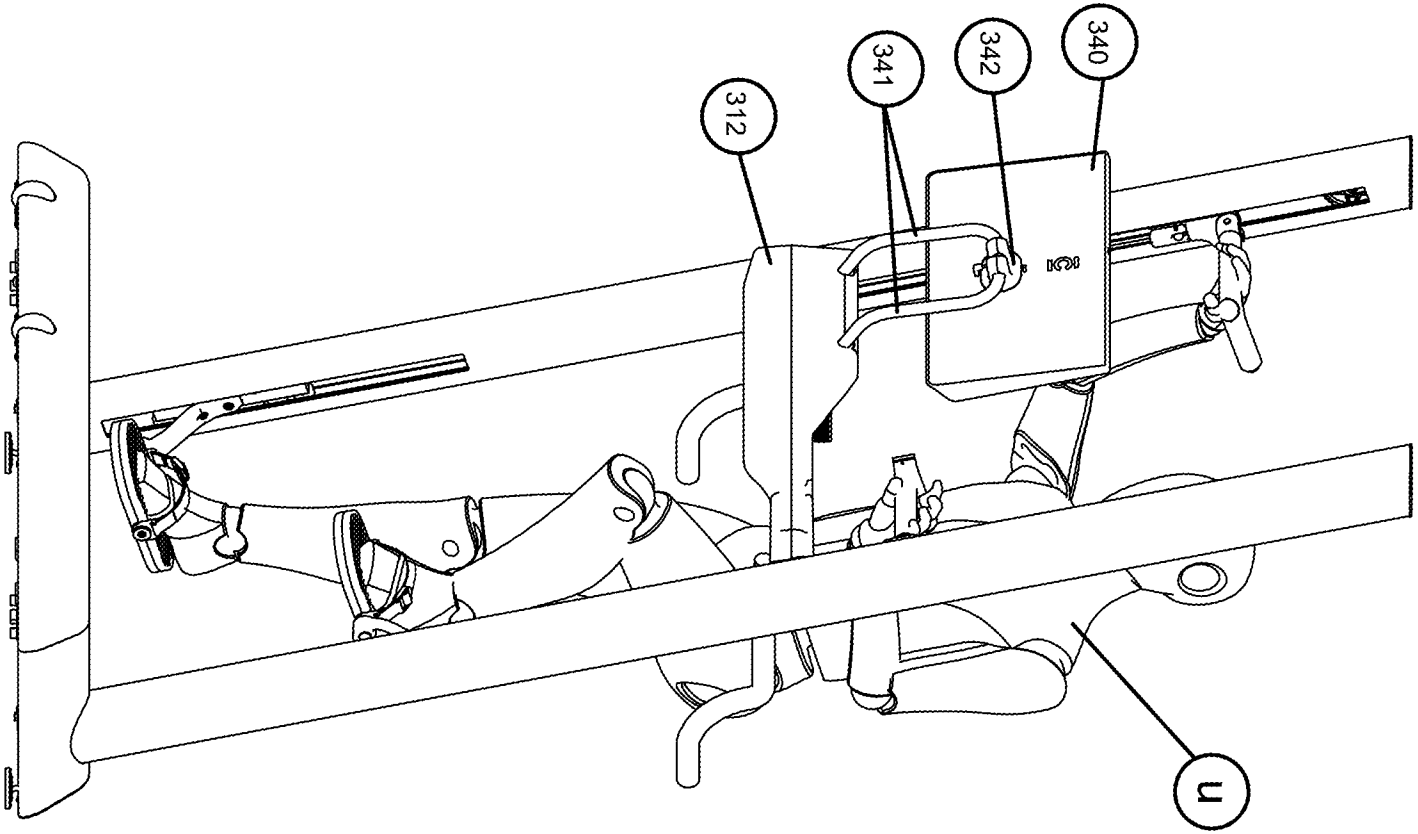
FIG. 49A illustrates a rear perspective view of a climbing exercise machine with a user mounted on the machine in a first exercise position, according to embodiments of the present invention.
Figure 49B:
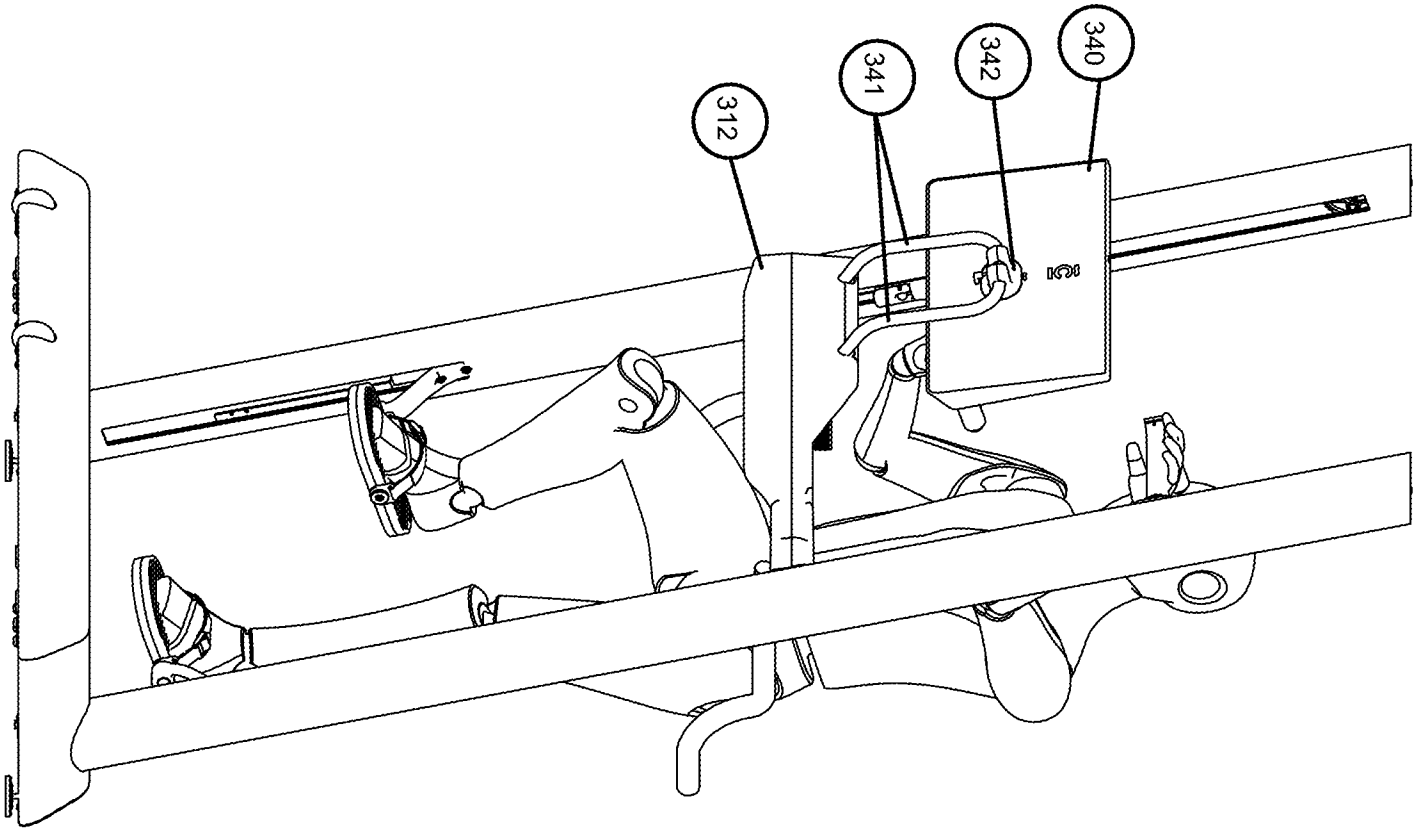
FIG. 49B illustrates a rear perspective view of a climbing exercise machine with a user mounted on the machine in a second exercise position, according to embodiments of the present invention.
Figure 49C:
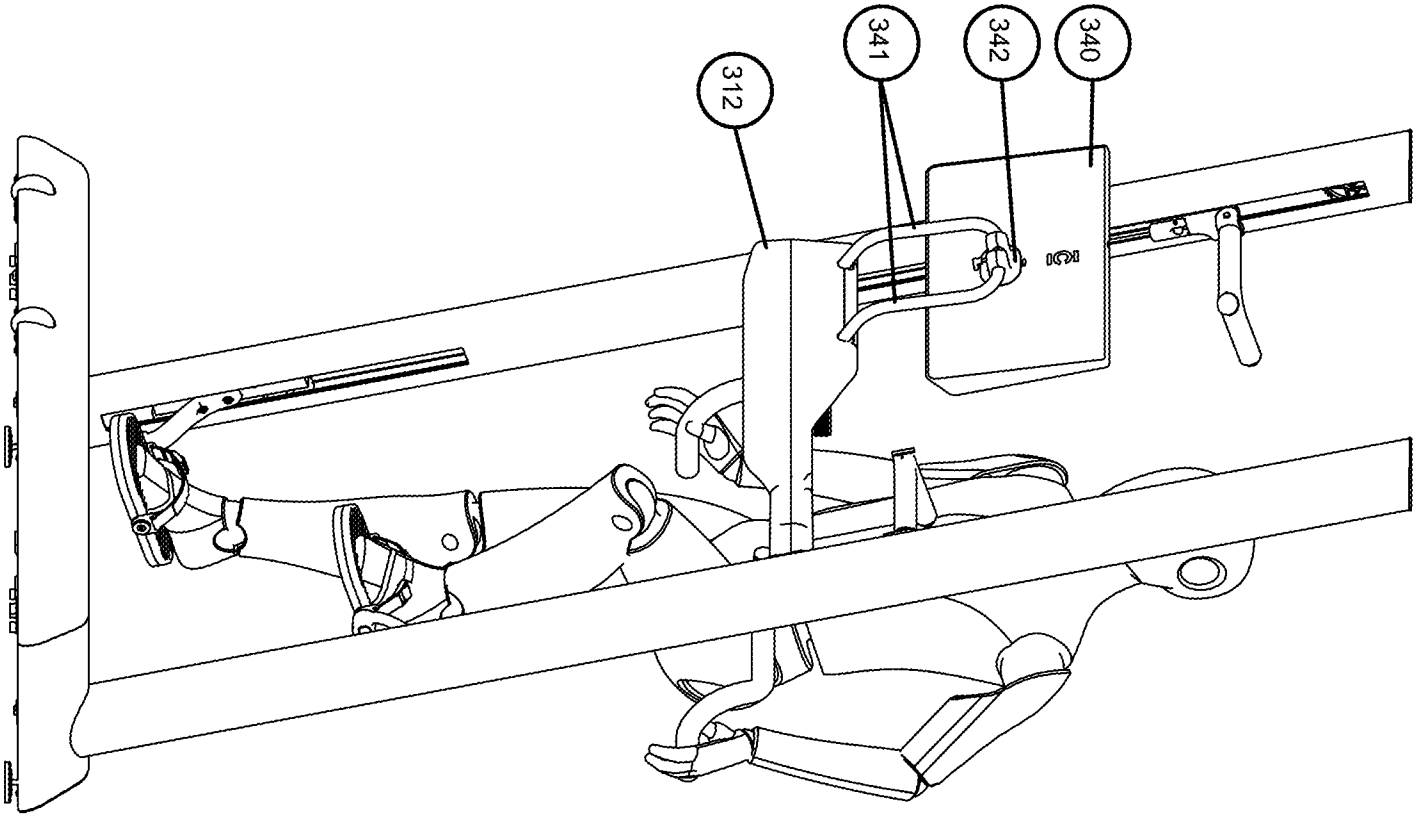
FIG. 49C illustrates a rear perspective view of a climbing exercise machine with a user mounted on the machine in a third exercise position, according to embodiments of the present invention.

FIGS. 49A-C illustrate the components that mount electronic user interface display 340 onto cross connector housing 312. FIGS. 49A-C also illustrate a user U operating machine 300 in various exercise positions.

As illustrated in FIGS. 49A-C, the lower ends of an electronic user interface display support tube 341 are rigidly connected to a forward central portion of cross connector housing 312, a portion of an electronic user interface display mounting bracket 342 is pivotally mounted on an upper central section of electronic user interface display mounting tube 341, and another portion of electronic user interface display mounting bracket 342 is rigidly connected to a central portion of electronic user interface display 340, such that electronic user interface display mounting bracket 342 couples electronic user interface display mounting tube 341 with electronic user interface display 340. The pivotal connection of electronic user interface display bracket 342 with electronic user interface display tube 341 allows user U to pivotally adjust electronic user interface display 340 about electronic user interface display support tube 341 to create a preferred viewing angle of electronic user interface display 340 for user U. Alternatively, electronic user interface display 340 can be mounted on cross connector housing 312 or other portions of machine 300 by various other methods and components to support electronic user interface display 340 and create an adjustable support for electronic user interface display 340 that allows user U to adjust electronic user interface display 340 to a preferred viewing angle; such alternatives are within the scope of the present invention.

FIG. 49A illustrates a user U operating machine 300 in a first position wherein user U's left hand is engaged with handle 318A and user U's left foot is engaged with foot pedal 321A such that user U's left arm and left leg are mostly contracted and more proximal to each other, and user U's right hand is engaged with handle 318B and user U's right foot is engaged with foot pedal 321B such that user U's right arm and right leg are mostly extended and more distal to each other. FIG. 49B illustrates a user U operating machine 300 in a second position wherein user U's left hand is engaged with handle 318A and user U's left foot is engaged with foot pedal 321A such that user U's left arm and left leg are mostly extended and more distal to each other, and user U's right hand is engaged with handle 318B and user U's right foot is engaged with foot pedal 321B such that user U's right arm and right leg are mostly contracted and more proximal to each other. As illustrated in FIGS. 49A and 49B, when user U moves from a first exercise position to a second exercise position on machine 300, user U's left hand and handle 318A move in the opposite direction of user U's left foot and foot pedal 321A, and user U's right hand and handle 318B move in the opposite direction of user U's right foot and foot pedal 321B. Furthermore, when User U moves from a first exercise position to a second exercise position on machine 300, user U's left hand and handle 318A move in the opposite direction of user U's right hand and handle 318B, and user U's left foot and left foot pedal 321A move in the opposite direction of user U's right foot and right foot pedal 321B while performing a resisted, concurrent climbing exercise motion using both arms and legs.

FIG. 49C illustrates a user U operating machine 300 in a third exercise position, wherein user U's left hand is gripping stationary hand grip 305A and user U's right hand is gripping stationary hand grip 305B so as to stabilize and secure user U on machine 300 while user U's left foot is engaged with foot pedal 321A in a higher position along upright 310A and user U's right foot is engaged with foot pedal 321B in a lower position along upright 310B, such that user U's left foot and right foot move in reciprocating opposite directions while performing a legs-only climbing exercise motion.

To operate machine 300, user U may enter machine 300 by stepping onto foot pedal 321A with user U's left foot, stepping onto foot pedal 321B with user U's right foot, gripping handle 318A with user U's left hand, and gripping handle 318B with user U's right hand. User U can then adjust the resistance to the exercise motion by moving resistance adjustment dial 359 to a preferred setting, causing resistance magnets 346 to engage flywheels 347 as previously described. If user U urges handle 318A upward, user U will necessarily concurrently urge foot pedal 321A downward, handle 318B downward, and foot pedal 321B upward.

When user U begins the exercise motion in a first direction as described, all of the various moving components of the machine 300, including handle assemblies 308, foot pedal assemblies 311, linear motion carriages 320A, 320B, 320C, 320D, linkage assemblies 350A, 350B, cross connector axle 370, and flywheel resistance assembly 349, move concurrently in a synchronized fashion. Upward motion of handle 318A and linear motion carriage 320A causes belt 317A to rotate in a first direction on guide pulley 336A and cross connector axle drive pulley 337A, in turn causing the rearward side of linkage belt 317A to move upward, in turn causing the forward side of linkage belt 317A to move downward, in turn causing connector bar 360A to move downward, in turn causing linear motion carriage 320B and foot pedal 321A to move downward. Concurrently, downward motion of handle 318B and linear motion carriage 320C causes belt 317B to rotate in a first direction on guide pulley 336B and cross connector axle drive pulley 337B, in turn causing the forward side of linkage belt 317B to move downward, in turn causing the rearward side of linkage belt 317B to move upward, in turn causing connector bar 360B to move upward, in turn causing linear motion carriage 320D and foot pedal 321B to move upward. Concurrently, cross connector axle drive pulleys 337A and 337B cause cross connector axle 370 to rotate in a first direction, in turn causing flywheel drive pulley 372A to rotate in a first direction, in turn causing flywheel drive belt 373A to rotate in a first direction, in turn causing flywheel drive pulley 372B to rotate in a first direction, in turn causing flywheel drive pulley axle 374 to rotate in a first direction, in turn causing flywheel drive pulley 374C to rotate in a first direction, in turn causing flywheel drive belt 373B to rotate in a first direction, in turn causing flywheel axle pulley 365 to rotate in a first direction, in turn causing flywheels 347 to rotate in a first direction.

When user U reverses the exercise motion to urge handles 318A and 318B and foot pedals 321A and 321B in the opposite second direction, all of the various moving components of the machine 300, including handle assemblies 308, foot pedal assemblies 311, linear motion carriages 320A, 320B, 320C, 320D, linkage assemblies 350A, 350B, cross connector axle 370, and flywheel resistance assembly 349, move concurrently in a synchronized fashion in the opposite second direction. Downward motion of handle 318A and linear motion carriage 320A causes belt 317A to rotate in a second direction on guide pulley 336A and cross connector axle drive pulley 337A, in turn causing the rearward side of linkage belt 317A to move downward, in turn causing the forward side of linkage belt 317A to move upward, in turn causing connector bar 360A to move upward, in turn causing linear motion carriage 320B and foot pedal 321A to move upward. Concurrently, upward motion of handle 318B and linear motion carriage 320C causes belt 317B to rotate in a second direction on guide pulley 336B and cross connector axle drive pulley 337B, in turn causing the forward side of linkage belt 317B to move upward, in turn causing the rearward side of linkage belt 317B to move downward, in turn causing connector bar 360B to move downward, in turn causing linear motion carriage 320D and foot pedal 321B to move downward. Concurrently, cross connector axle drive pulleys 337A and 337B cause cross connector axle 370 to rotate in a second direction, in turn causing flywheel drive pulley 372A to rotate in a second direction, in turn causing flywheel drive belt 373A to rotate in a second direction, in turn causing flywheel drive pulley 372B to rotate in a second direction, in turn causing flywheel drive pulley axle 374 to rotate in a second direction, in turn causing flywheel drive pulley 374C to rotate in a second direction, in turn causing flywheel drive belt 373B to rotate in a second direction, in turn causing flywheel axle pulley 365 to rotate in a second direction, in turn causing flywheels 347 to rotate in a second direction.

User U can continue this reciprocating first and second direction exercise motion for any preferred amount of time and/or preferred number of repetitions. User U may also interact with user interface display 340 prior to the exercise session, during the exercise session, and/or after the exercise session.

It is to be expressly understood that within the scope of the present invention, certain components or features of a climbing exercise machine 1 as illustrated in FIGS. 15-36 may be provided in addition to, or instead of, certain components or features of a climbing exercise machine 300 as illustrated in FIGS. 37-49C. By way of non-limiting example, a climbing exercise machine 300 as illustrated in FIGS. 37-49C may, within the scope of the present invention, include one or more movable electronic sensors 53 and/or one or more stationary electronic sensors 54 as illustrated in FIGS. 15-36, which may, for example, collect data that are displayed on electronic user interface display 340. By way of further non-limiting example, an electronic user interface display 340 illustrated in FIGS. 37-49C may be a part of a tablet computer 40 as illustrated in FIGS. 15-36. Those skilled in the art will, in view of this disclosure, readily appreciate how these and other features and components of the embodiments depicted in various figures may be combined and/or substituted.

The present disclosure, in various aspects, embodiments, and configurations, includes components, methods, processes, systems and/or apparatus substantially as depicted and described herein, including various aspects, embodiments, configurations, sub-combinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

The invention claimed is:

1. A climbing exercise machine, comprising:

a base support frame configured to contact a floor or ground surface;

a first elongate upright having a first end and a second end, wherein the first end is rigidly connected to the base support frame;

a crossbar having a first end and a second end, wherein a middle, central, or intermediate portion of the crossbar is rigidly connected to the second end of the first elongate upright;

a second elongate upright having a first end and a second end, wherein the first end of the second elongate upright is rigidly connected to the first end of the crossbar such that the first elongate upright and the second elongate upright are in substantially parallel planes on opposing vertical sides of the crossbar;

a third elongate upright having a first end and a second end, wherein the first end of the third elongate upright is rigidly connected to the second end of the crossbar such that the first elongate upright and the third elongate upright are in substantially parallel planes on opposing vertical sides of the crossbar;

first and second movable and adjustable foot pedals, operatively engaged with opposing lateral sides of the first elongate upright to enable reciprocating linear movement along the first elongate upright;

a first movable and adjustable handle, operatively engaged with the second elongate upright to enable reciprocating linear movement along the second elongate upright;

a second movable and adjustable handle, operatively engaged with the third elongate upright to enable reciprocating linear movement along the third elongate upright; and a linkage assembly, interconnecting the first handle, the first foot pedal, the second handle, and the second foot pedal, comprising a rail and a belt, wherein the interconnection provided by the linkage assembly enables reciprocating concurrent movement of the first handle, the first foot pedal, the second handle, and the second foot pedal to simulate a climbing motion for a user.

2. The climbing exercise machine of claim 1, further comprising an electronic device or system enabling the user to perceive digital content while using the climbing exercise machine.

3. The climbing exercise machine of claim 2, wherein the electronic device or system comprises a tablet computer mounted on a mounting apparatus of the climbing exercise machine.

4. The climbing exercise machine of claim 3, wherein the electronic device or system further comprises at least one sensor, disposed within or on a surface of the climbing exercise machine and configured to transmit data pertaining to a function of the climbing exercise machine to the tablet computer.

5. The climbing exercise machine of claim 4, wherein the at least one sensor comprises at least two sensors.

6. The climbing exercise machine of claim 5, wherein the at least two sensors comprise a stationary electronic sensor and a movable electronic sensor, wherein the movable electronic sensor is mounted on a forward section of a handle adjustment plate and the stationary electronic sensor is mounted on a section of the first elongate upright adjacent to the handle adjustment plate.

7. The climbing exercise machine of claim 6, wherein, when the handle adjustment plate moves in a reciprocating linear pattern along one of the second and third elongate uprights, the movable electronic sensor passes in close proximity to the stationary electronic sensor.

8. The climbing exercise machine of claim 5, wherein the at least two sensors measure a parameter of interest to the user according to an algorithm, and wherein the parameter of interest is presented to the user in a graphical user interface of the tablet computer.

9. The climbing exercise machine of claim 3, wherein the mounting apparatus is adjustable such that the user can adjust at least one of an angle of the tablet computer relative to the first and second elongate uprights and a height of the tablet computer above the floor or ground surface.

10. The climbing exercise machine of claim 3, wherein the tablet computer is configured to allow the user to input data corresponding to the workout preferences of the user and display to the user data corresponding to exercise performance and experience of the user.

11. The climbing exercise machine of claim 1, wherein the linkage assembly further comprises a plurality of self-lubricating slides, wherein each of the plurality of self-lubricating slides is connected to one of the first handle, the first foot pedal, the second handle, and the second foot pedal.

12. The climbing exercise machine of claim 11, wherein the plurality of self-lubricating slides are operatively mounted on the rail.

13. The climbing exercise machine of claim 1, wherein movement of one of the first and second handles or one of the first and second foot pedals causes concurrent motion of all other of the first and second handles and the first and second foot pedals.

14. The climbing exercise machine of claim 13, wherein the concurrent motion of the first and second handles and the first and second foot pedals simulates a contralateral climbing motion.

15. The climbing exercise machine of claim 13, wherein the concurrent motion of the first and second handles and the first and second foot pedals simulates an ipsilateral climbing motion.

16. The climbing exercise machine of claim 1, wherein a horizontal distance between the second and third elongate uprights is adjustable.

17. The climbing exercise machine of claim 1, wherein the base support frame comprises a plurality of base members extending away from the first upright.

18. The climbing exercise machine of claim 1, wherein the first end of the first elongate upright is rigidly connected to the base support frame at a first obtuse angle relative to the floor or ground surface, wherein the first obtuse angle is adjustable.

19. The climbing exercise machine of claim 1, wherein locations of the first handle and the first foot pedal relative to each other are adjustable prior to operation of the climbing exercise machine and locations of the second handle and the second foot pedal relative to each other are adjustable prior to operation of the climbing exercise machine.

20. The climbing exercise machine of claim 1, further comprising an adjustable resistance mechanism, interconnected with the first handle, the first foot pedal, the second handle, and the second foot pedal to provide resistance to motion of the first handle, the first foot pedal, the second handle, and the second foot pedal.

* * * * *